US005110374A

United States Patent [19]

Takeshita et al.

[11] Patent Number: 5,110,374

[45] Date of Patent: May 5, 1992

[54] RARE EARTH-IRON-BORON MAGNET POWDER AND PROCESS OF PRODUCING SAME

[75] Inventors: Takuo Takeshita; Ryoji Nakayama; Tamotsu Ogawa, all of Omiya, Japan

[73] Assignee: Mitsubishi Materials Corporation, Tokyo, Japan

[21] Appl. No.: 534,185

[22] Filed: Jun. 6, 1990

Related U.S. Application Data

[62] Division of Ser. No. 234,405, Aug. 19, 1988, Pat. No. 4,891,532.

[30] Foreign Application Priority Data

| | | | |
|---|---|---|---|
| Aug. 19, 1987 | [JP] | Japan | 62-205944 |
| Sep. 22, 1987 | [JP] | Japan | 62-238341 |
| Feb. 29, 1988 | [JP] | Japan | 63-46309 |
| Mar. 23, 1988 | [JP] | Japan | 63-68954 |
| Jun. 28, 1988 | [JP] | Japan | 63-159758 |

[51] Int. Cl.[5] ..... H01F 1/02

[52] U.S. Cl. ..... 148/101; 148/104; 148/105; 241/18; 241/24; 241/29

[58] Field of Search ..... 148/101, 102, 103, 104, 148/105; 419/12, 33; 241/18, 24, 29

[56] References Cited

U.S. PATENT DOCUMENTS

| | | | |
|---|---|---|---|
| 4,558,077 | 12/1985 | Gray | 523/548 |
| 4,770,702 | 9/1988 | Ishigaki et al. | 148/302 |
| 4,770,723 | 9/1988 | Sagawa et al. | 148/302 |

FOREIGN PATENT DOCUMENTS

| | | | |
|---|---|---|---|
| 0125752 | 11/1984 | European Pat. Off. . | |
| 0234031 | 9/1987 | European Pat. Off. | 148/105 |
| 59-219904 | 12/1984 | Japan . | |
| 60-17905 | 1/1985 | Japan . | |
| 60-257107 | 12/1985 | Japan . | |
| 61-179801 | 8/1986 | Japan . | |
| 61-214505 | 9/1986 | Japan . | |
| 61-266502 | 11/1986 | Japan . | |
| 62-23903 | 1/1987 | Japan . | |
| 63-53202 | 3/1987 | Japan . | |
| 62-137808 | 6/1987 | Japan . | |
| 63-90104 | 4/1988 | Japan | 148/104 |

OTHER PUBLICATIONS

"The Hydrogen Decrepitation of an $Nd_{15}Fe_{77}B_8$ Magnetic Alloy" J. of the Less Common Metals; 106 (Sep. 1985) L1-L4.

"Hydrogen Absorption and Desorption in $Nd_2Fe_{14}B$"; Appl. Phys. Lett. 48(6), Feb. 10, 1986, Cadogan et al.

"Novel Reading Media: $Fe_{14}R_2B$ Particles"; IEE Trans. on Magnetics, vol. May-22, No. 5, Sep., 1986.

*Primary Examiner*—John P. Sheehan

*Attorney, Agent, or Firm*—Scully, Scott, Murphy & Presser

[57] ABSTRACT

In a rare earth-iron-boron alloy magnet powder, each individual particle includes a recrystallized grain structure containing a $R_2Fe_{14}B$ intermetallic compound phase as a principal phase thereof, wherein R represents a rare earth element. The intermetallic compound phase are formed of recrystallized grains of a tetragonal crystal structure having an average crystal grain size of 0.05 μm to 50 μm. For producing the above magnet powder, a rear earth-iron-boron alloy material is first prepared. Then, hydrogen is occluded inot the alloy material by holding the material at a temperature of 500° C. to 1,000° C. either in an atmosphere of hydrogen gas or in an atmosphere of hydrogen and inert gases. Subsequently, the alloy material is subjected to dehydrogenation at a temperature of 500° C. to 1,000° C. until the pressure of hydrogen in the atmosphere is decreased to no greater than $1\times10^{-1}$ torr, and is subjected to cooling.

12 Claims, 33 Drawing Sheets

1μm

RARE EARTH-IRON-BORON MAGNET POWDER AND PROCESS OF PRODUCING SAME

This is a divisional of copending application Ser. No. 234,405, filed on Aug. 19, 1988 now U.S. Pat. No. 4,981,532.

BACKGROUND OF THE INVENTION

1. Field of the Invention

The present invention relates to rare earth-iron-born alloy magnet powders with improved magnetic properties, and to a process of producing the same.

2. Prior Art

Rare earth-iron-boron alloy magnet powders, comprising iron (Fe), boron (B) and a rare earth element inclusive of yttrium (Y) (which will be hereinafter represented by R), have been developed mainly for use as bonded magnets since rare earth-iron-boron alloys attracted attention as permanent magnet materials having superior magnetic properties. The bonded magnet is inferior in magnetic properties to the magnet powder contained therein or to other sintered magnets of the same kind, but is superior in physical strength and has such a high degree of freedom that it can be formed freely into an arbitrary shape, thereby varying application rapidly in recent years. Such bonded magnet is comprised of magnet powder bonded with organic or metal binders or the like, and its magnetic properties are influenced by those of the magnet powder.

In the alloy magnet powders as described above, their magnetic properties depend greatly on the structures of the alloy magnet powders, and hence research has been directed toward magnet powders with structures which make the best use of such superior magnetic properties of the alloys.

The rare earth-iron-boron alloy magnet powders hitherto known have been produced by various methods.

(1) Japanese Patent Application A-Publication Nos. 59-219904, 60-257107 and 62-23903 describe a method of producing magnet powder which comprises crushing ingots, coarse powder or permanent magnets of the rare earth-iron-boron alloy by means of various mechanical crushing methods or a decrepitation or disintegration method involving hydrogenation-dehydrogenation.

FIG. 1 (*a*) of the accompanying drawings schematically depicts one particle of rare earth-iron-boron alloy coarse powder which comprises a $R_2Fe_{14}B$ intermetallic phase 1, a R-rich phase 2 and a B-rich phase 3, the $R_2Fe_{14}B$ phase 1 serving as a principal phase. The coarse powder is crushed into fine powder, $R_2Fe_{14}B$ phase 1 of which is subjected to transgranular or intergranular fracture, as shown in FIG. 1 (*b*). Ingots or permanent magnets could as well be utilized instead of the coarse powder. p The alloy magnet powder crushed in this way keeps the structure of coarse powder, ingots or permanent magnets unchanged, and $R_2Fe_{14}B$ phase 1 of each individual powder particle may be monocrystal or polycrystal depending upon the degree of crushing. For practical use, the magnet powder should have an average particle size ranging from several micrometers to several hundred micrometers, and its $R_2Fe_{14}B$ phase has an average crystal grain size of 3 micrometers to several ten micrometers.

(2) Japanese Patent Application A-Publication Nos. 61-266502, 61-179801 and 61-214505 disclose the step of subjecting the magnet powder obtained according to the above method (1) to heat treatment to relieve strain or a further step of heating the powder at 800° C. to 1,100° C. to produce powder aggregates, in order to improve the coercivities. $R_2Fe_{14}B$ phase of each individual particle of the powder is also kept unchanged during such treatment.

(3) Japanese Patent Application A-Publication Nos. 60-17905 and 60-207302 describe a method of producing rare earth-iron-boron alloy magnet powder which comprises the step of quenching a molten alloy by means of rapid quenching or atomizing to produce magnet powder. The magnet powder thus obtained may be subjected to heat treatment to improve the coercivities as occasion demands.

FIG. 2 schematically depicts one particle of the rare earth-iron-boron alloy magnet powder obtained by quenching a molten alloy. The powder particle has a polycrystalline structure of $R_2Fe_{14}B$ phase 1, and there exist in its grain boundaries R-rich amorphous phase 2' surrounding the $R_2Fe_{14}B$ phase 1. Such magnet powder has an average particle size of several micrometers to several hundred micrometers. The average crystal grain size of the $R_2Fe_{14}B$ phase is of the order of several ten nanometers when the rapid quenching method is applied but is of the order of several ten micrometers in the case of the atomizing method.

The structure of the magnet powder thus produced is the one formed by solidification of the quenched molten alloy, or the one obtained by nucleation and growth of $R_2Fe_{14}B$ phase through heat treatment at need. Therefore, the crystal orientations of the crystal grains in $R_2Fe_{14}B$ phase are arbitrary, and the easy axes of magnetization of the magnetocrystalline anisotropy can be shown by the arrows designated at A in FIG. 2. Accordingly, each powder particle is not crystal anisotropic but isotropic, and hence is isotropic in its magnetic properties.

Other methods such as coreduction method and vapor phase method could as well be practiced to obtain rare earth-iron- boron alloy magnet powders, but the powders obtained by such method have structures similar to those of the powders produced by the aforementioned methods.

As described above, the prior art alloy powder has been such that its structure is defined by the structure of the ingots, coarse powder or permanent magnets kept unchanged, the one formed by solidification of quenched alloy melt, or the one obtained by heat treatment of such solidified structure.

Generally, it is assumed that in order to exhibit superior magnetic properties, the structure of the rare earth-iron boron magnet powder should satisfy the following conditions:

(i) $R_2Fe_{14}B$ phase serving as the principal phase has an average crystal grain size of no greater than 50 μm, preferably no greater than 0.3 μm, wherein the crystal grains can be particles of a single magnetic domain.

(ii) The principal phase has in its grains or at the grain boundaries neither impurities nor strain which may serve as nuclei upon the generation of reverse magnetic domain.

(iii) There exists R-rich phase or R-rich amorphous phase at crystal grain boundaries of the $R_2Fe_{14}B$ phase, and the crystal grains of the $R_2Fe_{14}B$ phase are surrounded by the R-rich phase or R-rich amorphous phase.

(iv) The easy axes of magnetization of the crystal grains in each individual magnet powder are aligned and hence the magnet powder has a magnetic anisotropy.

The magnet powder obtained by the above method (1), however, is usually crushed so as to have an average particle size of no less than 3 μm, and the $R_2Fe_{14}B$ phase is subjected to transgranular or intergranular fracture as shown in FIG. 1. Accordingly, the structure of the magnet powder does not become a structure wherein the crystal grains of $R_2Fe_{14}B$ phase 1 are surrounded by R-rich phase 2 but become the one wherein a part of the R-rich phase 2 is allowed to adhere to a part of $R_2Fe_{14}B$ phase 1, and strain caused during the crushing still remains. As a result, the prior art magnet powder by the method (1) exhibits a coercivity (iHc) of the order of only 0.5 to 3 KOe. As regards the magnet powder produced according to the method (2), when such magnet powder is employed to produce a bonded magnet, the coercivity of the resulted bonded magnet decreases with the increased molding pressure. The bonded magnet formed by pressing under a pressure of 5 tons/cm$^2$ in an orienting magnetic field, for example, has a coercivity of no greater than 5 KOe, thereby being inferior in its magnetic properties.

In the magnet powder produced according to the method (3), the crystal orientations of the crystal grains in the $R_2Fe_{14}B$ phase are arbitrary and each powder particle is isotropic in its magnetic properties. When such magnet powder is used to produce a bonded magnet, the resulted magnet exhibits a great coercivity of the order of 8 to 15 KOe. However, a great magnetic field of 20 to 45 KOe is required for magnetization since the powder is isotropic, thereby limiting its practical use.

Further, in the magnet powders produced according to the above methods, the fact that R-rich phase and R-rich amorphous phase exist at the grain boundaries of crystal grains of the $R_2Fe_{14}B$ phase in such a manner as to be surrounded thereby is considered to be responsible for greater coercivities. Accordingly the existence of the grain boundary phase has reduced the percentage by volume of $R_2Fe_{14}B$ phase, to thereby lower the value of magnetization of the magnetic powder.

Thus, the prior art alloy magnet powders have not made the best use of the magnetic properties which the rare earth-iron- boron alloy intrinsically possesses.

SUMMARY OF THE INVENTION

It is therefore a primary object of the present invention to provide a rare earth-iron-boron alloy magnet powder which exhibits much superior magnetic properties when used as a bonded magnet.

Another object of the invention is to provide an improved process which can produce the above magnet powder from an alloy material with a high yield.

According to the first aspect of the invention, there is provided a rare earth-iron-boron alloy magnet powder, each individual particle of which comprises a recrystallized grain structure containing a $R_2Fe_{14}B$ intermetallic compound phase as a principal phase thereof, wherein R represents a rare earth element, the intermetallic compound phase consisting of recrystallized grains of a tetragonal crystal structure having an average crystal grain size of 0.05 μm to 50 μm.

According to the second aspect of the invention, there is provided a process of producing a rare earth-iron-boron alloy magnet powder comprising the steps of:

(a) preparing a rare earth-iron-boron alloy material;

(b) subsequently occluding hydrogen into the material by holding the material at a temperature of 500° C. to 1000° C. in an atmosphere of a gas selected from the group consisting of hydrogen gas and a mixture of hydrogen and inert gases:

(c) subsequently subjecting the alloy material to dehydrogenation at a temperature of 500°0 C. to 1,000° C. until the pressure of hydrogen in the atmosphere is decreased to no greater than $1\times10^{-1}$ torr; and (d) subsequently cooling the alloy material.

BRIEF DESCRIPTION OF THE DRAWINGS

FIG. 1 (*b*) is a view of particles of a prior art rare earth alloy magnet obtained by crushing the coarse powder of FIG. 1 (*a*);

FIG. 3(*b*) is a schematic view of the particle obtained by treating the powder of FIG. 3 (*a*), the particle having recrystallized grains of $R_2Fe_{14}B$ phase formed therein;

FIG. 3(*c*) is a schematic view of the particle of a rare earth alloy magnet powder in accordance with the present invention obtained by treating the powder of FIG. 3(*b*), the particle having a recrystallized aggregate structure wherein the recrystallized grains are formed at intergranular triple points;

FIG. 4(*b*) is a schematic view of the ingot or permanent magnet obtained by treating the ingot or magnet of FIG. 4 (*a*), the ingot or magnet having recrystallized grains of $R_2Fe_{14}B$ phase formed therein;

FIG. 4(*c*) is a schematic view of the ingot or permanent obtained by treating the ingot or magnet of FIG. 4(*b*), the ingot or magnet having a recrystallized aggregate structure;

FIG. 4(*d*) is a schematic view of particles of another rare earth-iron-boron alloy magnet powder in accordance with the magnet of FIG. 4(*c*);

FIG. 5(*b*) is a schematic view of the particle obtained by treating the powder of FIG. 5 (*a*), the particle having recrystallized grains of $R_2Fe_{14}B$ phase formed therein;

FIG. 5(*c*) is a schematic view of the particle of a further rare earth-iron-boron alloy magnet powder in accordance with the present invention obtained by treating the powder of FIG. 5(*b*), the particle having a recrystallized aggregate structure wherein the recrystallized grains are formed at intergranular triple points;

FIG. 6(*b*) is a schematic view of the ingot or permanent magnet obtained by treating the ingot or magnet of FIG. 6 (*a*), the ingot or magnet having recrystallized grains of $R_2Fe_{14}B$ phase formed therein;

FIG. 6(*c*) is a schematic view of the ingot or permanent magnet obtained by treating the ingot or magnet of FIG. 6(*b*), the ingot or magnet having a recrystallized aggregate structure;

FIG. 6(*d*) is a schematic view of particles of a further rare earth alloy magnet powder in accordance with the present invention, obtained by crushing the ingot or permanent magnet of FIG. 6(*c*);

FIG. 13(*b*) is a tracing of the microstructure shown in the photomicrograph of FIG. 13(*a*);

FIG. 17(*b*) is a tracing of the microstructure shown in the micrograph of FIG. 17(*a*);

FIG. 21(*b*) is a tracing of the microstructure shown in the photomicrograph of FIG. 21(*a*);

DESCRIPTION OF THE INVENTION

The inventors have made an extensive study over the improvement of the prior art magnet powders, and have obtained a rare earth-iron-boron alloy magnet powder in accordance with the present invention which exhibits superior magnetic properties when used as bonded magnets. The alloy magnet powder of the invention is characterized by a recrystallized grain structure containing a $R_2Fe_{14}B$ intermetallic compound phase as its principal phase, the $R_2Fe_{14}B$ phase consisting of recrystallized grains of a tetragonal crystal structure having an average crystal grain size of 0.05 μm to 50 μm.

In general, a recrystallized structure is the structure obtained by causing in a metal a high density of strain such as dislocations and pores and subjecting the metal to suitable heat treatment to form and grow the recrystallized grains. In the foregoing, the recrystallized $R_2Fe_{14}B$ intermetallic compound phase may occupy less than 50 % by volume, but should preferably occupy no less than 50 % by volume.

The recrystallized structure will now be described with reference to FIGS. 3 to 6 of the accompanying drawings.

Figure 3C:
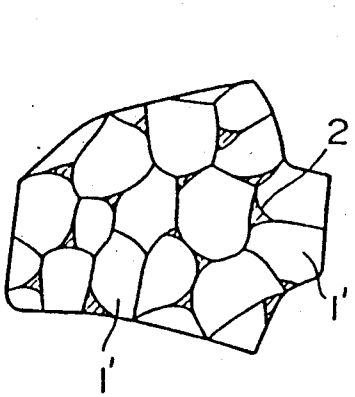
FIG. 3(*a*) is a schematic view of one particle of a powder obtained by mechanical crushing.
Figure 3B:
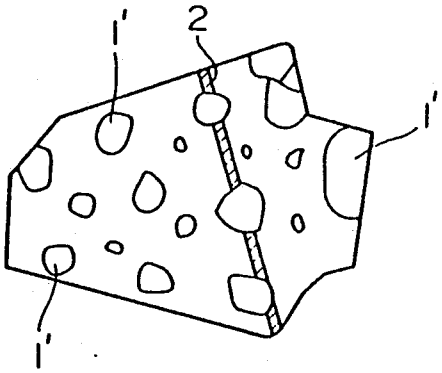
Figure 3A:
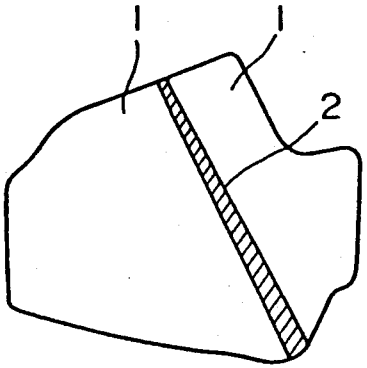
Figure 4A:
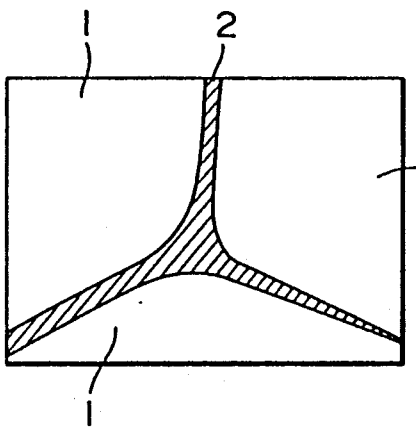
FIG. 4(*a*) is a schematic view showing a structure of a rare earth-iron-boron alloy ingot or permanent magnet.
Figure 4B:
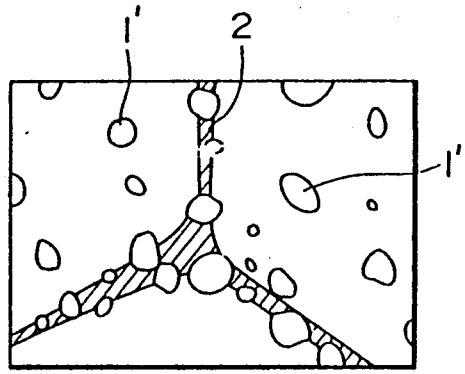
Figure 4C:
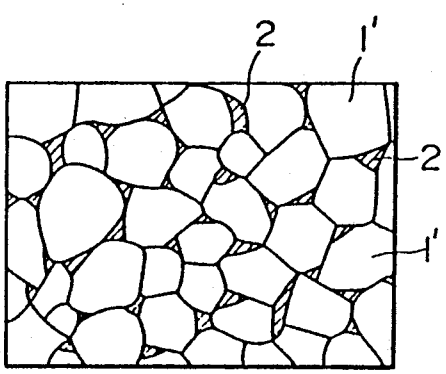
Figure 4D:
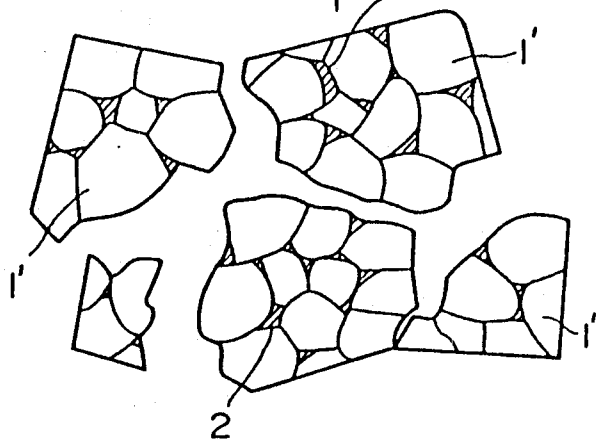

Referring first to FIGS. 3 and 4, explanation will be made as to the case where the content of the rare earth element R in the alloy material is greater than that at a composition of $R_2Fe_{14}B$, i.e., the alloy material is represented by $R_x(Fe,B)_{100-x}$, wherein $x>13$.

FIG. 3(*a*) schematically depicts one particle of the magnet powder obtained by subjecting the ingot, coarse powder or permanent magnet of a rare earth-iron-boron alloy to mechanical crushing in such a case. Such powder could as well be prepared by means of a decrepitation method based on hydrogenation-dehydrogenation. At any rate, the structure of the powder particle shown in FIG. 3(*a*) is the structure of the ingot, coarse powder or permanent magnet which has been kept unchanged.

In FIG. 3(*a*), 1 and 2 denote $R_2Fe_{14}B$ phase and R-rich phase, respectively. When the powder particle shown in FIG. 3(*a*) is treated according to the process of the invention, recrystallized grains 1' of $R_2Fe_{14}B$ phase are produced as shown in FIG. 3(*b*) and grown into a recrystallized aggregate structure of $R_2Fe_{14}B$ phase as shown in FIG. 3(*c*), the recrystallized grains of the aggregate structure having an average crystal grain size of 0.05 micrometers to several micrometers.

In the foregoing, the $R_2Fe_{14}B$ phase 1 of the powder prepared according to the prior art method is subjected to recrystallization to form recrystallized grains 1' as shown in FIG. 3 (*b*), which are further grown into a recrystallized aggregate structure as shown in FIG. 3(*c*). However, the recrystallized grains 1' of $R_2Fe_{14}B$ phase shown in FIGS. 3(*b*) and 3(*c*) are not arranged with completely random crystal orientations but define a structure with a prescribed orientation.

On the other hand, the R-rich phase is not clearly recognized at the beginning of recrystallization as will be seen from FIG. 3(*b*), but is formed at the triple points of the grain boundaries among the recrystallized grains 1' when the recrystallized grains 1' of $R_2Fe_{14}B$ phase are grown into the recrystallized aggregate structure as shown in FIG. 3(*c*).

FIG. 4(*a*) schematically depicts the structure of a rare earth-iron-boron alloy ingot or permanent magnet, which is represented by $R_x(Fe,B)_{100-x}$ where $x>13$. In FIG. 4(*a*), 1 and 2 denote $R_2Fe_{14}B$ phase and R-rich phase, respectively. When the ingot or permanent magnet shown in FIG. 4(*a*) is treated according to the process of the invention, recrystallized grains 1' of $R_2Fe_{14}B$ phase are formed in the grains or at the grain boundaries as shown in FIG. 4(*b*) and grown into a recrystallized aggregate structure of $R_2Fe_{14}B$ phase as shown in FIG. 4(*c*), the recrystallized grains of the aggregate structure having an average crystal grain size of 0.05 micrometers to several micrometers.

On the other hand, R-rich phase is not clearly recognized at the beginning of recrystallization as shown in FIG. 4(*b*), but is formed at the triple points of the grain boundaries among the recrystallized grains 1' when the recrystallized grains 1' of $R_2Fe_{14}B$ phase are grown into the recrystallized aggregate grain structure as shown in FIG. 4(*c*).

The alloy ingot or permanent magnet having the aggregate structure of recrystallized grains 1' of $R_2Fe_{14}B$ phase as shown in FIG. 4(*c*) may be crushed by means of mechanical crushing or decrepitation due to hydrogenation-dehydrogenation into a magnet powder, which may be then subjected to heat treatment to relieve strain, resulting in a magnet powder having an aggregate structure of recrystallized grains 1' as shown in FIG. 4(*d*). Such magnet powder is similar in structure to the magnet powder as shown in FIG. 3(*c*) and cannot be distinguished therefrom.

Figure 5C:
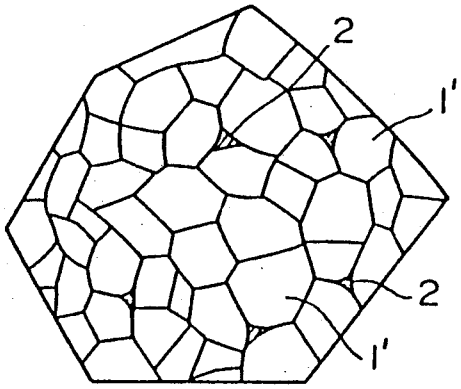
FIG. 5(*a*) is a schematic view of one particle of another powder obtained by mechanical crushing.
Figure 5B:
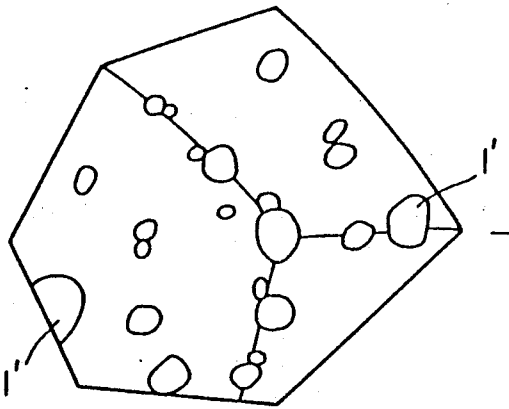
Figure 5A:
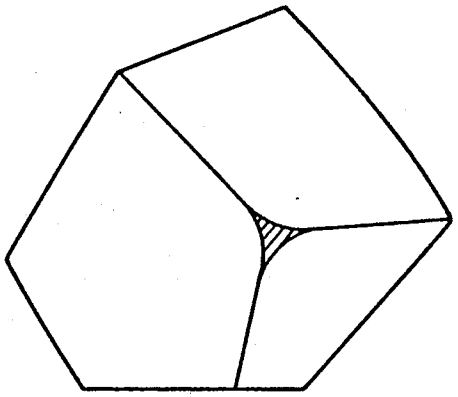
Figure 6A:
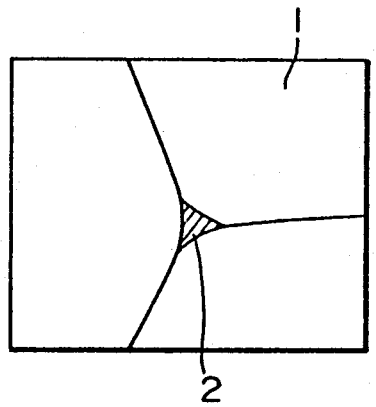
FIG. 6(*a*) is a schematic view showing a structure of another rare earth alloy ingot or permanent magnet.
Figure 6B:
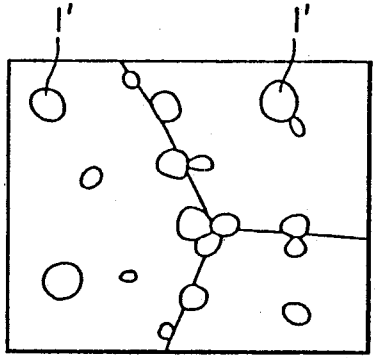
Figure 6C:
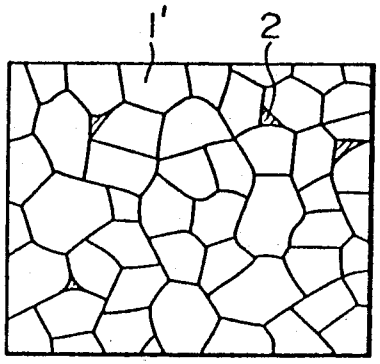
Figure 6D:
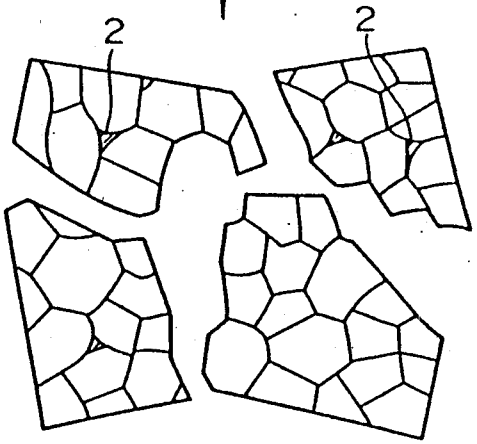

Referring next to FIGS. 5 and 6, explanation will be made as to the case where the composition of the alloy material is in the vicinity of $R_2Fe_{14}B$, i.e., the alloy material is represented by $R_x(Fe,B)_{100-x}$ wherein $11 \leqq x \leqq 13$, more preferably the case where the composition is close to $R_{12}Fe_{82}B_6$.

FIG. 5(*a*) schematically depicts one particle of the magnet powder obtained by mechanically crushing an ingot, coarse powder or permanent magnet of an alloy having composition close to $R_{12}Fe_{82}B_6$.

The powder may be formed by means of decrepitation due to hydrogenation-dehydrogenation. At any rate, the structure of the powder particle shown in FIG. 5(*a*) is the structure of the ingot, coarse powder or permanent magnet which has been kept unchanged.

In FIG. 5(*a*), 1 and 2 denote $R_2Fe_{14}B$ phase and R-rich phase, respectively. When the powder particle shown in FIG. 5(*a*) is treated according to the process of the invention, recrystallized grains 1' of $R_2Fe_{14}B$ phase are produced as shown in FIG. 5(*b*) and grown into an aggregate structure of recrystallized grains 1' of $R_2Fe_{14}B$ phase as shown in FIG. 5(*c*), the recrystallized grains of the aggregate structure having an average crystal grain size of 0.05 micrometers to several micrometers.

In the foregoing, the $R_2Fe_{14}B$ phase 1 of the powder prepared according to the prior art method are subjected to recrystallization to form recrystallized grains 1' as shown in FIG. 5 (*b*), which are further grown into a recrystallized aggregate structure as shown FIG. 5(*c*). However, the recrystallized grains 1' of $R_2Fe_{14}B$ phase in FIGS. 5(*b*) and 5(*c*) are not arranged with completely random crystal orientations but define a structure with a prescribed orientation.

The R-rich phase is not clearly recognized at the beginning of recrystallization as shown in FIG. 5(*b*). Even when the recrystallized crystal grains 1' of $R_2Fe_{14}B$ phase are grown into the recrystallized aggregate grain structure as shown in FIG. 5(*c*), the R-rich phase is only formed at some triple points of the grain boundaries among the recrystallized grains 1', and hence the recrystallized aggregate grain structure shown in FIG. 5(*c*) is substantially comprised of $R_2Fe_{14}B$ recrystallized phase.

FIG. 6(*a*) schematically depicts a structure of the alloy ingot or permanent magnet having a composition close to $R_{12}Fe_{82}B_6$. In FIG. 6(*a*), 1 and 2 denote $R_2Fe_{14}B$ phase and R-rich phase, respectively. When the ingot or permanent magnet as shown in FIG. 6(*a*) is treated according to the process of the invention, recrystallized grains 1' of $R_2Fe_{14}B$ phase are produced in the grains or at the grain boundaries as shown in FIG. 6(*b*) and grown into a recrystallized aggregate structure of $R_2Fe_{14}B$ phase as shown in FIG. 6(*c*).

The R-rich phase is not clearly recognized at the beginning of recrystallization as shown in FIG. 6(*b*). Even when the recrystallized crystal grains of $R_2Fe_{14}B$ phase are grown into the aggregate structure as shown in FIG. 6(*c*), the R-rich phase is only formed at some triple points of the grain boundaries among the recrystallized grains 1', and hence the recrystallized grain structure is substantially comprised of only the $R_2Fe_{14}B$ phase.

The alloy ingot or permanent magnet having the recrystallized aggregate structure 1' of $R_2Fe_{14}B$ phase as shown in FIG. 6(*c*) could as well be crushed by mechanical crushing or decrepitation due to hydrogenation-dehydrogenation into a magnet powder. As will be seen from FIG. 6(*c*), some particles of the magnet powder thus obtained have aggregate structures in which R-rich phase exists at some triple points of the grain boundaries among the recrystallized grains 1' and hence are similar in structure to the magnet powder shown in FIG. 5(*c*). However, others have the aggregate structures of which recrystallized grains do not contain R-rich phase at all but are comprised of 100% $R_2Fe_{14}B$ phase.

The present invention includes not only the magnet powders having an aggregate structure of recrystallized grains 1' of $R_2Fe_{14}B$ phase as shown in FIGS. 3(*c*), 4(*d*), 5(*c*) and 6(*d*) but the magnet powder comprising recrystallized grains 1' of $R_2Re_{14}B$ phase as shown in FIGS. 3(*b*) and 5(*b*) and the magnet powders obtained by the crushing of the rare earth-iron-boron alloy or permanent magnet comprising recrystallized grains 1' of $R_2Fe_{14}B$ phase as shown in FIGS. 4(*b*) and 6(*b*) as well.

Figure 1B:
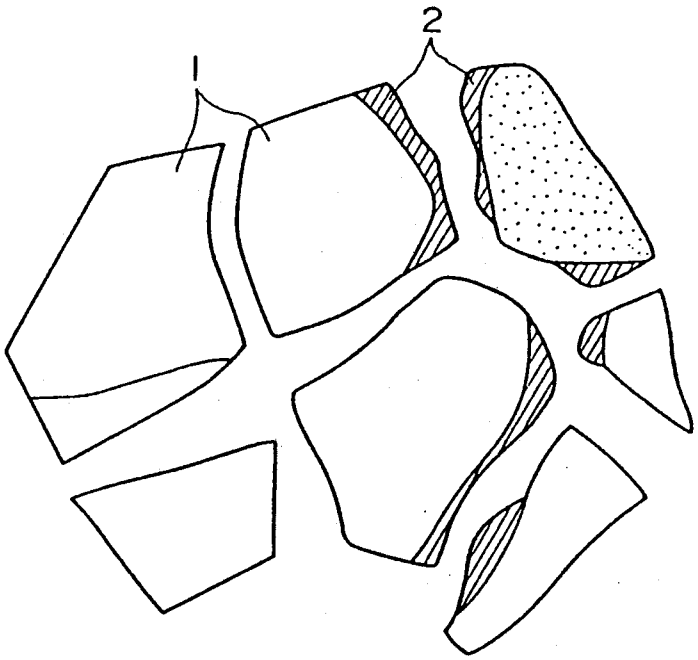
FIG. 1 (*a*) is a schematic view showing a structure of a coarse powder.
Figure 1A:
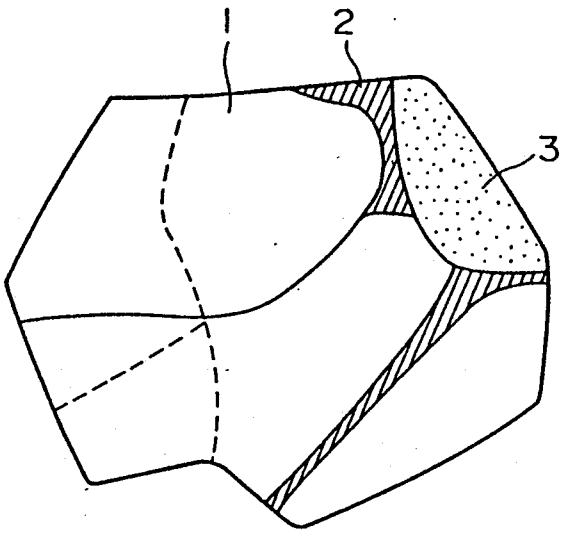
Figure 2:
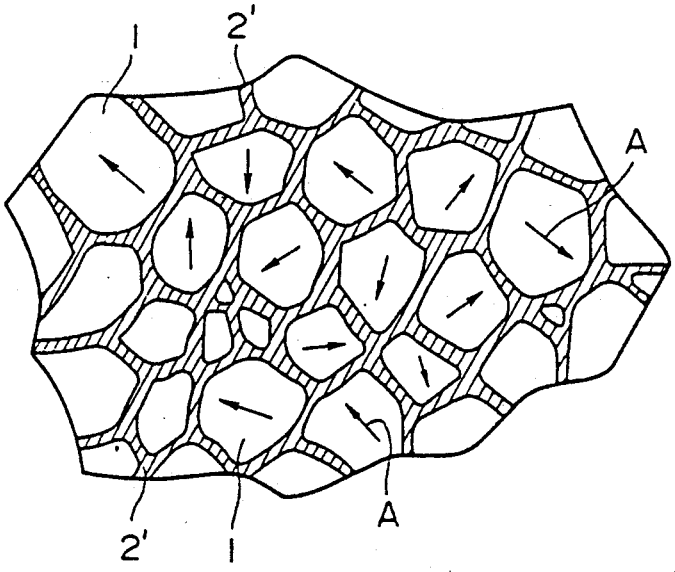
FIG. 2 is a schematic view of a structure of another prior art rare earth alloy magnet powder obtained by known atomizing method.

Accordingly, the rare earth alloy magnet powder in accordance with the present invention is characterized by a recrystallized grain structure, and quite differs from the prior art magnet powder which does not contain a recrystallized structure. Even though a molten alloy is subjected to rapid quenching or atomizing to obtain powder as shown in FIG. 2, no recrystallized structure is formed in the resulted powder.

Further, there must exist R-rich phase surrounding $R_2Fe_{14}B$ phase in order that the prior art magnet powder has a high coercivity, but the magnet powder in accordance with the present invention need not have such R-rich grain boundary phase. In the magnet powder of the invention, R-rich phase may unavoidably be formed at the triplet points of grain boundaries during the manufacture as illustrated in the case where the alloy material is represented by $R_x(Fe,B)_{100-x}$ wherein $x > 13$, but the power is substantially comprised of only the recrystallized grains of $R_2Fe_{14}B$ phase.

The alloy magnet powder in accordance with the present invention exhibits high magnetic properties since it has a recrystallized grain structure. More specifically, each individual particle of the magnet powder is comprised of recrystallized grains, and therefore there are neither impurities nor strain in the grains or at the grain boundaries. Besides, the average grain size of recrystallized grains of $R_2Fe_{14}B$ phase is regulated to be no greater than 50 μm, preferably in the range of 0.05 μm to 3 μm, which is close to 0.3 μm wherein the recrystallized grains can become particles of a simple magnetic domain. Accordingly, the magnet powder in accordance with the invention can exhibit higher coercivities. The magnet powder produced from the alloy material having a composition represented by $R_x(Fe,B)_{100-x}$, wherein $11 \leqq x \leqq 13$, exhibits particularly higher value of magnetization.

The magnet powder in accordance with the present invention should preferably have an average particle size of 2.0 to 500 μm, and the recrystallized $R_2fe_{14}B$ phase in each individual particle with the above average particle size should have an average crystal grain size of 0.05 to 50 μm, preferably of 0.05 to 3 μm.

If the average particle size of the magnet powder is less than 2.0 μm, there may arise difficulties such as the oxidation and burning of the powder when it is actually dealt. On the other hand, if the particle size exceeds 500 μm, the powder is not suitable for practical use.

If the average crystal grain size of $R_2Fe_{14}B$ phase in each individual powder particle is less than 0 05 μm, it becomes difficult to magnetize the particle. On the other hand, if the average crystal grain size exceeds 50 μm, the coercivity (iHc) becomes no greater than 5 KOe. Since the coercivity of no greater than 5 KOe falls within the range which the prior art rare earth-iron-boron alloy magnet powder possesses, the magnet powder with such coercivity is never superior in magnetic properties.

In the foregoing, a part of iron in the rare earth-iron-boron alloy magnet powder of the invention may be substituted by one or more elements selected from the group consisting of cobalt (Co), nickel (Ni), vanadiym (V), niobium (Nb), tantalum (Ta), copper (Cu), chromium (Cr), molybdenum (Mo), tungsten (W), titanium (Ti), aluminum (Al), gallium (Ga), indium (In), zirconium (Zr) and hafnium (Hf). Similarly, a part of boron may be substituted by one or more elements selected from the group consisting of nitrogen (N), phosphorus (P), sulfur (S), fluorine (F), silicon (Si), carbon (C), germanium (Ge), tin (Sn), zinc (Zn), antimony (Sb) and bismuth (Bi).

The alloy magnet powder of the invention usually has a magnetic anisotropy. However, magnetically. isotropic powder may also be manufactured sometimes. This will be explained as follows.

In the magnet powder of the invention, the recrystallized grains in each individual particle are not arranged with completely random crystal orientations but define a structure with a prescribed crystal orientation. As a result, the magnet powder, having recrystallized grains of an average crystal grain size smaller than the average crystal grain size to be determined correlatively by the average particle size of the magnet powder, becomes to have a magnetic isotropy, whereas the magnet powder, having the recrystallized grains of an average crystal grains size greater than the above determined average grain size, becomes to have a magnetic anisotropy.

Even the magnetic powders with the recrystallized structures having such magnetic isotropy can all be converted so as to have a magnetic anisotropy by making use of plastic deformation such as hot rolling and hot extrusion. This is because the crystal orientations in the individual recrystallized grains, represented by easy axes of magnetization, are caused to be aligned due to the plastic deformation. The plastic deformation may be applied not only to the powder of the invention but also to the alloy ingot, coarse powder or permanent magnet having an aggregate grain structure of $R_2Fe_{14}B$ phase. For example, the coarse powder or ingot as shown in FIGS. 3(*c*) or 6(*c*) can be converted to magnet powder with magnetic anisotropy by subjecting it to the plastic deformation, crushing it into powder by a suitable crushing method and heat-treating the crushed product to relieve strain.

The magnet powder of the present invention may be blended with the prior art magnet powder. When it was blended with the prior art rare earth-iron-boron alloy magnet powder in such a manner that the invented magnet powder occupied no less than 50 by weight of the total amount, the resulted magnet powder exhibited a coercivity of no less than 5 KOe.

One conventional method hitherto used for obtaining a recrystallized structure as described above involves the steps of causing in a metal a high density of strain such as dislocations and pores and subjecting the metal to a suitable heat treatment to form and grow the recrystallized grains. In the present invention, however, hydrogen is first occluded into $R_2Fe_{14}B$ phase to cause lattice strain therein, and then dehydrogenation is carried out at an appropriate temperature to obviate brittle fracture to develop the recovery of structure inclusive of phase transformation as well as the formation and growth of the recrystallized grains.

The process in accordance with the present invention will now be described in detail.

The process of the invention is characterized by the steps of:

(a) preparing a rare earth-iron-boron alloy material in the form of ingot, powder, homogenized ingot or homogenized powder;

(b) subsequently occluding hydrogen into the alloy material by holding the material at a temperature of 500° C. to 1,000° C. either in a hydrogen gas atmosphere or in a mixed gas atmosphere of hydrogen and inert gases;

(c) subsequently subjecting the alloy material to dehydrogenation at a temperature of 500° C. to 1,000° C. until the atmosphere becomes a vacuum atmosphere wherein the pressure of hydrogen gas is reduced to no greater than $1 \times 10^{-1}$ torr or an inert gas atmosphere wherein the partial pressure of hydrogen gas is reduced to no greater than $1 \times 10^{-1}$ torr; and (d) subsequently cooling the material or cooling the material after having subjected it to heat treatment at a temperature of 300° C. to 1,000° C.

In the step (a), the rare earth-iron-boron alloy material to be prepared may be in the form of either ingot or powder. The powder may be obtained either by the crushing of as-cast alloy ingot or by known coreduction method. In either case, it is preferable to subject the alloy in advance to homogenizing treatment by keeping it at a temperature of 600° C. to 1,200° C. With this homogenizing treatment, the magnetic properties of the magnet powder obtained from the above procedures can be markedly improved.

This is because although the rare earth alloy as-cast ingot, the powder obtained by crushing the as-cast ingot or the powder obtained from the coreduction has a microstructure essentially consisting of $R_2Fe_{14}B$ phases and R-rich phases, a non-equilibrium structure such as α-Fe phase and $R_2Fe_{17}$ phase is often formed in the $R_2Fe_{14}B$ phase. Accordingly, homogenized ingot or powder, produced by eliminating such non-equilibrium structure and essentially consisting of $R_2Fe_{14}B$ phase and R-rich phase, would rather be used as alloy material to improve the magnetic properties When the ingot or homogenized ingot is used as the material, the decrease in magnetic properties due to oxidation is prevented as compared with the case where the homogenized powder is used as the material. Besides, even though the ingot or homogenized ingot is used, an additional crushing step is not required since the ingot is to be crushed by dehydrogenation. Since the crushing step is not required, the problem regarding the oxidation of the magnet powder during the crushing can be naturally obviated.

It is preferable to use the homogenized ingot as the material as to the alloy having a composition close to that of $R_2Fe_{14}B$ phase, i.e., the alloy represented by $R_x(Fe,B)_{100-x}$, wherein $11.7 \leqq x \leqq 15$.

As regards the alloy represented by $R_x(Fe,B)_{100-x}$ wherein $x<11.7$ or $x>15$, however, the powder or homogenized powder could be used more preferably than the ingot or homogenized ingot in some cases depending upon the composition of the alloy. Relatively, there is a tendency that ingots are suitable for the alloy with smaller content of rare earth and boron while powder is better for the alloy with greater content of rare earth and boron.

The homogenization temperature should be in the range of 600° C. to 1,200° C., preferably of 900° C. to 1,100° C. If the temperature is lower than 600° C., the homogenization process consumes very long time, thereby lowering the industrial productivity. On the other hand, the temperature exceeding 1,200° C. is not preferable since the ingot or powder melts at the temperature.

In the step (b), the hydrogen gas atmosphere or the mixed gas atmosphere of hydrogen and inert gases is selected to be used. This is because such atmosphere is not only suitable for relieving strain in the material and causing the hydrogenation while preventing the oxidation, but also causes a structural change in the material to grow a recrystallized grain structure therein. If the material should be held in other atmosphere such as of only inert gas or of a vacuum, no recrystallized grain structure can be obtained. The atmosphere in the above step (b) is preferably set such that the pressure of hydrogen gas in the hydrogen atmosphere or the partial pressure of hydrogen gas in the mixed gas atmosphere is no less than 10 torr. If such is less than 10 torr, hydrogen gas could not be occluded into the alloy material to such an extent that the material undergoes a sufficient structural change. On the other hand, if the pressure is greater than 760 torr, i.e., the atmosphere is in a pressurized state, the dehydrogenation process consumes very long time, thereby being unsuitable for industrial manufacture.

The expression "holding the material at a temperature of 500° C. to 1,000° C." means not only the case where the alloy is kept at a constant temperature in the range of 500° C. to 1,000° C., but also the case where the temperature is varied up and down within the above range. The increase or decrease of the temperature may be made in a linear fashion or in a curved manner. The steps of increasing, maintaining and decreasing the temperature may be combined arbitrarily.

The atmosphere in which the alloy is heated from room temperature to elevated temperature of 500° C. to 1,000° C. may be another atmosphere such as of inert gas or vacuum although hydrogen atmosphere is preferable. However, as described above, hydrogen gas atmosphere is indispensable when keeping the alloy at the temperature of 500° C. to 1,000° C. Further, the coercivities and magnetic anisotropy of the magnet powder to be obtained can be controlled by regulating the holding temperature within the range of 500° C. to 1,000° C., the holding time and the pressure of hydrogen gas. If the holding temperature is set to be lower than 500° C., a sufficient structural change cannot be caused in the magnet powder. On the other hand, if the temperature is higher than 1,000° C., hydrogenized matters or particles of powder are welded to each other, and besides the structural change is caused too much, so that the recrystallized grains grow to such an extent that the coercivities are lowered.

After the termination of the above step (b), the dehydrogenation is carried out in the step (c) until the hydrogen atmosphere becomes a vacuum atmosphere wherein the pressure of hydrogen gas is reduced to no greater than $1\times10^{-1}$ torr or until the mixed gas atmosphere becomes an inert gas atmosphere wherein the partial pressure of hydrogen gas is reduced to no greater than $1\times10^{-1}$ torr. The purpose of this dehydrogenation step is to remove hydrogen from the alloy magnet powder almost completely. If hydrogen should remain in the magnet powder, high coercivities cannot be obtained. In order to ensure the almost complete dehydrogenation, the pressure of hydrogen or the partial pressure of hydrogen has to be decreased to $1\times10^{-1}$ torr, and the dehydrogenation temperature has to be kept in the range of 500° C. to 1,000° C. If the pressure exceeds the above value, dehydrogenation becomes insufficient. Similarly, if the dehydrogenation temperature is less than 500° C., hydrogen remains in the magnet powder even though the pressure is decreased to no greater than $1\times10^{-5}$ torr. On the other hand, if the temperature is greater than 1,000° C., hydrogenized matters or particles of powder are welded to each other, and besides the structural change is caused too much, so that the recrystallized grains grow to such an extent that the coercivities are lowered. In this dehydrogenation step, too, the temperature may be kept constant within the range of 500° C. to 1,000° C., or may be varied up and down within the above range. The increase or decrease in the temperature could as well be made in a linear or curved fashion. The steps of increasing, maintaining and decreasing the temperature may also be combined arbitrarily.

In the foregoing, the temperature ranges in the steps (b) and (c) are set to be identical to each other, but need not be identical. However, in order to prevent the grain growth of recrystallized grains to obtain magnet powder with a recrystallized grain structure having higher coercivities, the dehydrogenation should be carried out at the temperature at which the alloy material has been kept in the hydrogen or mixed gas atmosphere.

Further, after the steps (b) and (c) come to an end, they may be conducted repeatedly.

The alloy material thus subjected to almost complete dehydrogenation is then cooled by inert gas such as argon or subjected to heat treatment by being held at a constant temperature in a vacuum or inert gas atmosphere during the cooling. The purpose of such heat treatment is to improve the coercivities of the magnet powder obtained through the above steps (a) to (c), and could be carried out as occasion demands. The temperature in the heat treatment should be in the range of 300° C. to 1,000° C., preferably of 550° C. to 700° C. Such heat treatment may be effected after the material is cooled to the room temperature by the inert gas, and may be conducted once or more than twice. The cooling after the heat treatment as well as the cooling after the dehydrogenation should be carried out immediately after such prior treatment.

FIGS. 7 to 10 diagrammatically illustrate typical patterns of the procedures for the manufacture of the rare earth-iron-boron alloy magnet powder in accordance with the present invention.

Figure 7:
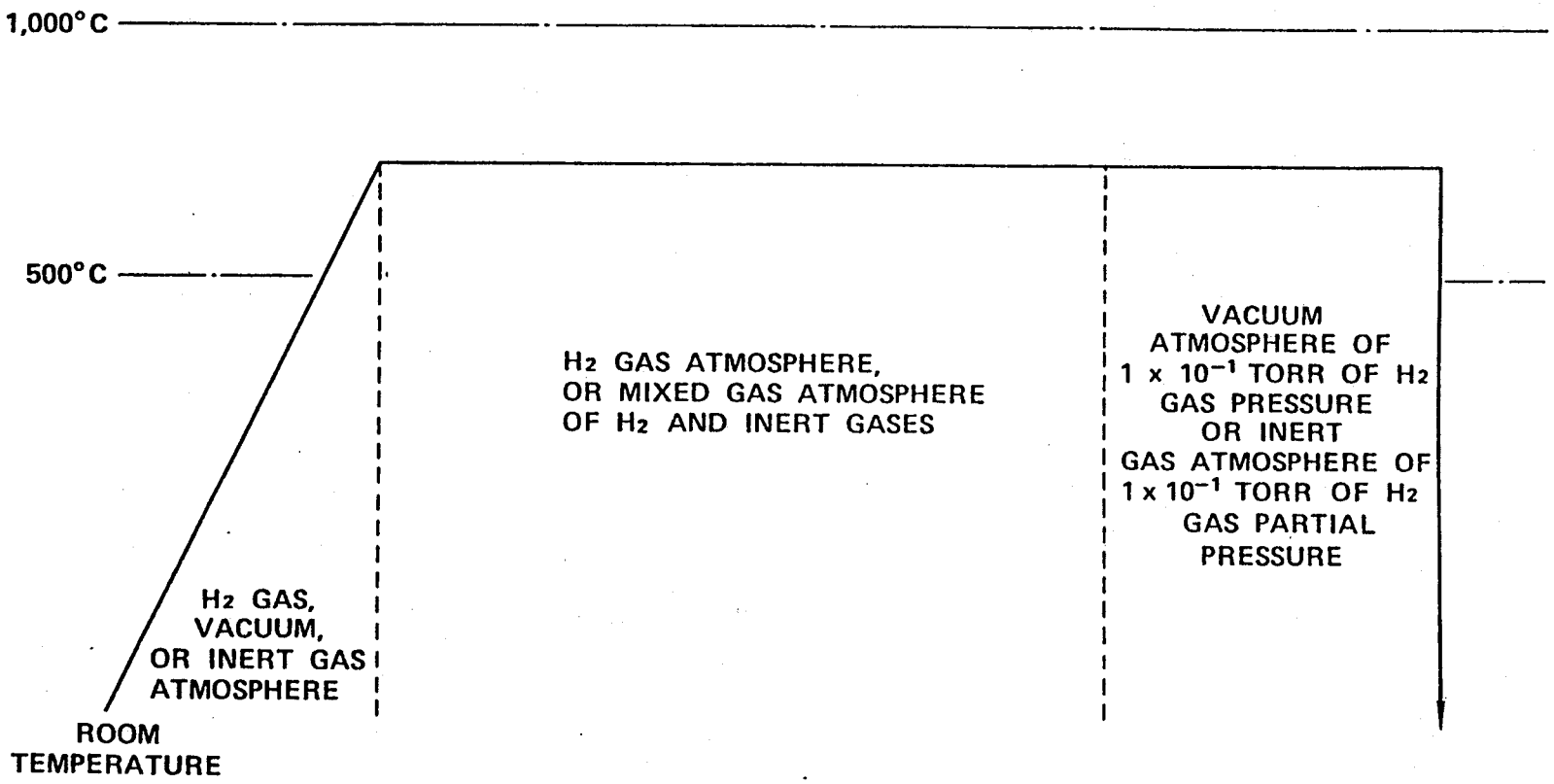
FIGS. 7 to 10 are diagrammatical representations showing typical patterns of procedures for the manufacture of the magnet alloy powder of the invention.

In the pattern shown in FIG. 7, the temperature is elevated to the range of 500° C. to 1,000° C., and while the temperature is maintained constant in that range, the alloy material is subjected to dehydrogenation until the hydrogen atmosphere becomes a vacuum atmosphere wherein the pressure of hydrogen gas is reduced to no greater than $1\times10^{-1}$ torr or until the mixed gas atmosphere becomes an inert gas atmosphere wherein the partial pressure of hydrogen gas is reduced to no greater than $1\times10^{-1}$ torr, followed by the cooling step.

Figure 8:
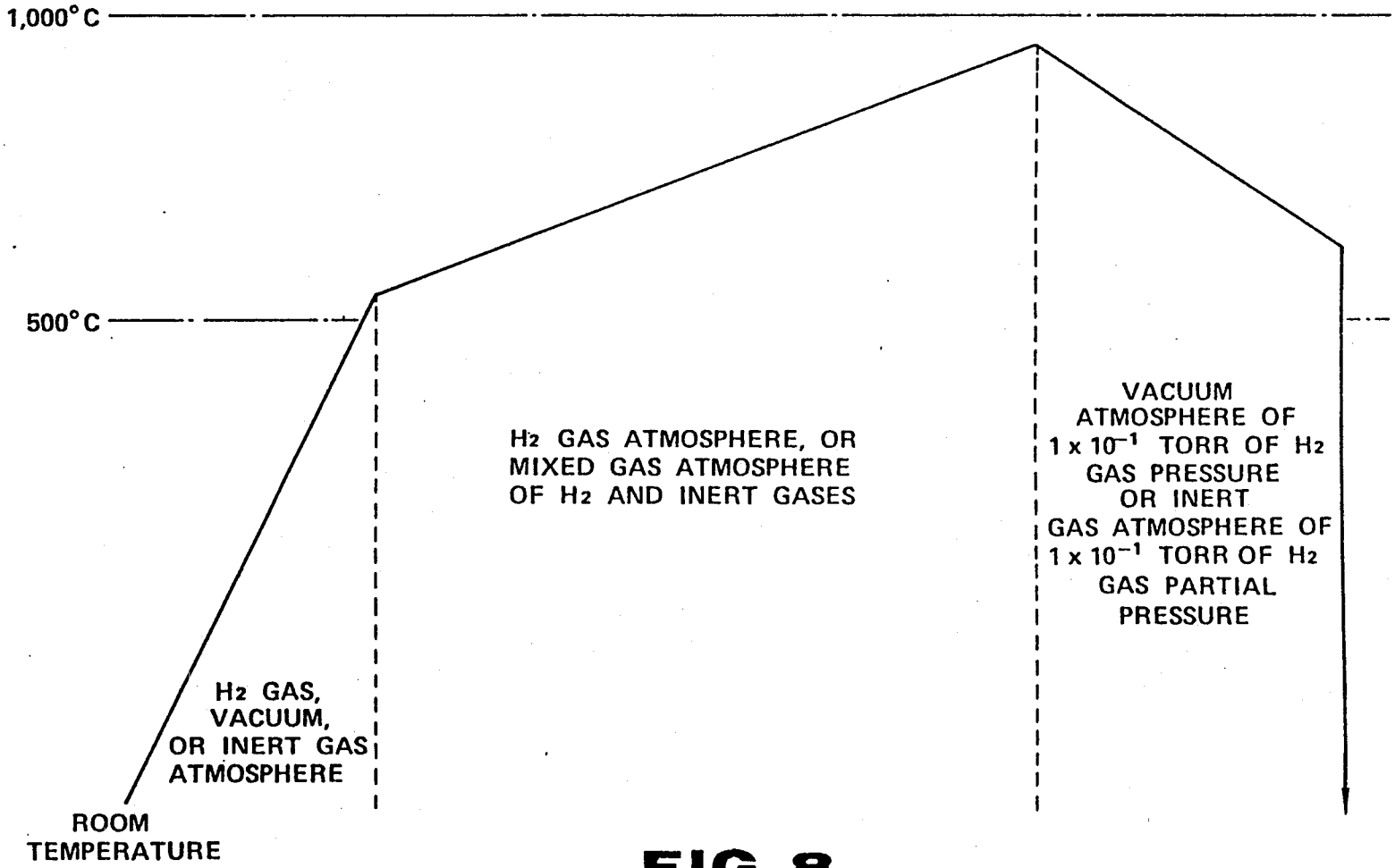

FIG. 8 shows the pattern of the procedures comprising the steps of elevating the temperature within the range of 500° C. to 1,000° C. in a hydrogen gas atmosphere or in a mixed gas atmosphere of hydrogen and inert gases, subsequently subjecting the material to dehydrogenation until the hydrogen atmosphere becomes a vacuum atmosphere wherein the pressure of hydrogen gas is reduced to no greater than $1\times10^{-1}$ torr or until the mixed gas atmosphere becomes an inert gas atmosphere wherein the partial pressure of hydrogen gas is reduced to no greater than $1\times10^{-1}$ torr while decreasing the temperature within the range of 500° C. to 1,000° C., and subsequently cooling the material.

Figure 9:
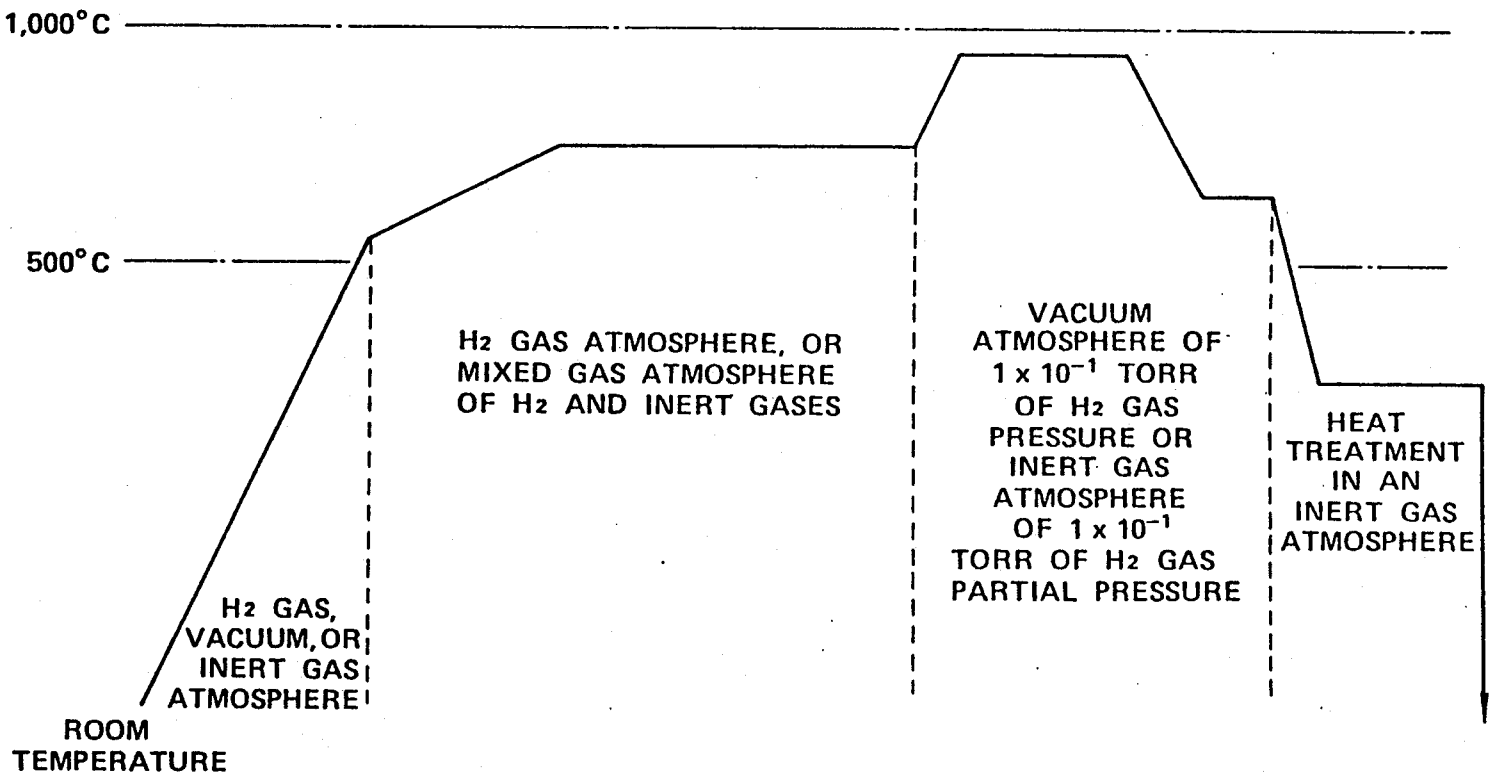

FIG. 9 shows the pattern of the procedures comprising the steps of first elevating the temperature within the range of 500° C. to 1,000° C. in a hydrogen gas atmosphere or in a mixed gas atmosphere of hydrogen and inert gases and then maintaining the temperature constant within the range in the same atmosphere, subsequently subjecting the material to dehydrogenation until the hydrogen atmosphere becomes a vacuum atmosphere wherein the pressure of hydrogen gas is reduced to no greater than $1\times10^{-1}$ torr or until the mixed gas atmosphere becomes an inert gas atmosphere wherein the partial pressure of hydrogen gas is reduced to no greater than $1\times10^{-1}$ torr while elevating, maintaining and decreasing the temperature within the range of 500° C. to 1,000° C., subsequently subjecting the material to heat treatment by holding it at a constant temperature, and subsequently cooling the material.

Figure 10:
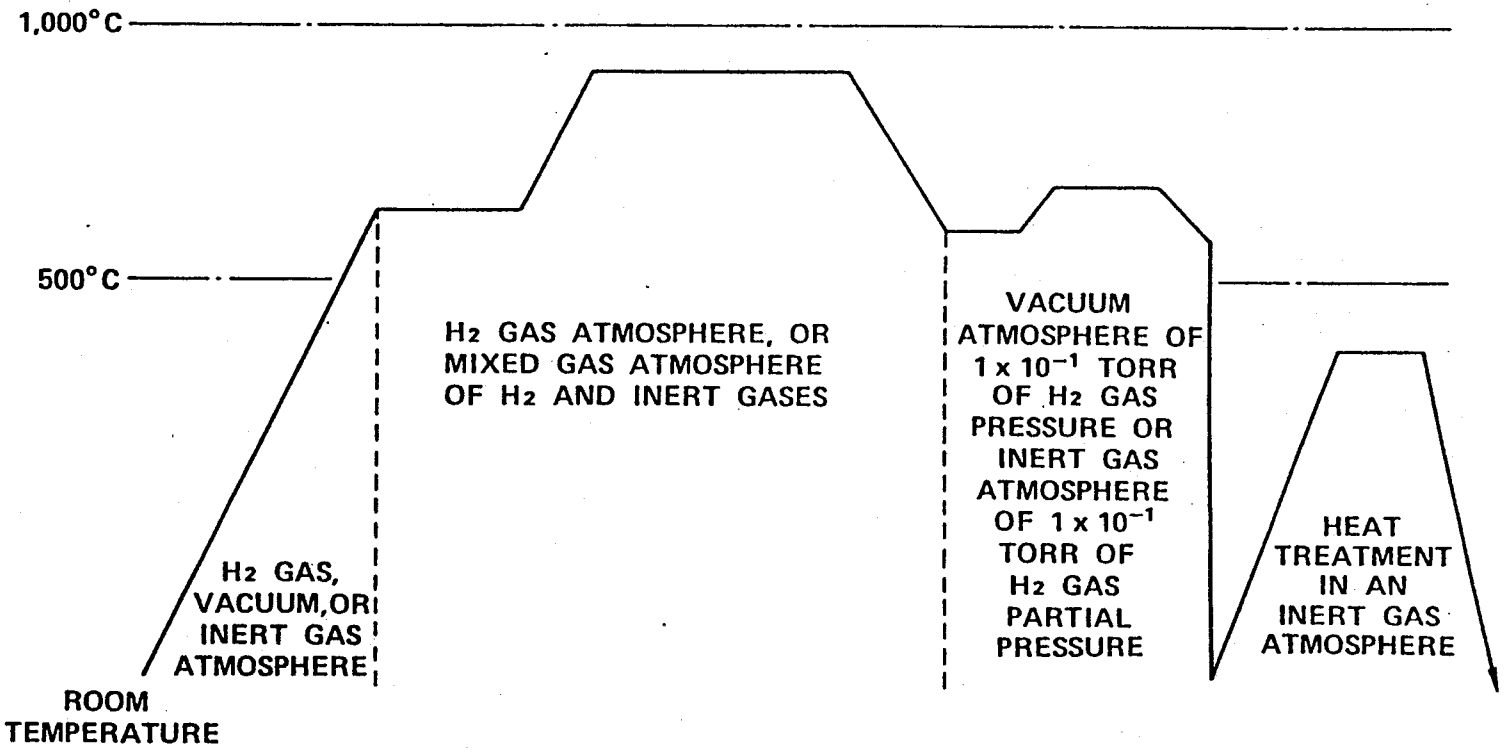
Figure 11A:
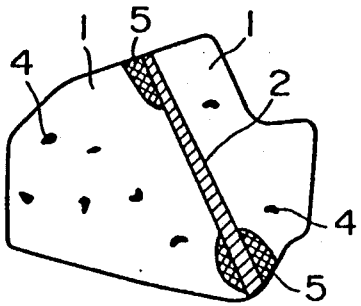
FIG. 11 is a view similar to FIG. 3, but showing the case where homogenization treatment is required.
Figure 11B:
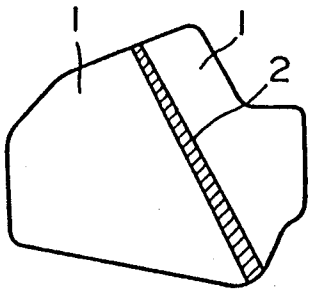
Figure 11C:
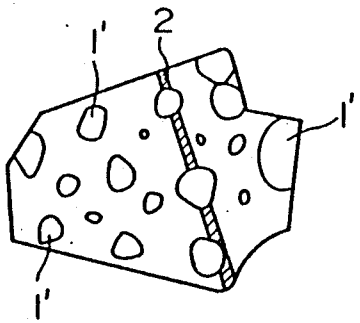
Figure 11D:
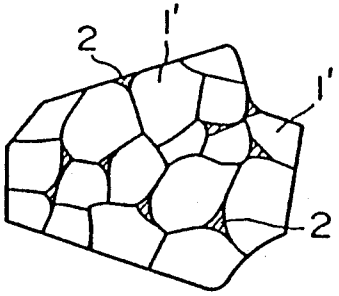

FIG. 10 shows the pattern comprising the steps of elevating, maintaining and decreasing the temperature within the range of 500° C. to 1,000° C. in a hydrogen gas atmosphere or in a mixed gas atmosphere of hydrogen and inert gases, subsequently subjecting the material to dehydrogenation until the hydrogen atmosphere becomes a vacuum atmosphere wherein the pressure of hydrogen gas is reduced to no greater than $1\times10^{-1}$ torr or until the mixed gas atmosphere becomes an inert gas atmosphere wherein the partial pressure of hydrogen gas is reduced to no greater than $1\times10^{-1}$ torr while elevating, maintaining and decreasing the temperature within the range of 500° C. to 1,000° C., subsequently conducting the quenching to the room temperature, subsequently subjecting the material to heat treatment while elevating the temperature and holding the material at a constant temperature, and subsequently cooling the material.

The patterns as set forth in FIGS. 7 to 10 are no more than the representative presentations of the process of the present invention. The present invention, therefore, is not limited to these patterns.

When the above procedures are practiced, the rare earth- iron-boron alloy in the form of ingot, powder, homogenized ingot or homogenized powder is formed into powder having a recrystallized grain structure of $R_2Fe_{14}B$ phase. For example, when the particle shown in FIG. 3 (*a*) is treated according to the above procedures, it changes through the state shown in FIG. 3(*b*) into an aggregate grain structure as shown in FIG. 3(*c*).

The particle shown in FIG. 3 (*a*) consists of $R_2Fe_{14}B$ phase and R-rich phase. In the every day operation in the factory, however, it is rare to obtain such an ideal particle since the control of conditions in the manufacture is usually insufficient. Practically, segregation often occurs in the most of the ingots or powder, and non-equilibrium phases such as —Fe phase and $R_2Fe_{17}$ phase may exist. FIG. 11 (*a*) shows such non-equilibrium phases, in which 4 and 5 denote Fe phase and $R_2Fe_{17}$ phase, respectively.

When the ingot or powder as shown in FIG. 11 (*a*) is treated according to the procedures as described above, alloy magnet powder having relatively inferior magnetic properties can only be produced. Therefore, the ingot or powder shown in FIG. 11 (*a*) should be subjected to homogenizing treatment in advance to diffuse $\alpha$- Fe phase and $R_2Fe_{17}$ phase to eliminate them as much as possible. FIG. 11 (*b*) shows a powder thus treated, which essentially consists of $R_2Fe_{14}B$ phase and R-rich phase. This powder or ingot is further treated according to the procedures as described above, so that it changes through the state of FIG. 11 (*c*) into an aggregate grain structure as shown in FIG. 11 (*d*).

The invention will now be illustrated by the following Examples:

EXAMPLE 1

Neodymium (Nd), selected from the rare earths, was melted with iron and boron in a high frequency induction furnace and cast into a neodymium-iron-boron alloy ingot containing a principal component represented in atomic composition as $Nd_{15.0}Fe_{77.0}B_{8.0}$. The $R_2Fe_{14}B$ phase of the ingot had an average crystal grain size of 110 um. The ingot thus prepared was subjected to coarse crushing in a stamp mill in an argon atmosphere, and subsequently to fine grinding or crushing in a vibrating ball mill to produce neodymium-iron-boron alloy fine powder of an average particle size of 3.7 $\mu$m. Thereafter, an appropriate amount of the fine powder was placed on a board and fed in a heat treating furnace, and the furnace was evacuated to a vacuum of $1.0\times10^{-5}$ torr. Hydrogen gas at 1 atm was then introduced into the furnace, and the temperature was elevated from room temperature to 850° C. while the pressure of hydrogen gas was maintained constant. After arrival at 850° C., the furnace was evacuated for 30 minutes to produce a vacuum of $1.0\times10^{-5}$ torr in the furnace. Subsequently, argon gas was introduced thereinto until the pressure reached 1 atm, and rapid quenching of the fine powder was effected. The fine powder was aggregated and hence broken into pieces in a mortar, and neodymium-iron-boron alloy magnet powder having an average particle size of 5.8 um was obtained.

The resulted magnet powder was subjected to x-ray diffraction and observed by a transmission electron microscope.

Figure 12:
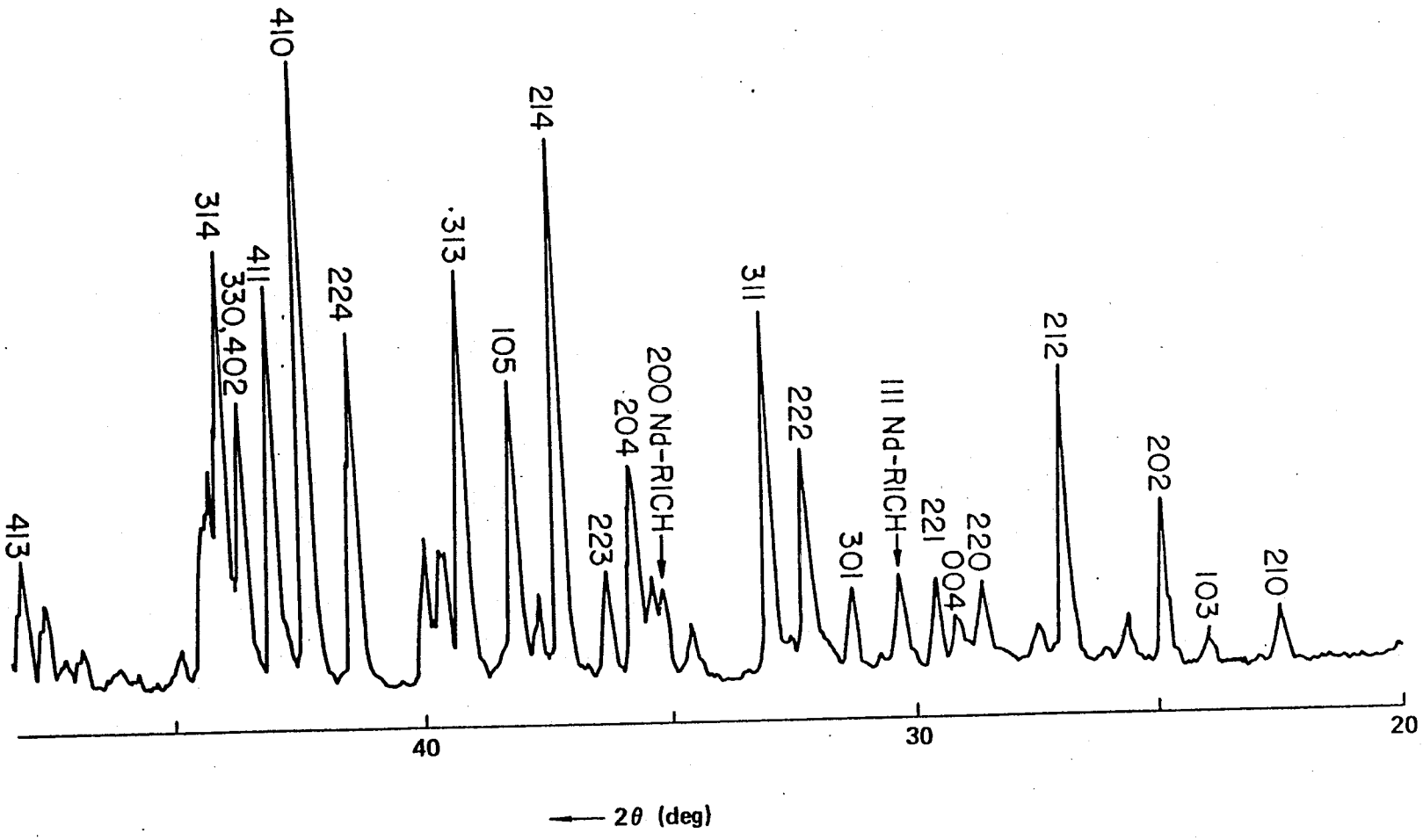
FIG. 12 is a diagrammatical representation showing the results of x-ray diffraction analysis of a magnet powder of the present invention.
Figure 13A:
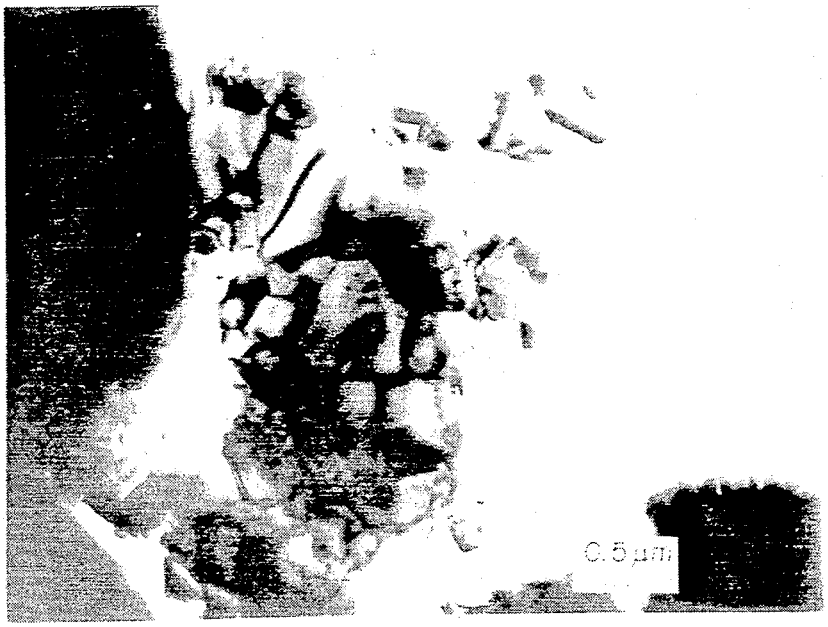
FIG. 13(*a*) is an electron micrograph of a microstructure of the magnet powder of Example 1.
Figure 13B:
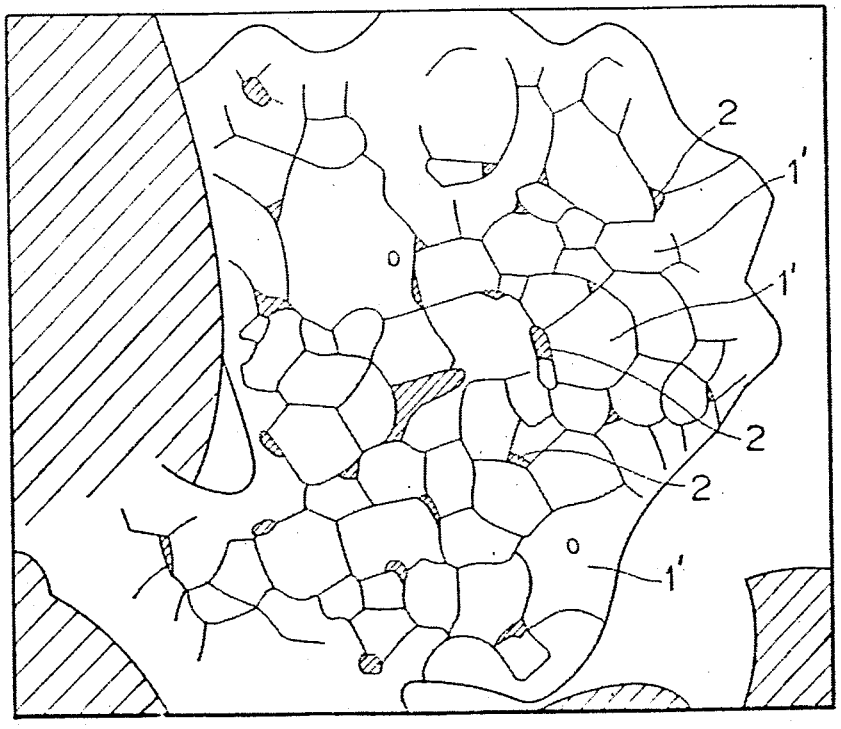

The results are shown in FIGS. 12 and 13. FIG. 12 is a tracing of an x-ray diffractometer recorder chart wherein the incident x-rays are CuK$\alpha$ radiation. FIG. 13 (*a*) is a photomicrograph showing the microstructure of the magnet powder while FIG. 13 (*b*) is a tracing of such photomicrograph.

As will be seen from FIG. 12, insomuch as the main diffraction peaks are indexed for an intermetallic compound $Nd_2Fe_{14}B$ having a tetragonal crystal structure, the magnet powder in accordance with the present invention is found to have $Nd_2Fe_{14}B$ phase as a principal phase. Similarly, since the other several diffraction peaks are indexed by the indices of planes for Nd-rich phase having a face-centered cubic structure, Nd-rich phase is also found to exist.

Further, it is seen from FIG. 13 (*a*) that the structure of the magnet powder of the invention is not the one obtained simply by crushing the structure of the rare earth alloy ingot but a recrystallized grain structure in which a great number of new recrystallized grains of about 0.3 μm exist.

More specifically, it is seen from FIG. 13 (*b*) that the powder particle of the magnet powder produced in Example 1 has recrystallized $Nd_2Fe_{14}B$ phase 1', and that since the material represented by $R_x(Fe,B)_{100-x}$ wherein $x>13$ is used, Nd-rich phase 2 exists in places and is formed particularly at triple points of grain boundaries to which three recrystallized $Nd_2Fe_{14}B$ phases 1' are located adjacent.

The magnetic property of the magnet powder was measured by a sample vibrating magnetometer (VSM), and was found to have a coercivity (iHc) of 11.5 KOe, thereby exhibiting a superior magnetic property.

Subsequently, the above magnet powder was blended with 4.5 % by weight of bismaleimidotriazine resin and was subjected to compression molding under a pressure of 5 tons/cm$^2$ in a magnetic field of 15 KOe, following which the resin was solidified by holding the compact at a temperature of 180° C. for 6 hours, resulting in a bonded magnet. The magnetic properties for the bonded magnet thus obtained are set forth in Table 1.

Control 1

The rare earth alloy ingot material of Example 1 was subjected to coarse crushing in a stamp mill in an argon atmosphere, and further to fine grinding in a vibrating ball mill, so that a comparative neodymium-iron-boron alloy magnet powder having an average particle size of 3.7 μm was obtained.

The coercivity of the comparative magnet powder thus obtained was 2.0 KOe.

Thereafter, the comparative magnet powder was blended with 4.5 % by weight of bismaleimidotriazine resin and a bonded magnet was produced under the same conditions as in Example 1. The magnetic properties for the bonded magnet thus obtained are also shown in Table 1.

Control 2

An appropriate amount of the magnet powder of Control 1 was placed on a board and fed in a heat treating furnace, and the furnace was evacuated to a vacuum of $1.0\times10^{-5}$ torr. Argon gas at 1 atm was then introduced into the furnace and the temperature in the furnace was elevated from the room temperature to 500° C. while the pressure of argon gas was being maintained constant. After arrival at 500° C., the material was held at the temperature for 30 minutes to relieve strain caused therein upon the crushing, and then quenched rapidly. The aggregated powder thus obtained was broken into pieces in a mortar, and neodymium-iron-boron alloy magnet powder having an average particle size of 6.6 um was obtained.

The above comparative magnet powder was then blended with 4.5 % by weight of bismaleimidotriazine resin and subjected to compression molding under a pressure of 5 tons/cm$^2$ in a magnetic field of 15 KOe, following which the resin was solidified by holding the resulted product at a temperature of 180° C. for 6 hours, resulting in a bonded magnet. The magnetic properties for the bonded magnet thus obtained are also shown in Table 1.

EXAMPLE 2

Neodymium and praseodymium (Pr) were melted with iron and boron in a high frequency induction furnace and cast into a neodymium-praseodymium-iron-boron alloy ingot comprising a principal component represented in atomic composition by $Nd_{13.6}Pr_{0.4}Fe_{78.1}B_{7.9}$. The alloy ingot thus prepared was subjected to homogenizing treatment in an argon atmosphere at a temperature of 1,100° C. for 30 hours, and was cut into a rectangular parallelepiped of 10 mm×10 mm×50 mm. The rectangular ingot, which had recrystallized grains of $R_2Fe_{14}B$ phase of an average crystal grain size of 280 um, was introduced into a heat treating furnace, which was then evacuated to a vacuum of $1.0\times10^{-5}$ torr, and the temperature was elevated from the room temperature to 840° C. while the vacuum was maintained. After arrival at 840° C., hydrogen gas was introduced into the furnace until the degree of vacuum reached 180 torr, and such atmosphere was kept for 10 hours while the hydrogen pressure was maintained, following which the outgassing of the ingot was conducted for 1.5 hours to produce a vacuum of $1.0\times10^{-5}$ torr in the furnace. Subsequently, argon gas was introduced in the furnace until the pressure reached 1 atm, and the rapid quenching of the powder was thus effected. The rectangular ingot treated was then crushed in a stamp mill in an argon gas atmosphere into neodymium-praseodymium-iron-boron alloy magnet powder, which had an average particle size of 25 μm.

All the individual particles of the magnet powder obtained in this way had the same recrystallized grain structure as in Example 1, and the average crystal grain size of the recrystallized structure was 0.8 um. The magnetic property of the magnet powder was 8.6 KOe in coercivity. Further, the magnet powder was blended with 4.5 % by weight of bismaleimidotriazine resin and a bonded magnet was produced under the same conditions as in Example The magnetic properties for the bonded magnet thus obtained are also set forth in Table 1.

EXAMPLE 3

An appropriate amount of the magnet powder of Example 2 was placed on a board and fed in a heat treating furnace, and the furnace evacuated to a vacuum of $1.0\times10^{-5}$ torr. Argon gas at 1 atm was then introduced into the furnace and the furnace temperature was elevated from the room temperature to 600° C. while the pressure of argon gas was being maintained constant. After arrival at 600° C., the material was kept at the temperature for 10 minutes to relieve strain caused upon the crushing, and then quenched rapidly. The aggregated powder thus obtained was broken into pieces in a mortar, and neodymium-praseodymium-iron-boron alloy magnet powder having an average grain size of 26 μm was obtained.

All the individual particles of the magnet powder obtained in this way had the same recrystallized grain structure as Example 1 had, and the average crystal grain size of the recrystallized structure was 0.8 μm. The coercivity of the magnet powder was 10.3 KOe. Further, the magnet powder was blended with 4.0 % by weight of bismaleimidotriazine resin and a bonded magnet was produced under the same conditions as in Example 1. The magnetic properties for the bonded magnet thus obtained are also shown in Table 1.

EXAMPLE 4

The rectangular ingot of Example 2, heat-treated in a hydrogen gaseous atmosphere, was introduced into a heat treating furnace, and hydrogen gas at 180 torr was occluded into the ingot at 330° C. for 3 hours to subject the ingot to decrepitation crushing. The furnace temperature was then elevated to 700° C. while the furnace was evacuated, and kept at 700° C. for 5 minutes, following which dehydrogenation was carried out to $1.0\times10^{-5}$ torr. Then, the decrepitated ingot was quenched by introducing argon gas until the pressure in the furnace reached 1 atm. The aggregated powder thus obtained was broken into pieces in a mortar, and neodymium-praseodymium- iron-boron alloy magnet powder with an average particle size of 42 μm was obtained.

All the individual particles of the magnet powder obtained in this way had the same recrystallized grain structure as in Example 1, and the average grain size of the recrystallized structure was 1.0 μm. The coercivity of the magnet powder was 9.2 KOe. Further, the magnet powder was blended with 3.0 % by weight of bismaleimidotriazine resin and a bonded magnet was produced under the same conditions as in Example 1. The magnetic properties for the bonded magnet thus obtained are also shown in Table 1.

Controls 3 and 4

The rare earth alloy ingot, comprising a principal component represented in atomic composition by $Nd_{13.6}Pr_{0.4}Fe_{78.1}B_{7.9}$, was subjected to homogenizing treatment in an argon atmosphere at 1,100° C. for 30 hours, and then crushed by a stamp mill in the same argon gas atmosphere into neodymium-praseodymium-iron- boron alloy magnet powder (Control 3), which had an average particle size of 21 μm.

Further, the magnet powder of Control 3 was subjected to same treatment as in Example 3 to remove strain upon crushing, and neodymium-praseodymium-iron-boron alloy magnet powder (Control 4) having an average particle size of 20 um was obtained. The coercivities of the magnet powders of Controls 3 and 4 were 0.5 KOe and 0.9 KOe, respectively. The magnet powders were then blended with 4.0 % by weight of bismaleimidotriazine resin and were subjected to compression molding under a pressure of 5 tons/cm$^2$ in a magnetic field of 15 KOe, following which the compacts were held at 180° C. for 6 hours. The magnetic properties for the bonded magnets thus obtained are also shown in Table 1.

As will be seen from Table 1, the magnet powders of Examples 1 to 4 of the invention exhibit very high coercivities (iHc) as compared with the prior art magnet powders of Controls 1 to 4, and the bonded magnets formed from the magnet powders of the invention are also markedly superior in magnetic properties to those formed by the prior art magnet powders.

TABLE 1

| Kind of samples | | Properties of magnet powders: Average particle size (μm) | Properties of magnet powders: Coercivities iHc (KOe) | Magnetic properties of bonded magnets: Residual magnetic flux density Br (KG) | Magnetic properties of bonded magnets: Coercivities iHc (KOe) | Magnetic properties of bonded magnets: Maximum energy product $(BH)_{max}$ (MGOe) |
|---|---|---|---|---|---|---|
| Examples | 1 | 5.8 | 11.5 | 7.0 | 11.0 | 10.8 |
| | 2 | 25 | 8.6 | 6.3 | 8.1 | 8.4 |
| | 3 | 26 | 10.3 | 6.5 | 9.5 | 8.9 |
| | 4 | 42 | 9.2 | 6.7 | 8.6 | 9.4 |
| Controls | 1 | 3.7 | 2.0 | 3.4 | 1.2 | 0.9 |
| | 2 | 6.6 | 3.8 | 4.0 | 2.0 | 1.4 |
| | 3 | 21 | 0.5 | 3.0 | 0.3 | — |
| | 4 | 20 | 0.9 | 3.2 | 0.6 | — |

EXAMPLE 5

Neodymium was melted with iron and boron in an electron beam melting furnace and cast into a neodymium-iron-boron alloy ingot having a principal component represented in atomic composition as $Nd_{14.9}Fe_{79.1}B_{6.0}$. The $R_2Fe_{14}B$ phase of the ingot has an average crystal grain size of 150 μm. The alloy ingot thus prepared was then introduced into a heat treating furnace and kept at 300° C. in hydrogen gas atmosphere at 200 torr for 1 hour. The furnace was then evacuated for 30 minutes while maintaining the temperature, and dehydrogenation was conducted to a vacuum of $1.0\times10^{-5}$ torr. Subsequently, the quenching was effectcd by introducing argon gas into the furnace until the pressure therein reached 1 atm.

The decrepitated powder thus obtained was further subjected to fine grinding in a vibrating ball mill to produce neodymium-iron-boron alloy powder of an average particle size of 5.3 um. Thereafter, an appropriate amount of the powder was placed on a board and introduced in a heat treating furnace, which was then evacuated to a vacuum of $1.0\times10^{-5}$ torr, and the temperature was elevated from room temperature to 800° C. After arrival at 800° C, hydrogen gas was introduced thereinto until the pressure reached 100 torr, and kept for 5 hours while maintaining the hydrogen pressure, following which the evacuation was effected at 800° C. for 0.2 hour to obtain a vacuum of $1.0\times10^{-5}$ torr. Subsequently, argon gas was introduced into the furnace until the pressure reached 1 atm, and thus the rapid quenching of the powder was effected.

The aggregated powder thus obtained was broken into pieces in a mortar, and neodymium-iron-boron alloy magnet powder having an average particle size of 8.1 μm was obtained. The individual particles of the magnet powder had an average grain size of 0.05 μm, and had the same recrystallized structures as Example 1 had.

The magnet powder was blended with 4.5 % by weight of phenol-novolak epoxy resin and was subjected to compression molding under a pressure of 5 tons/cm$^2$ in the absence of magnetic field or in the presence of magnetic field of 15 KOe, following which the resin was solidified by holding the compact at 100° C. for 10 hours, resulting in a bonded magnet. The magnetic properties for the bonded magnet thus obtained are set forth in Table 2.

EXAMPLES 6 TO 8

The neodymium-iron-boron alloy magnet powder of Example 5, having an average particle size of 8.1 μm and comprising a recrystallized grain structure of an average grain size of 0.05 μm, was subjected to heat treatment at temperature of 600° C. and at a vacuum of $1.0\times10^{-5}$ torr for 2 hours (Example 6), 10 hours (Example 7) and 100 hours (Example 8), respectively, and the recrystallized grains were thus grown. Then argon gas was introduced to conduct the quenching, and neodymium-iron-boron alloy magnet powders having recrystallized structures of average grain sizes of 0.7 μm (Example 6), 1.2 μm (Example 7) and 1.8 μm (Example 8) were respectively obtained.

These magnet powders had the same recrystallized grain structures as that of Example 1 had.

Each of the above alloy magnet powders was blended with 4.5% by weight of phenol-novolak epoxy resin and subjected to compression molding under a pressure of 5 tons/cm$^2$ in the absence of magnetic field or in the presence of magnetic field of 15 KOe, following which bonded magnets were produced under the same conditions as in Example 5. The magnetic properties for the bonded magnets thus obtained are also shown in Table 2.

TABLE 2

| Kind of samples | | Average grain size of recrystallized grains (μm) | Presence of magnetic field upon molding | Magnetic properties of bonded magnets Br (KG) | iHc (KOe) | $(BH)_{max}$ (MGOe) |
|---|---|---|---|---|---|---|
| Examples | 5 | 0.05 | Present | 5.2 | 13.5 | 5.4 |
| | | | Absent | 4.9 | 13.7 | 5.0 |
| | 6 | 0.7 | Present | 6.2 | 11.1 | 8.0 |
| | | | Absent | 5.1 | 11.2 | 5.3 |
| | 7 | 1.2 | Present | 7.1 | 10.8 | 11.2 |
| | | | Absent | 5.1 | 11.3 | 5.1 |
| | 8 | 1.8 | Present | 7.3 | 9.0 | 10.6 |
| | | | Absent | 5.0 | 8.7 | 4.8 |

It is clear from Table 2 that when the average crystal grain size of the recrystallized grains is not less than 0.7 μm and the molding was conducted in the presence of the magnetic field, the bonded magnets having a marked anisotropy can be obtained.

The reason why the anisotropic bonded magnet is obtained is that the particles of the magnet powder are caused to align in the easy direction of the magnetization during the molding in the presence of a magnetic field.

Figure 14:
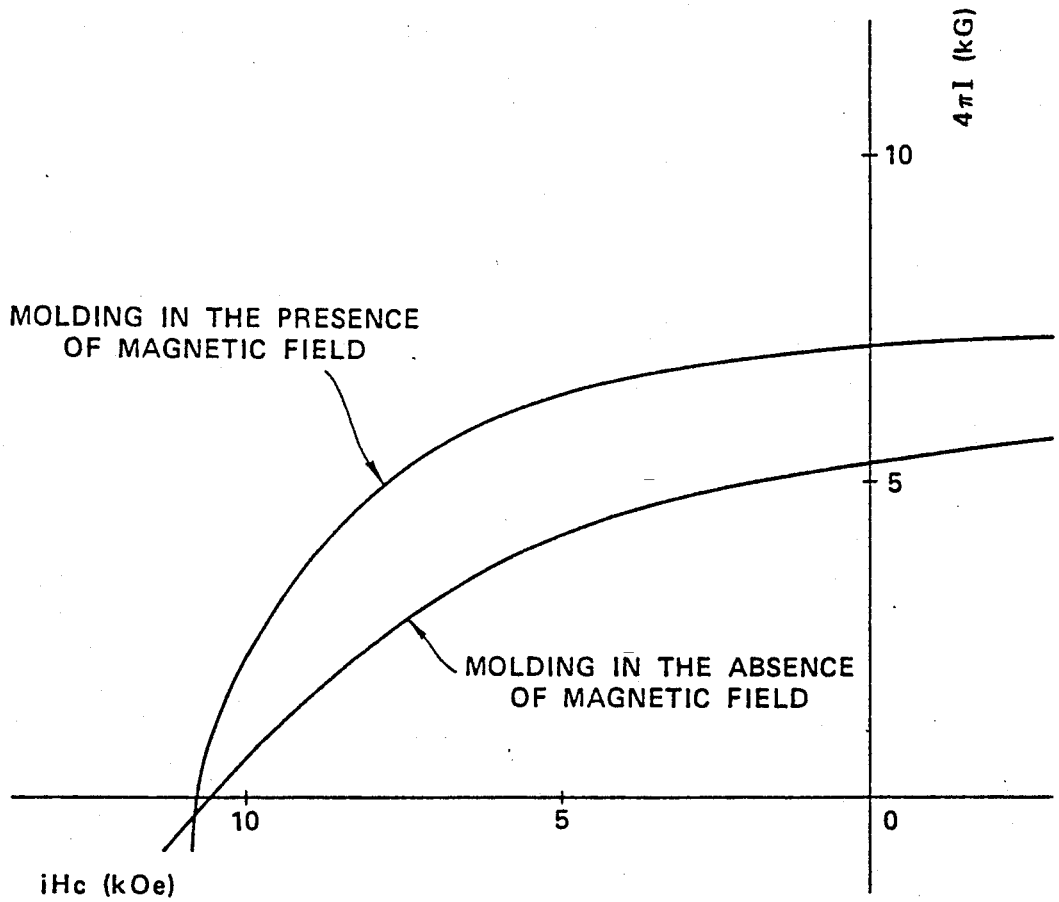
FIG. 14 is a graph showing a demagnetization curve of the bonded magnet of Example 7.

Further, demagnetization curve for the bonded magnet of Example 7 is shown in FIG. 14, from which the magnet powder of the invention is found to have a magnetic anisotropy.

EXAMPLE 9

Neodymium was melted with iron and boron in a plasma arc melting furnace and cast into a neodymium-iron-boron alloy ingot having a principal component represented in atomic composition as $Nd_{14.0}Fe_{78.8}B_{7.2}$. The ingot was subjected to homogenizing treatment at 1,090° C. in an argon atmosphere for 20 hours and cut into a rectangular ingot of 10 mm×10 mm×50 mm. The rectangular ingot (average crystal grain size of $R_2Fe_{14}B$ phase: 200 μm) was introduced in a heat treating furnace. After the furnace was evacuated to a vacuum of $1\times10^{-5}$ torr, the furnace temperature was elevated from the room temperature to 830° C. while maintaining the vacuum, and the furnace was kept at 830° C. for 30 minutes. Then, hydrogen gas at 1 atm was introduced at 830 ° C. into the furnace, and the ingot was kept for 20 hours while maintaining the hydrogen gas pressure. Further, the temperature was elevated to 850 ° C. while conducting the outgassing of ingot, which was continued for 40 minutes at 850° C. so that a vacuum of $1.0\times10^{-5}$ torr was produced. Subsequently, the rapid quenching was effected by introducing argon gas into the furnace up to 1 atm. The rectangular ingot thus treated was crushed in a stamp mill in an argon atmosphere, and the crushed powder was filled in the gap between the mill rolls which had been kept at 720° C. in an argon gas atmosphere. Then, by subjecting the powder to powder rolling, neodymium-iron-boron alloy magnet powder with an average particle size of 38 μm was obtained. The individual particles of the magnet powder had recrystallized grains of an average grain size of 0.5 μm, and had the same recrystallized structure as the powder of Example 1 had.

The magnet powder thus obtained was blended with 4.0 % by weight of phenol-novolak epoxy resin and was subjected to compression molding under a pressure of 5 tons/cm$^2$ in the absence of magnetic field or in the presence of magnetic field of 15 KOe, following which the resin was solidified by holding the compact at 100° C. for 10 hours, resulting in a bonded magnet. The magnetic properties for the bonded magnet thus obtained are set forth in Table 3.

EXAMPLE 10

The rectangular ingot, subjected to heat treatment in the hydrogen gas in Example 9, was inserted in the gap between mill rolls which had been kept at 750° C. in an argon atmosphere, and was subjected to rolling several times until the reduction reached 40 %.

The ingot thus rolled was then crushed by a stamp mill in an argon atmosphere, and subjected to the same heat treatment as in Example 3 to remove strain. Thus, neodymium-iron-boron alloy magnet powder having an average particle size of 25 μm was obtained. The individual particles of the powder had the average recrystallized grain size of 0.7 μm, and had the same recrystallized grain structure as Example 1 had. The resulted magnet powder was blended with 4.0 % by weight of phenol-novolak epoxy resin and was subjected to compression molding under a pressure of 5 tons/cm$^2$ in the absence of magnetic field or in the presence of a magnetic field of 15 KOe, following which the resin was solidified by holding the compact at 100° C. for 10 hours, resulting in a bonded magnet. The magnetic properties for the bonded magnet thus obtained are set forth in Table 3.

TABLE 3

| Kind of samples | | Average grain size of recrystallized grains (μm) | Presence of magnetic field upon molding | Magnetic properties of bonded magnets Br (KG) | iHc (KOe) | $(BH)_{max}$ (MGOe) |
|---|---|---|---|---|---|---|
| Examples | 9 | 0.5 | Present | 7.9 | 9.3 | 12.8 |
| | | | Absent | 5.0 | 9.7 | 5.0 |
| | 10 | 0.7 | Present | 8.2 | 8.5 | 15.1 |
| | | | Absent | 5.1 | 8.8 | 5.1 |

As will be seen from Table 3, when the bonded magnet was produced by molding the rolled magnet powder of the invention in the presence of magnetic field, the magnetic properties, particularly maximum energy product (BH)max and residual magnetic flux density (Br) are improved markedly. This is because since the magnetic powder of the invention possesses a magnetic anisotropy, particles of the powder are oriented in the easy axes of magnetization upon the molding in the presence of a magnetic field.

Figure 15:
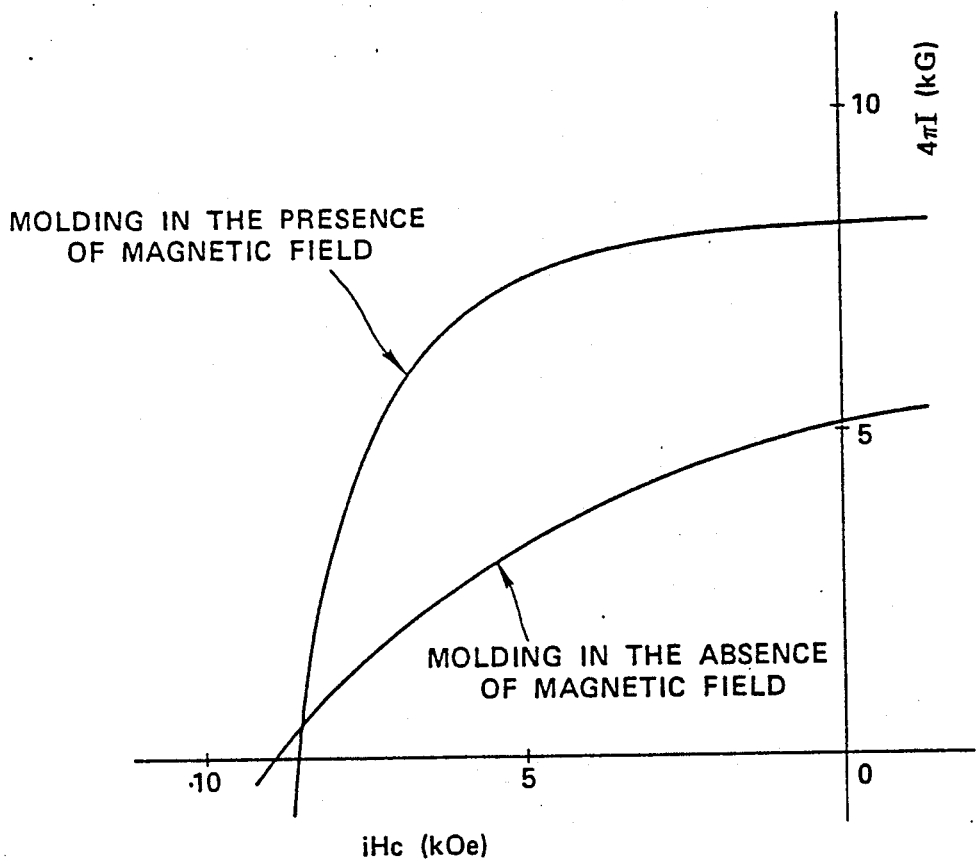
FIG. 15 is a graph showing a demagnetization curve of the bonded magnet of Example 10.

The demagnetization curve for the bonded magnet of Example 10 is shown in FIG. 15. As seen from the curve, the magnet powder of the invention surely has a magnetic anisotropy.

Although in this example, hot rolling was used as hot working, other hot plastic working such as hot extrusion could as well be applied.

EXAMPLES 11 TO 16 AND CONTROLS 5 to 7

Neodymium and dysprosium (Dy) were melted with iron and boron in a high frequency induction furnace and cast into neodymium-dysprosium-iron-boron alloy ingots having a principal component represented in atomic composition as $Nd_{13.5}Dy_{1.5}Fe_{77.3}B_{7.7}$. The $R_2Fe_{14}B$ phase of the ingot had an average crystal grain size of 70 μm. The alloy ingot thus prepared was fed in a heat treating furnace and kept at 300° C. in an atmosphere of hydrogen at 300 torr for 1 hour to subject the alloy ingot to decrepitation crushing due to hydrogenation. The furnace was then evacuated for 1 hour while maintaining the temperature, and dehydrogenation was conducted until a vacuum of $1.0\times10^{-5}$ torr was produced, and the rapid quenching was effected by introducing argon gas until the pressure in the furnace reached 1 atm. Thus, neodymium-dysprosium-iron-boron alloy powder of an average particle size of 120 μm was obtained. Subsequently, an appropriate amount of the powder was placed on a board and introduced in a heat treating furnace, which was then evacuated to a vacuum of $1.0\times10^{-5}$ torr. Hydrogen gas at 1 atm was introduced in the furnace, and temperature was elevated from room temperature to 850° C. while maintaining the hydrogen gas pressure. After arrival at 850° C., the material was kept at 850° C. for 1 hour, following which the temperature was decreased to 700° C. Then, while keeping the temperature at 700° C., the outgassing of the material was effected up to the vacuum of $1.0\times10^{-5}$ torr for various periods of hours as set forth in Table 4, to thereby grow the recrystallized grains. After that, the rapid quenching was effected by introducing argon gas into the furnace until the pressure reached 1 atm, and neodymium-dysprosium-iron-boron alloy magnet powder having an average particle size of 150 μm was obtained.

The magnet powders thus obtained had recrystallized structures each comprising $(Nd\ Dy)_2Fe_{14}B$ phase as a principal component, and the average crystal grain sizes of the recrystallized grains of the individual particles obtained are shown in Table 4, in which the coercivities are also set forth.

Figure 16:
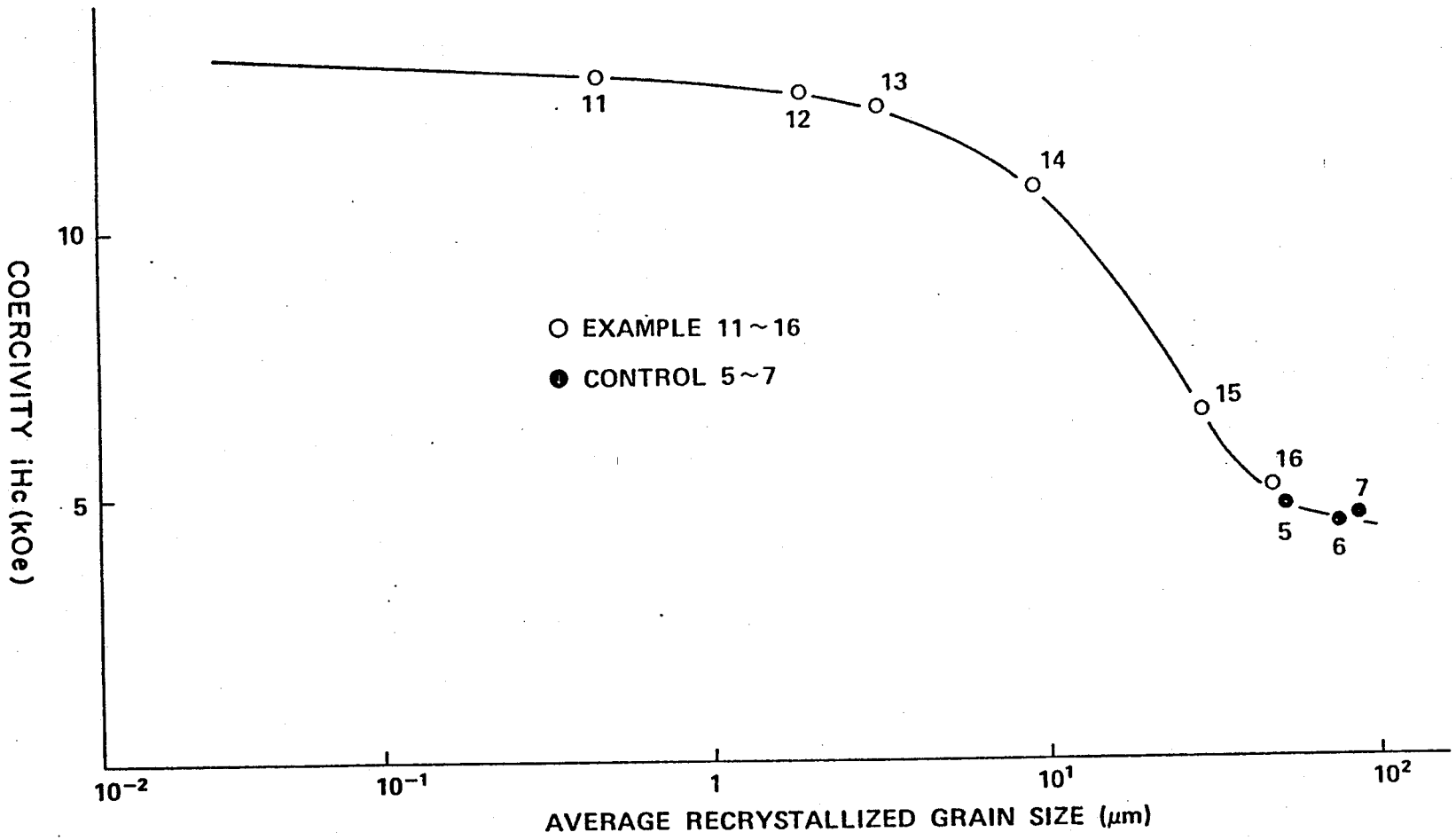
FIG. 16 is a graph showing the relationship between an average recrystallized grain size and a coercivity.

The results shown in Table 4 are further depicted by a graph of FIG. 16 in which the logarithmic axis of abscissa represents the average crystal grain size (μm) of recrystallized grains while the axis of ordinate represents coercivities (iHc).

The graph of FIG. 16 shows that when the average crystal grain size of recrystallized grains is not greater than 50 μm, the magnet powder of the invention exhibits its coercivity exceeding 5 KOe, thereby having a superior magnetic property. It also shows that the average crystal grain size of recrystallized grains should be preferably no greater than 3 μm.

TABLE 4

| Kind of samples | | Outgassing time upon growth of recrystallized grains (Hr) | Average grain size of recrystallized grains (μm) | Coercivities (iHc) (KOe) |
|---|---|---|---|---|
| Examples | 11 | 0.5 | 0.5 | 12.8 |
| | 12 | 2 | 2.0 | 12.6 |
| | 13 | 3 | 3.0 | 12.4 |
| | 14 | 5 | 10 | 10.6 |
| | 15 | 10 | 35 | 6.5 |
| | 16 | 30 | 50 | 5.3 |
| Controls | 5 | 50 | 55 | 4.8 |
| | 6 | 200 | 58 | 4.5 |
| | 7 | 500 | 60 | 4.7 |

EXAMPLE 17

Neodymium was melted with iron and boron in a high frequency induction furnace and cast into a neodymium-iron-boron alloy ingot which had a principal component represented in atomic composition as $Nd_{12.1}Fe_{82.1}B_{5.8}$. The rare earth alloy ingot, which had $R_2Fe_{14}B$ phase of an average crystal grain size of 150 um, was subjected to homogenization treatment by holding it at 1,090° C. in an argon atmosphere for 40 hours. Then, an appropriate amount of the rare earth alloy, in the form of the ingot, was placed on a board and introduced into a heat treating furnace, which was then evacuated to a vacuum of $1.0\times10^{-5}$ torr. Subsequently, hydrogen gas at 1 atm was introduced into the furnace, and the temperature was elevated from the room temperature to 830° C. while the pressure of hydrogen gas was being maintained. The ingot was kept in the hydrogen gas at 1 atm at 830° C. for 1 hour, and further kept at 830° C. in an atmosphere of hydrogen at 200 torr for 6 hours. While maintaining the temperature, the furnace was further evacuated for 40 minutes to produce a vacuum of $1.0\times10^{-5}$ torr in the furnace. Then, argon gas was introduced thereinto until the pressure reached 1 atm, and the rapid quenching of the alloy ingot was thus effected. Since the alloy ingot thus treated had been decrepitated, it was broken into pieces in a mortar to produce neodymium-iron-boron alloy magnet powder of an average particle size of 40 μm.

The magnet powder thus obtained was subjected to x-ray diffraction and observed by a transmission electron microscope. As a result of x-ray diffraction analysis, the diffraction peaks were indexed for an intermetallic compound $Nd_2Fe_{14}B$ having a tetragonal crystal structure. The diffraction peaks due to phases other than $Nd_2Fe_{14}B$ phase was hardly observed.

Figure 17A:
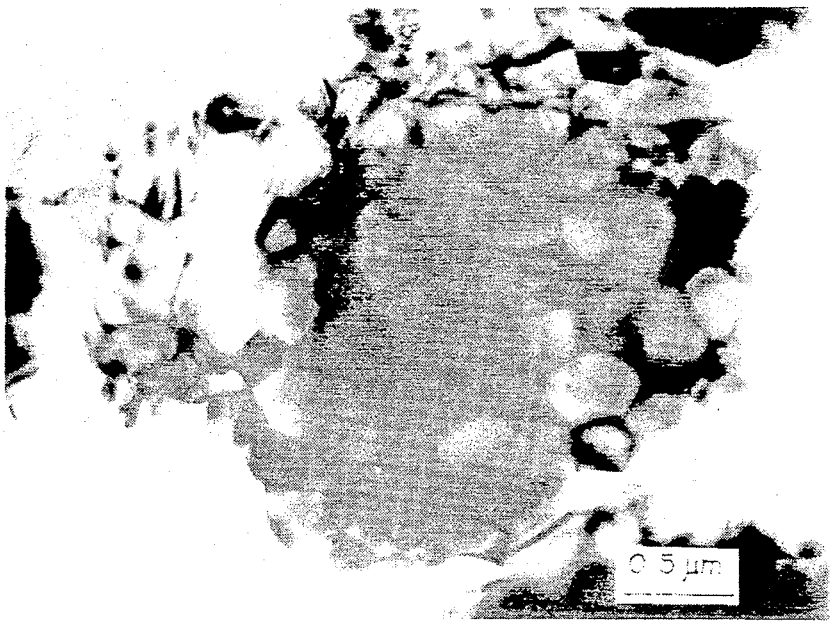
FIG. 17(*a*) is a photomicrograph of the microstructure of another rare earth-iron-boron alloy magnet powder.
Figure 17B:
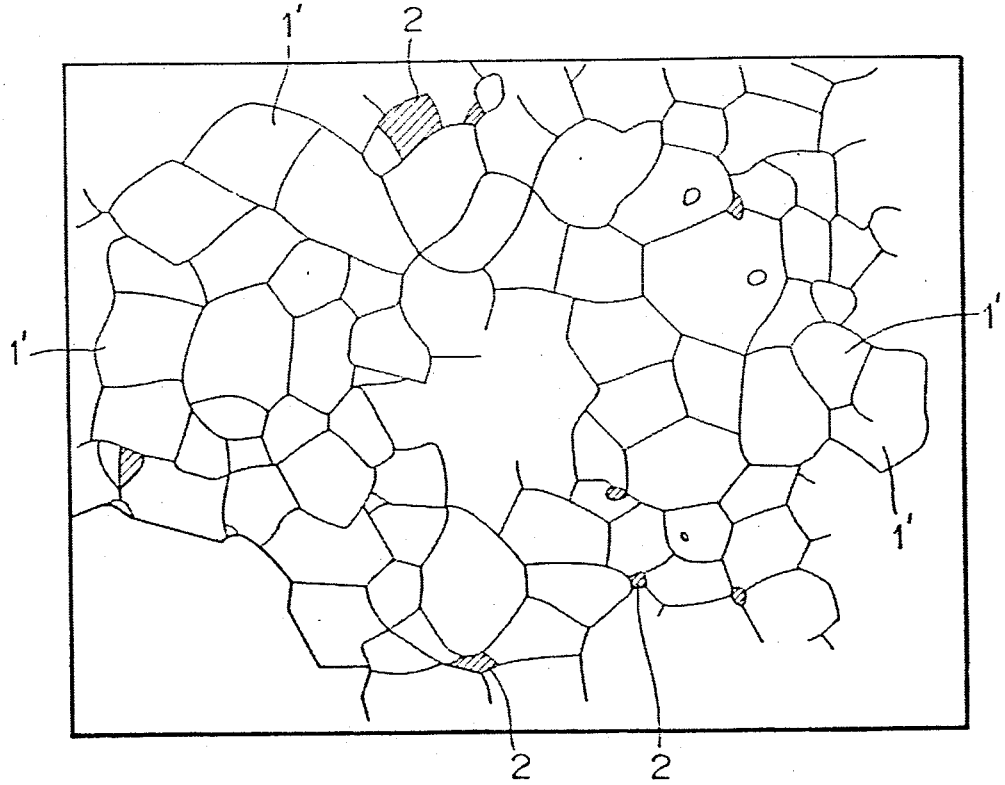

FIG. 17 (*a*) is a micrograph of the microstructure of the magnet powder while FIG. 17 (*b*) is a tracing showing the metal structure of the above micrograph.

From FIG. 17 (*a*), the structure of the magnet powder of the invention is not the one obtained simply by crushing the alloy ingot but a recrystallized grain structure in which a great number of new recrystallized grains of about 0.4 μm exist.

More specifically, referring to FIG. 17(*b*), the one powder particle of the rare earth-iron-boron alloy magnet powder of Example 17 has recrystallized $Nd_2Fe_{14}B$ phase 1', and as to phases other than the recrystallized $Nd_2Fe_{14}B$ phase 1', Nd-rich phase 2 exists only at a part of triple points of grain boundaries to which three recrystallized $Nd_2Fe_{14}B$ phases 1' are disposed adjacent, so that the magnet powder is essentially comprised of recrystallized grains of $Nd_2Fe_{14}B$ phase.

The coercivity of the magnet powder was measured by a VSM, and was found to be 11.2 KOe, thereby exhibiting a superior magnetic property.

Thereafter, the above magnet powder was blended with 3.0% by weight of phenol novolak epoxy resin and was subjected to compression molding under a pressure of 5 tons/cm$^2$ in the absence of magnetic field, following which the resin was solidified by holding the compact at 120° C. for 6 hours, resulting in a bonded magnet. The magnetic properties for the bonded magnet thus obtained are shown in Table 5.

Control 8

The same rare earth alloy ingot as in Example 17, comprising $Nd_{12.1}Fe_{82.1}B_{5.8}$, was subjected to a high frequency melting in an argon atmosphere and the melt was dropped through a nozzle of 3 mm in diameter to subject the melt to atomizing due to argon gas at a high speed of no less than the sonic speed. The powder thus produced was then subjected to heat treatment at 600° C. for 30 minutes in a vacuum, and crushed and sieved into a comparative neodymium-iron-boron alloy magnet powder of an average particle size of 40 μm.

The coercivity of the above magnet powder is set forth in Table 5.

Thereafter, the above magnet powder was blended with 3.0% by weight of phenol novolak epoxy resin and a bonded magnet was prepared in the same manner as in Example 17. The magnetic properties for the bonded magnet thus obtained are also set forth in Table 5.

TABLE 5

| Kind of samples | Properties of magnet powder: Average grain size (μm) | Properties of magnet powder: iHc (KOe) | Properties of bonded magnets: Magnetic properties: Br (KG) | Properties of bonded magnets: Magnetic properties: iHc (KOe) | Properties of bonded magnets: Magnetic properties: $(BH)_{max}$ (MGOe) | Properties of bonded magnets: Density (g/cm$^3$) |
|---|---|---|---|---|---|---|
| Example 17 | 40 | 11.2 | 6.5 | 11.0 | 9.1 | 6.0 |
| Control 8 | 40 | 11.0 | 6.0 | 7.5 | 5.3 | 6.0 |

It is seen from Table 5 that the neodymium-iron-boron alloy isotropic bonded magnet of Example 17 is superior in magnetic properties to the neodymium-iron-boron alloy isotropic bonded magnet of Control 8.

EXAMPLES 18 TO 21

The ingot, decrepitated by the heat treatment in hydrogen gas in Example 17, was broken into pieces in a mortar, and various comparative magnet powders of average particle sizes: 32 μm (Example 18), 21 μm (Example 19), 15 μm (Example 20) and 4 um (Example 21) were obtained.

The coercivities of the above Examples 18 to 21, measured by the VSM, are set forth in Table 6.

Further, each of the above magnet powders of Example 18 to 21 was blended with 3.0% by weight of phenol novolak epoxy resin, and by subjecting the material to compression molding under a pressure of 5 tons/cm$^2$ in the absence of magnetic field or in the presence of magnetic field of 15 KOe, a bonded magnet was prepared under the same conditions as in Example 17. The magnetic properties for the bonded magnet thus obtained are also set forth in Table 6.

TABLE 6

| Kinds of samples | | Properties of magnet powder: Average particle size (μm) | Properties of magnet powder: iHc (KOe) | Presence of magnetic field | Bonded magnets: Magnetic property: Br (KG) | Bonded magnets: Magnetic property: iHc (KOe) | Bonded magnets: Magnetic property: $(BH)_{max}$ (MGOe) | Bonded magnets: Density (g/cm$^3$) |
|---|---|---|---|---|---|---|---|---|
| Examples | 18 | 32 | 11.5 | Present | 6.9 | 11.1 | 10.2 | 6.0 |
| | | | | Absent | 6.4 | 11.3 | 8.8 | 6.1 |
| | 19 | 21 | 11.3 | Present | 7.0 | 11.2 | 10.8 | 6.0 |
| | | | | Absent | 6.4 | 11.3 | 8.7 | 6.1 |
| | 20 | 15 | 11.1 | Present | 7.4 | 10.8 | 12.1 | 5.9 |
| | | | | Absent | 6.1 | 11.1 | 7.7 | 5.9 |
| | 21 | 4 | 11.0 | Present | 7.6 | 9.8 | 12.0 | 5.8 |
| | | | | Absent | 5.8 | 10.1 | 7.1 | 5.8 |

It is clear from Table 6 that when the molding of the powder with the average grain of no greater than 15 μm is molded in the presence of a magnetic field, the resulted pond magnet exhibits an enhanced value of residual magnetic flux density (Br) and has a marked anisotropy.

This is because the particles of the powder are oriented in the easy axes of magnetization during the molding in the presence of magnetic field, and thus the magnet powders of the invention have a magnetic anisotropy.

EXAMPLE 22

Neodymium and dysprosium were melted with iron, boron and cobalt (Co) in a plasma arc melting furnace and cast into a neodymium-dysprosium-iron-cobalt-boron alloy ingot having a principal composition represented in atomic composition as $Nd_{11.0}Dy_{0.9}Fe_{77.2}Co_{5.2}B_{5.7}$. The alloy ingot was subjected to homogenizing treatment at 1,080° C. in an argon gas atmosphere for 50 hours and cut into a cylindrical ingot, 11.3 mm in diameter and 10 mm in height. This cylindrical ingot (of which average crystal grain size of the principal phase was 120 um) was introduced in a heat treating furnace, and the furnace was evacuated to a vacuum of $1\times10^{-5}$ torr. Then, the temperature in the furnace was elevated from the room temperature to 750° C. while maintaining the vacuum, and hydrogen gas was introduced into the furnace at 750 ° C. until the pressure reached 1 atm. After the temperature was elevated to 840° C. while maintaining the pressure of hydrogen, the alloy was kept at 840° C. in the hydrogen gas at 1 atm for 2 hours, and further kept at 840° C. in an atmosphere of hydrogen at 200 torr for 10 hours. The furnace was then evacuated at 840° C. for 50 minutes to produce a vacuum of no greater than $1.0\times10^{-5}$ torr in the furnace, and the alloy ingot was rapidly quenched by introducing argon gas thereinto until the pressure reached 1 atm.

The cylindrical ingot thus treated was then subjected to plastic working at 730° C. in a vacuum so as to become 2 mm in height. The worked ingot was crushed in a stamp mill in an argon gas atmosphere to obtain neodymium-dysprosium-iron-cobalt-boron alloy magnet powder of an average particle size of 42 μm. The individual particles of this magnet powder had an average recrystallized grain size of 0.6 μm, and had the recrystallized grain structure comprising $(Nd,Dy)_2(Fe,Co)_{14}B$ as similarly to Example 17. The magnet powder thus obtained was blended with 3.0% by weight of phenol-novolak epoxy resin and subjected to compression molding under a pressure of 5 tons/cm$^2$ in the absence of magnetic field or in the presence of magnetic field of 15 KOe, following which the resin was solidified by holding the compact at 120° C. for 5 hours, resulting in a bonded magnet. The magnetic properties for the bonded magnet thus obtained are set forth in Table 7.

The data set forth in Table 7 shows that when the magnet powder of Example 22, subjected to hot plastic working during the manufacture, was utilized to produce the bonded magnet by the molding in the presence of magnetic field, the resulted bonded magnet has remarkably improved magnetic properties, particularly in the maximum energy product $(BH)_{max}$ and residual magnetic flux density (Br), as compared with the bonded magnet molded in the absence of magnetic field. This is because the magnetic powder of the invention has a magnetic anisotropy and hence the particles of the powder are oriented in the easy axes of magnetization during the molding in the presence of magnetic field.

TABLE 7

| Kind of samples | Presence of magnetic field upon molding | Magnetic properties of bonded magnet | | |
|---|---|---|---|---|
| | | Br (KG) | iHc (KOe) | $(BH)_{max}$ (MGOe) |
| Example 22 | Present | 8.6 | 12.2 | 16.7 |
| | Absent | 6.1 | 12.6 | 7.7 |

EXAMPLE 23

Figure 18:
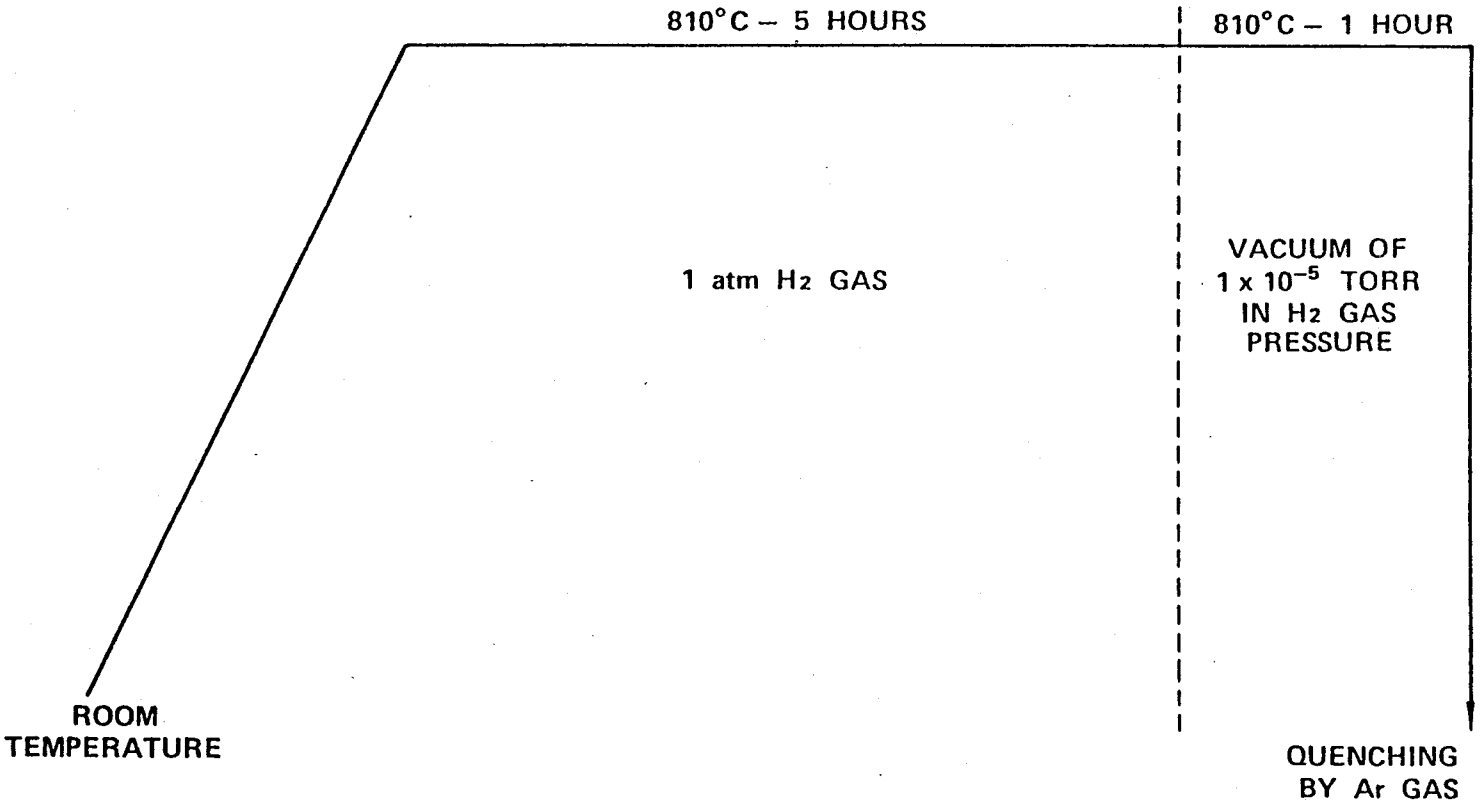
FIG. 18 is a diagrammatical representation showing a pattern of the procedure of Example 23.

Neodymium, selected from the rare earths, was melted with iron and boron in a high frequency induction furnace and cast into a neodymium-iron-boron alloy ingot comprising a principal composition represented in atomic percent as $Nd_{15.0}Fe_{76.9}B_{8.1}$. The ingot had a principal phase of $R_2Fe_{14}B$ phase comprised of crystal grains of a grain size of about 150 μm. The alloy ingot thus prepared was subjected to coarse crushing in a stamp mill in an argon gas atmosphere, and subsequently to fine grinding or crushing in a vibrating ball mill to produce neodymium-iron-boron alloy fine powder of an average particle size of 3.8 μm. Thereafter, an appropriate amount of the fine powder was placed on a board and introduced into a heat treating furnace, and the furnace evacuated to a vacuum of $1.0\times10^{-5}$ torr. Hydrogen gas was then introduced into the furnace, and the temperature was elevated from room temperature to 810° C. while the pressure of hydrogen gas was maintained constant. After the alloy was treated in the hydrogen gas atmosphere of 1 atm at 810° C for 5 hours, the furnace was evacuated at 810° C. for 1 hour to produce a vacuum of $1.0\times10^{-5}$ torr in the furnace. Subsequently, argon gas was introduced thereinto until the pressure reached 1 atm, and rapid quenching of the fine powder was thus effected. The procedure of this example is illustrated in FIG. 18. The fine powder obtained in accordance with the above procedure was in the form of powder aggregates, and hence it was broken into pieces in a mortar to produce a neodymium-iron-boron alloy magnet powder having an average particle size of 6.2 μm.

Figure 21A:
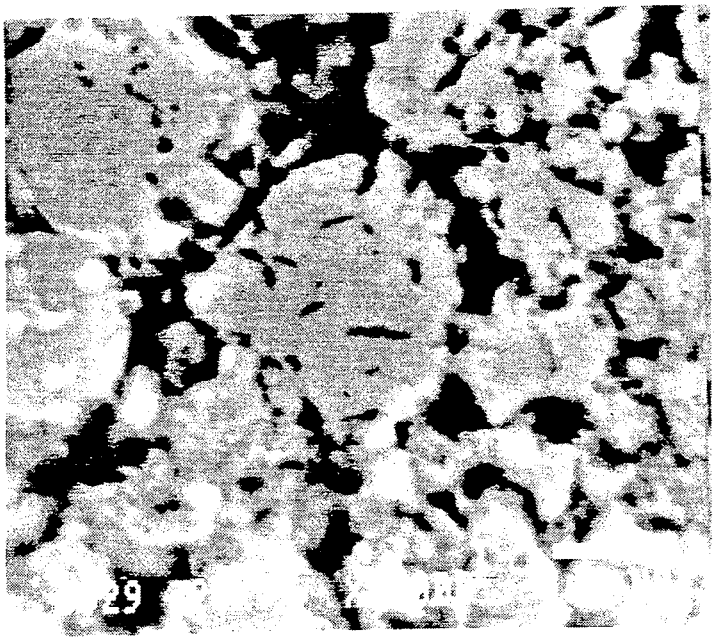
FIG. 21(*a*) is a photomicrograph of a microstructure of a rare earth-iron-boron alloy magnet powder of Example 23.
Figure 21B:
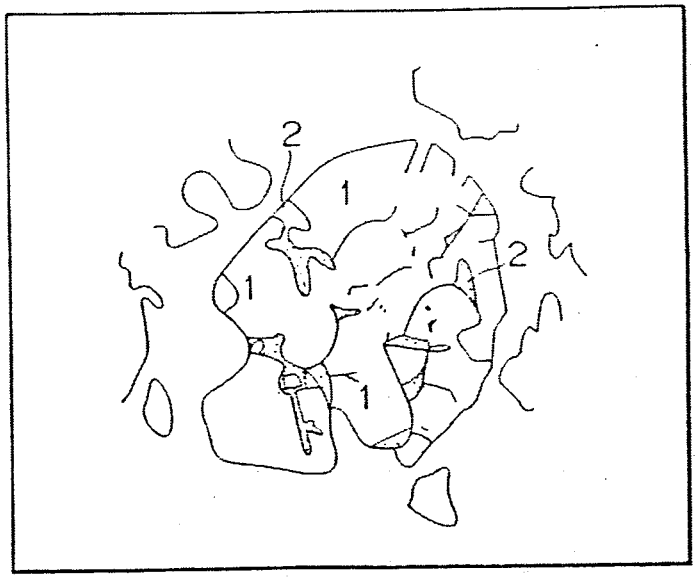

The magnetic properties of the magnet powder thus obtained were measured by a VSM, and the results are set forth in Table 8. Further, the structure of the above magnet powder was observed by using a scanning electron microscope. FIG. 21 (*a*) shows a micrograph of a microstructure while FIG. 21 (*b*) shows a tracing of the micrograph.

As a result of the composition analysis, it is found that the phase designated at 1 in FIG. 21 (*b*) is a principal phase of $Nd_2Fe_{14}B$, and that Nd-rich phase exists in a part of grain boundaries as designated at 2. It is seen from FIG. 21 (*a*) that $Nd_2Fe_{14}B$ principal phase exists in the form of recrystallized grains of 0.2 to 1.0 μm in the powder particle, and that the structure of the magnet powder obtained is a recrystallized aggregate grain structure.

A bonded magnet was then prepared from the above magnet powder in the same way as in Example 1. Magnetic properties of such bonded magnet is also set forth in Table 8.

Control 9

Figure 19:
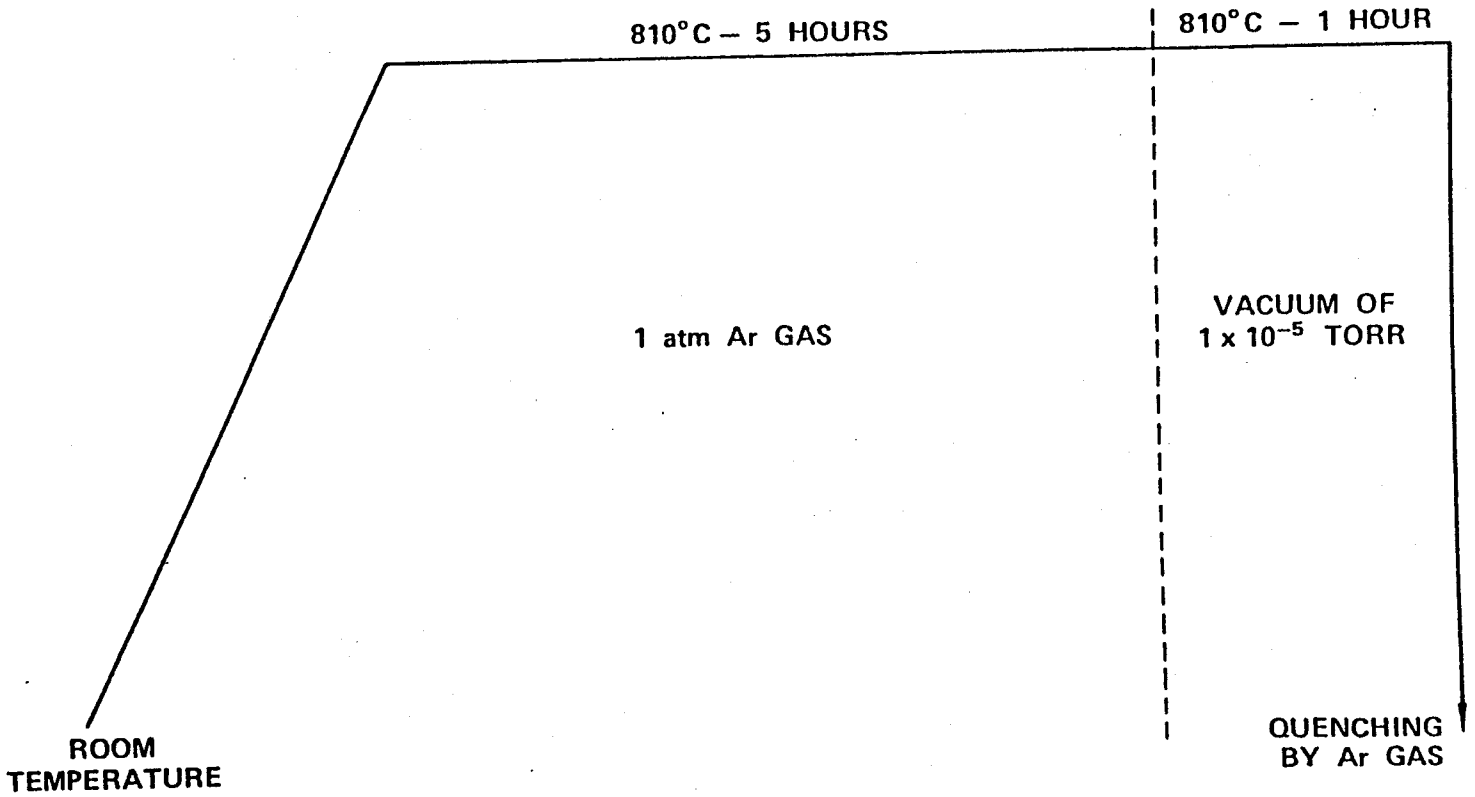
FIG. 19 is a view similar to FIG. 18, but showing the pattern of the procedure of Control 9.

An appropriate amount of the alloy fine powder of an average particle size of 3.8 μm, obtained in Example 23, was placed on a board introduced in a heat treating furnace. After the furnace was evacuated to a vacuum of $1.0\times10^{-5}$ torr, argon gas at 1 atm was introduced thereinto and the temperature therein was elevated from the room temperature to 810° C. Thus the powder was treated at 810° C. in an argon gas atmosphere of 1 atm for 5 hours, and the furnace was then evacuated at 810° C. for 1 hour to a vacuum of $1.0\times10^{-5}$ torr, following which the powder was quenched by introducing argon gas into the furnace until the pressure reached 1 atm. This procedure is set forth in FIG. 19. The fine powder thus obtained was in the form of powder aggregates, and hence it was broken into pieces in a mortar to produce a neodymium-iron-boron alloy magnet powder having an average particle size of 6.5 μm. The magnetic properties of the above magnet powder were measured by a VSM, and the results are also set forth in Table 8. Further, the above comparative magnet powder was blended with 4.5% by weight of bismaleimidotriazine resin and a bonded magnet was prepared under the same conditions as in Example 1. The magnetic properties for this bonded magnet are also shown in Table 8.

Control 10

Figure 20:
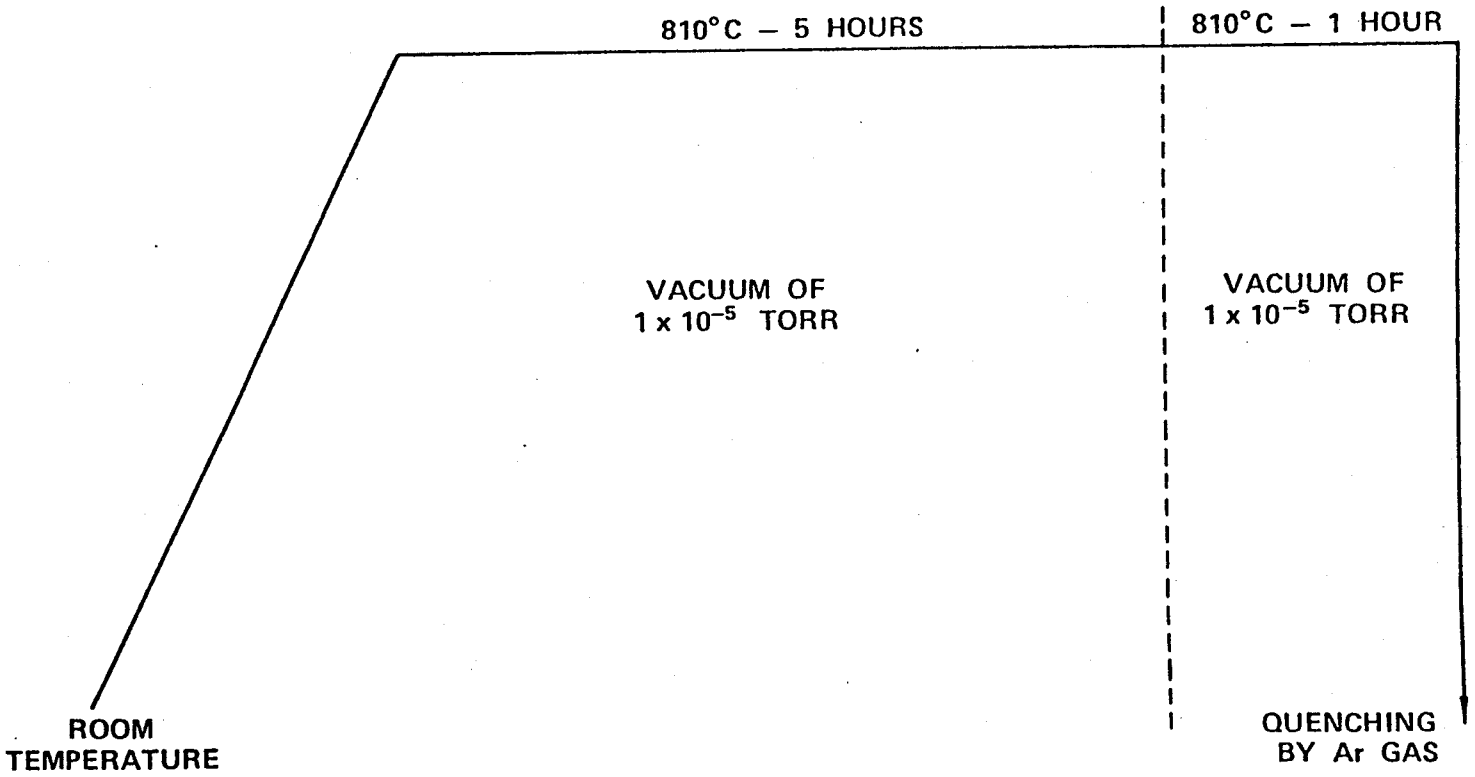
FIG. 20 is a view similar to FIG. 18, but showing the pattern of the procedure of Control 10.

An appropriate amount of the neodymium-iron-boron alloy fine powder of an average particle size of 3.8 μm, obtained in Example 23, was placed on a board and introduced into a heat treating furnace, which was evacuated to a vacuum of $1.0\times10^{-5}$ torr. Then, the temperature of the furnace was elevated from the room temperature to 810° C., and the powder was kept at 810° C. in a vacuum of $1.0\times10^{-5}$ torr for 6 hours. Thereafter, argon gas was introduced into the furnace until the pressure reached 1 atm, and the rapid quenching of the fine powder was thus effected. Procedure of this example is set forth in FIG. 20. The fine powder obtained was in the form of powder aggregates, and hence it was broken into pieces in a mortar to produce a neodymium-iron-boron alloy magnet powder having an average particle size of 5.9 μm. The magnetic properties of this magnet powder were measured in the same way as in Example 23, and a bonded magnet was prepared in the same way. The results obtained are also set forth in Table 8.

Control 11

The neodymium-iron-boron alloy fine powder of an average particle size of 3.8 μm, obtained in Example 23, was used as a magnet powder of Control 11, and its magnetic properties were measured. Also, a bond magnet was prepared by using this magnet powder in the same way as in Example 23, and its magnetic properties were measured. The results are also set forth in Table 8.

TABLE 8

| Kind of samples | Magnet powders: Average particle size (μm) | Magnetization for magnetic field 15 KOe (KG) | Bond magnets: iHc (KOe) | Br (KG) | iHc (KOe) | $(BH)_{max}$ (MGOe) |
|---|---|---|---|---|---|---|
| Example 23 | 6.2 | 8.0 | 12.1 | 7.1 | 11.5 | 11.3 |
| Control 9 | 6.5 | 9.0 | 7.3 | 4.1 | 2.2 | 1.8 |
| Control 10 | 5.9 | 9.1 | 6.0 | 4.0 | 2.0 | 1.5 |
| Control 11 | 3.8 | 9.6 | 2.0 | 2.5 | 0.4 | — |

It is seen from Table 8 that the neodymium-iron-boron alloy magnet powder produced according to the method of the invention exhibits superior magnetic properties, and that in the cases where the magnet powder of the invention is used as the bonded magnet, the decrease in coercivity due to the compression molding is positively prevented, so that the bonded magnet exhibits superior magnetic properties, too.

EXAMPLE 24

Neodymium was melted with iron and boron in an electron beam melting furnace and cast into two kinds of neodymium-iron-boron alloy ingots represented in atomic composition by $Nd_{14.9}Fe_{77.0}B_{8.1}$ and $Nd_{14.1}Fe_{80.4}B_{5.5}$, respectively. Each of the ingots had a principal phase of $Nd_2Fe_{14}B$ phase comprised of crystal grains of a grain size of 50 to 150 μm. These ingots were crushed by a jaw crusher in an argon atmosphere into powders of an average particle size of 20 μm.

Further, $Nd_2O_3$, selected as rare-earth oxide powder, was blended with iron-boron alloy powder and metal calcium powder and neodymium-iron-boron alloy powder represented by $Nd_{14.5}Fe_{78.5}B_{7.0}$ was prepared by known coreduction. The alloy powder thus prepared had $Nd_2Fe_{14}B$ phase of crystal grains of 15 μm and was crushed so as to have an average particle size of 20 μm.

An appropriate amount of each of these three kinds of powders was placed on a board and introduced into a heat treating furnace. After the furnace was evacuated to a vacuum of $1.0\times10^{-5}$ torr, the powders were heated in the vacuum to various elevated temperatures of 500° C., 600° C., 750° C., 800° C., 850° C., 900° C. and 1,000° C., respectively. Then, hydrogen gas at 1 atm was introduced into the furnace at each temperature to produce an atmosphere of hydrogen at 1 atm in the furnace, and the powders were kept and treated therein at respective temperatures for 10 hours.

Thereafter, the furnace was evacuated at each temperature for 1 hour to a vacuum of $1.0\times10^{-5}$ torr, and argon gas was introduced thereinto until the pressure reached 1 atm. The rapid quenching of each powder was thus effected, and various neodymium-iron-boron alloy magnet powders were obtained. Procedure of this example is set forth in FIG. 22. The magnet powders thus obtained had recrystallized grain structures as is the case with Example 23.

The magnetic properties of the various magnet powders obtained were measured by a VSM, and the results are set forth in Table 9.

Control 12

An appropriate amount of each magnet powder of Example 24, comprising compositions represented in atomic composition as $Nd_{14.9}Fe_{77.0}B_{8.1}$, $Nd_{14.1}Fe_{80.4}B_{5.5}$ and $Nd_{14.5}Fe_{78.5}B_{7.0}$, respectively, were placed on a board and introduced in a heat treating furnace. After the furnace was evacuated to a vacuum of $1.0\times10^{-5}$ torr, the temperature was elevated in the vacuum to 400° C., 450° C. and 1,050° C., respectively. Then, hydrogen gas at 1 atm was introduced into the furnace at each temperature to produce a hydrogen atmosphere in the furnace, and the powders were kept and treated at each temperature for 10 hours.

Thereafter, the furnace was evacuated at the respective temperatures of 400° C., 450° C. and 1,050° C. for 1 hour to a vacuum of $1.0\times10^{-5}$ torr, and argon gas was introduced thereinto until the pressure reached 1 atm. The rapid quenching of each powder was thus effected, and comparative neodymium-iron-boron alloy magnet powders were obtained. Procedure of this control is also set forth in FIG. 22. The magnetic properties of the magnet powders of these three kinds were measured by a VSM, and the results are also set forth in Table 9.

TABLE 9

| Kinds of samples | Holding tem. (°C.) | Coercivities (KOe): $Nd_{14.9}Fe_{77.0}B_{8.1}$ | $Nd_{14.1}Fe_{80.4}B_{5.5}$ | $Nd_{14.5}Fe_{78.5}B_{7.0}$ |
|---|---|---|---|---|
| Example 24 | 1,000 | 8.0 | 6.7 | 5.2 |
| | 900 | 9.5 | 8.0 | 9.3 |
| | 850 | 12.6 | 11.6 | 10.0 |
| | 800 | 12.0 | 11.6 | 10.1 |
| | 750 | 9.0 | 8.1 | 7.7 |
| | 700 | 7.0 | 6.2 | 7.0 |
| | 600 | 6.3 | 5.9 | 6.0 |
| | 500 | 5.8 | 5.5 | 5.5 |
| Control 12 | 450 | 3.2 | 2.6 | 2.2 |
| | 400 | 3.1 | 2.0 | 2.0 |
| | 1,050 | 4.6 | 3.9 | 3.8 |

Figure 22:
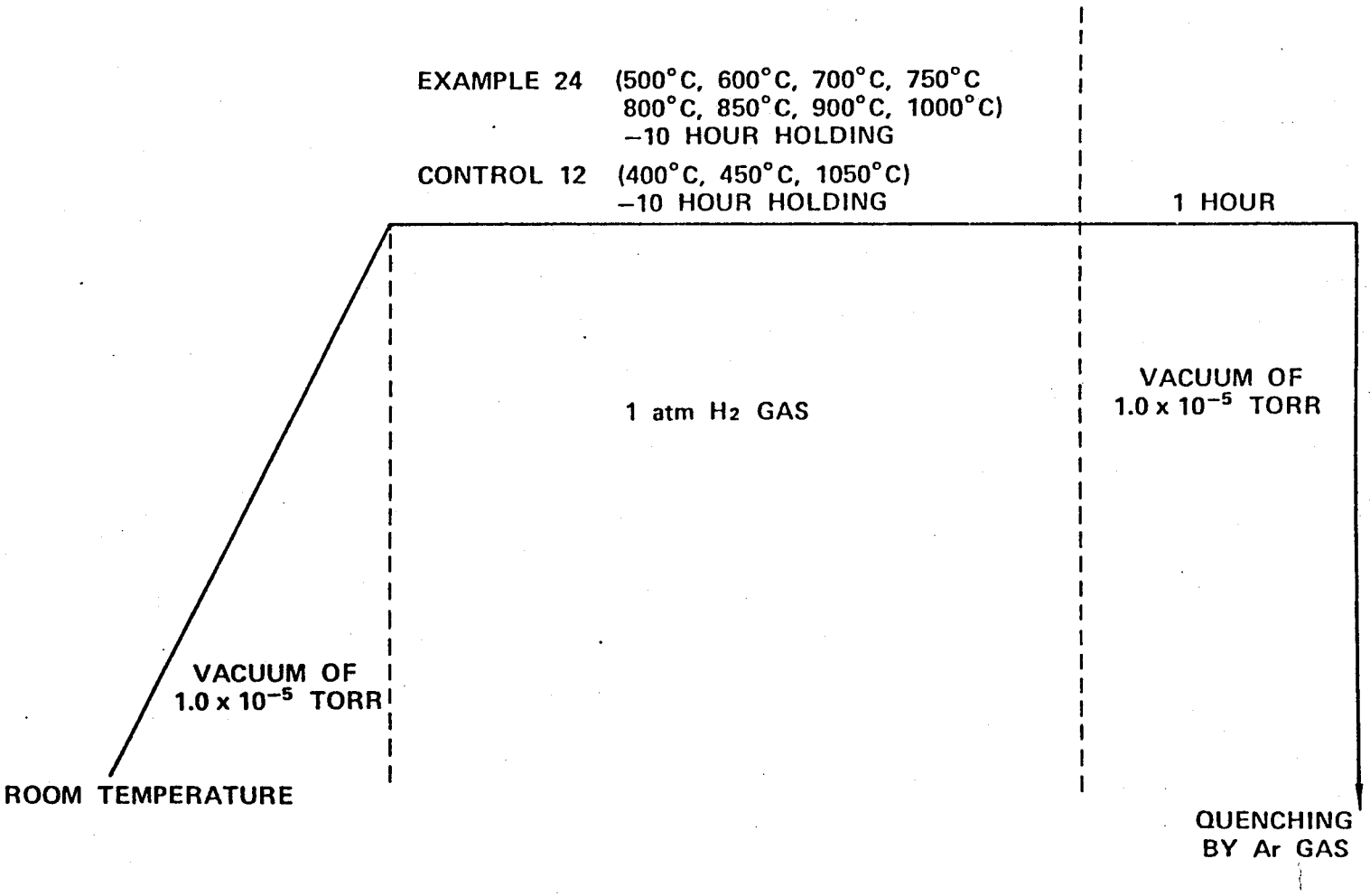
FIG. 22 is a diagrammatical representation showing the patterns of procedures of Example 24 and Control 12.
Figure 23:
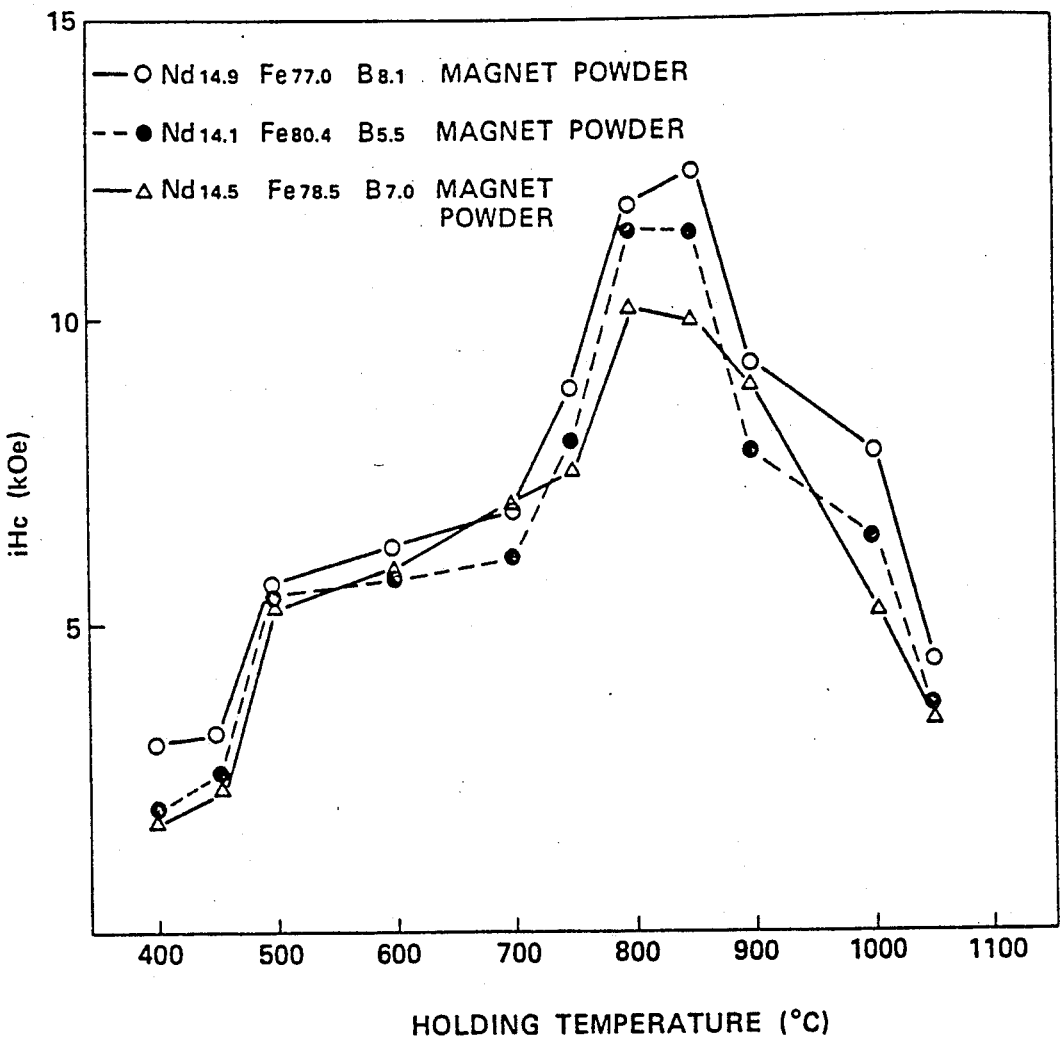
FIG. 23 is a graphical representation showing the relationship between the coercivity and holding temperature of the rare earth-iron-boron magnet powders.

The results shown in FIG. 22 are also depicted in a graph of FIG. 23 which shows the coercivities of the powders of $Nd_{14.9}Fe_{77.0}B_{8.1}$, $Nd_{14.1}Fe_{80.4}B_{5.5}$ and $Nd_{14.5}Fe_{78.5}B_{7.0}$ plotted against the holding temperature. As will be clearly seen from FIG. 23, when kept at temperature of 500° to 1,000° C. (preferably of 750° to 900° C.), the magnet powders exhibit increased coercivities of no less than 5 KOe.

EXAMPLE 25

In the manufacturing method of the invention as illustrated in Example 23, when effecting the evacuation at 810° C. after the treatment at 810° C. in an atmosphere of hydrogen at 1 atm for 5 hours, the furnace was evacuated up to various vacuum atmospheres of hydrogen pressure at $1.0\times10^{-4}$ torr, $1.0\times10^{-3}$ torr, $2.0\times10^{-3}$torr, $1.0\times10^{-2}$ torr and $1.0\times10^{-1}$ torr, respectively. Thereafter, by introducing argon gas into the furnace until the pressure reached 1 atm, the rapid quenching was effected, and magnet powders of an average particle size of 6.2 μm were obtained. The magnetic properties of such magnet powder were measured by a VSM, and the results are shown in Table 10.

Control 13

For comparison purposes, the procedures of Example 25 were repeated with the exception that the vacuum was set to be $2.0\times10^{-1}$ torr and 1 torr to prepare neodymium-iron-boron alloy magnet powders, and the magnetic properties of the magnet powders thus obtained were measured under the same conditions as in Example 25. The results are set forth in Table 10.

Figure 24:
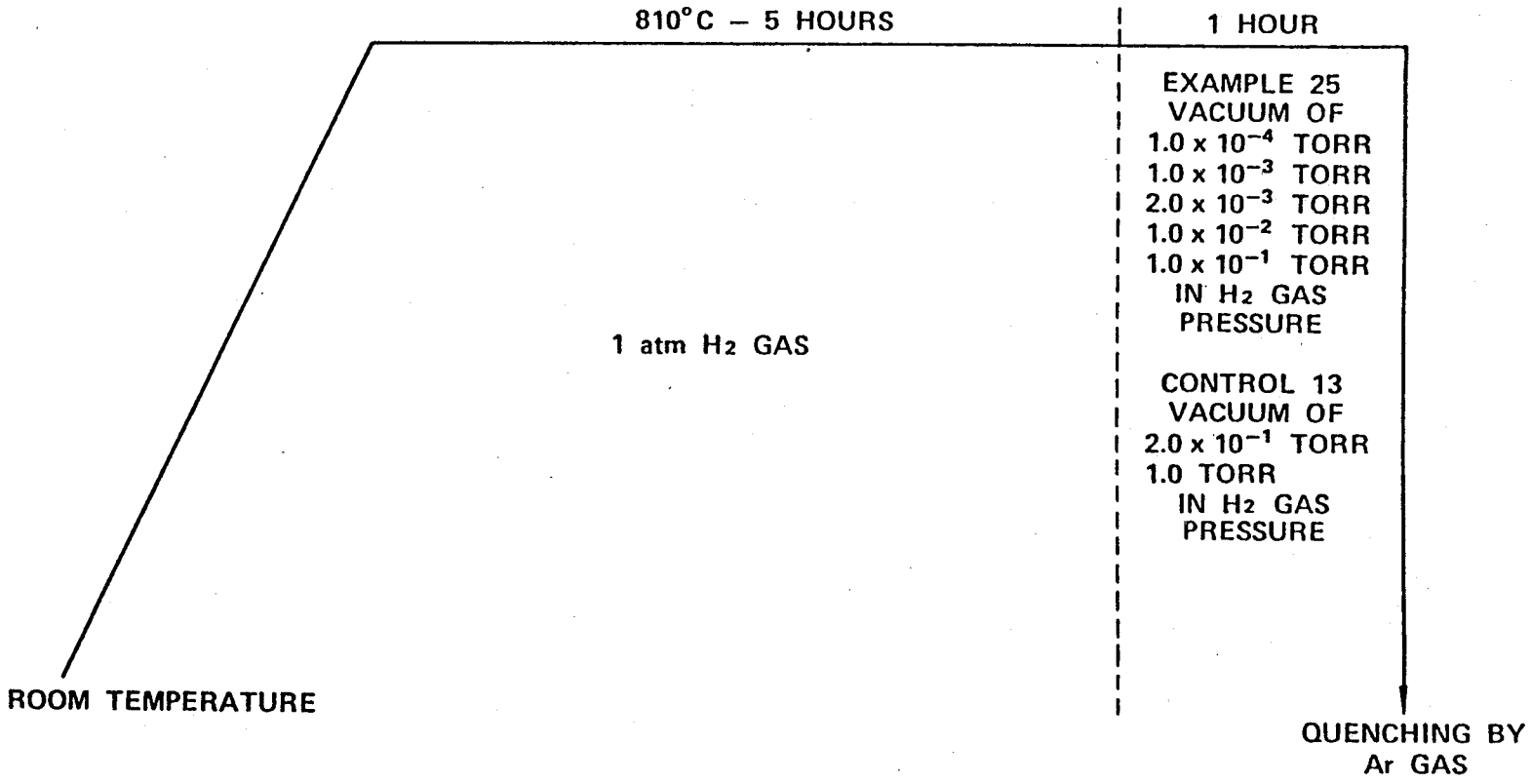
FIG. 24 is a diagrammatical representations showing the pattern of procedures of Example 25 and Control 13.

The patterns of the manufacturing procedures of Example 25 and Control 13 are both set forth in FIG. 24.

TABLE 10

| Kind of samples | Degree of vacuum (torr) | Coercivities (KOe) |
|---|---|---|
| Example 23 | $1.0\times10^{-5}$ | 12.1 |
| Example 25 | $1.0\times10^{-4}$ | 12.1 |
| | $1.0\times10^{-3}$ | 11.0 |
| | $2.0\times10^{-3}$ | 10.8 |
| | $1.0\times10^{-2}$ | 8.6 |
| | $1.0\times10^{-1}$ | 8.1 |
| Control 13 | $2.0\times10^{-1}$ | 1.2 |
| | 1.0 | 0.4 |

The data set forth in Table 10 shows that the rare earth-iron-boron alloy magnet powders, produced by exhausting the furnace to a vacuum of no greater than $1.0\times10^{-1}$ torr to produce an almost complete dehydrogenated atmosphere in the heat treating furnace, exhibit a superior magnetic properties.

EXAMPLE 26

Figure 25:
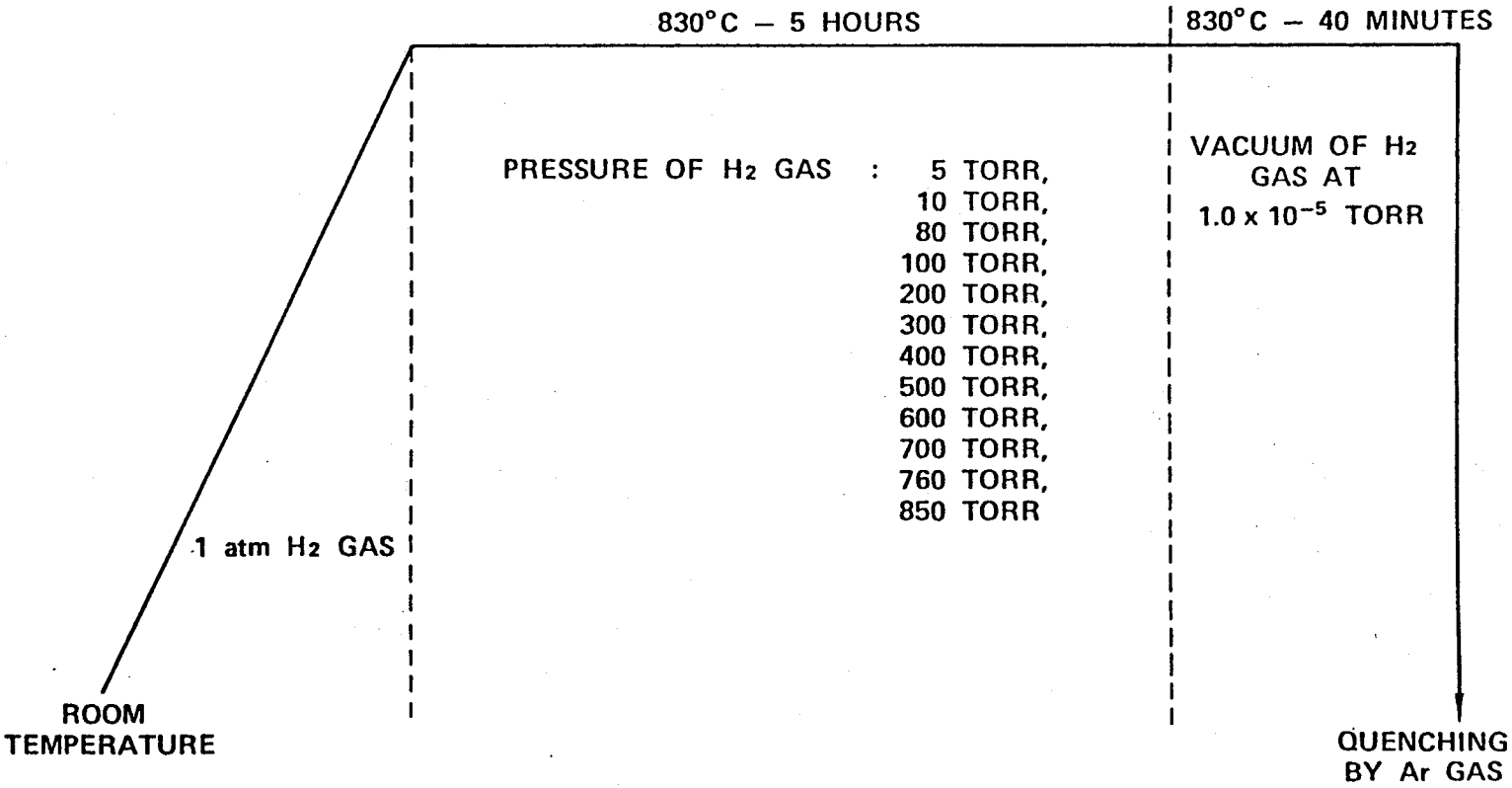
FIG. 25 is a diagrammatical representation of the pattern of Example 26.

Neodymium and praseodymium were melted with iron and boron in a high frequency induction furnace and cast into a neodymium-praseodymium-iron-boron alloy ingot having a principal composition represented in atomic composition as $Nd_{12.0}Pr_{1.4}Fe_{80.8}B_{5.8}$. The alloy ingot had a principal phase of $(Nd, Pr)_2Fe_{14}B$ phase having crystal grains of particle size of about 120 μm. This ingot was subjected to coarse crushing in a stamp mill in an argon gas atmosphere to produce a neodymium-praseodymium-iron-boron alloy powder having an average particle size of 30 μm. The powder thus prepared was placed on a board and introduced into a heat treating furnace, and the furnace was evacuated to a vacuum of $1.0\times10^{-5}$ torr. Then, hydrogen gas at 1 atm was introduced into the furnace, and while maintaining the pressure of the hydrogen gas, the temperature was elevated from the room temperature to 830° C. Thereafter, the powders were kept and treated at 830° C. for 5 hours under the various pressures of hydrogen gas at 5 torr, 10 torr, 80 torr, 100 torr, 200 torr, 300 torr, 400 torr, 500 torr, 600 torr, 700 torr, 760 torr and 850 torr, respectively. Then, the furnace was evacuated at 830° C. for 40 minutes to a vacuum of hydrogen at $1.0\times10^{-5}$ torr, and the rapid quenching was thus effected. The powder obtained in this way was in the form of aggregates, and hence was broken into pieces in a mortar to prepare neodymium-praseodymium-iron-boron alloy powders having average particle sizes as shown in Table 11. FIG. 25 shows the pattern of procedure of this example. The magnet powders obtained had the same recrystallized grain structures as in Example 23.

The magnet powder thus obtained was blended with 3.0% by weight of phenol-novolak epoxy resin and subjected to compression molding under a pressure of 6 tons/cm$^2$ in the absence of magnetic field or in the presence of a magnetic field of 15 KOe, following which the resin was solidified by holding the compact at a temperature of 100° C. for 10 hours, resulting in a bonded magnet. The magnetic properties for the bonded magnet thus obtained are also set forth in Table 11.

Figure 26:
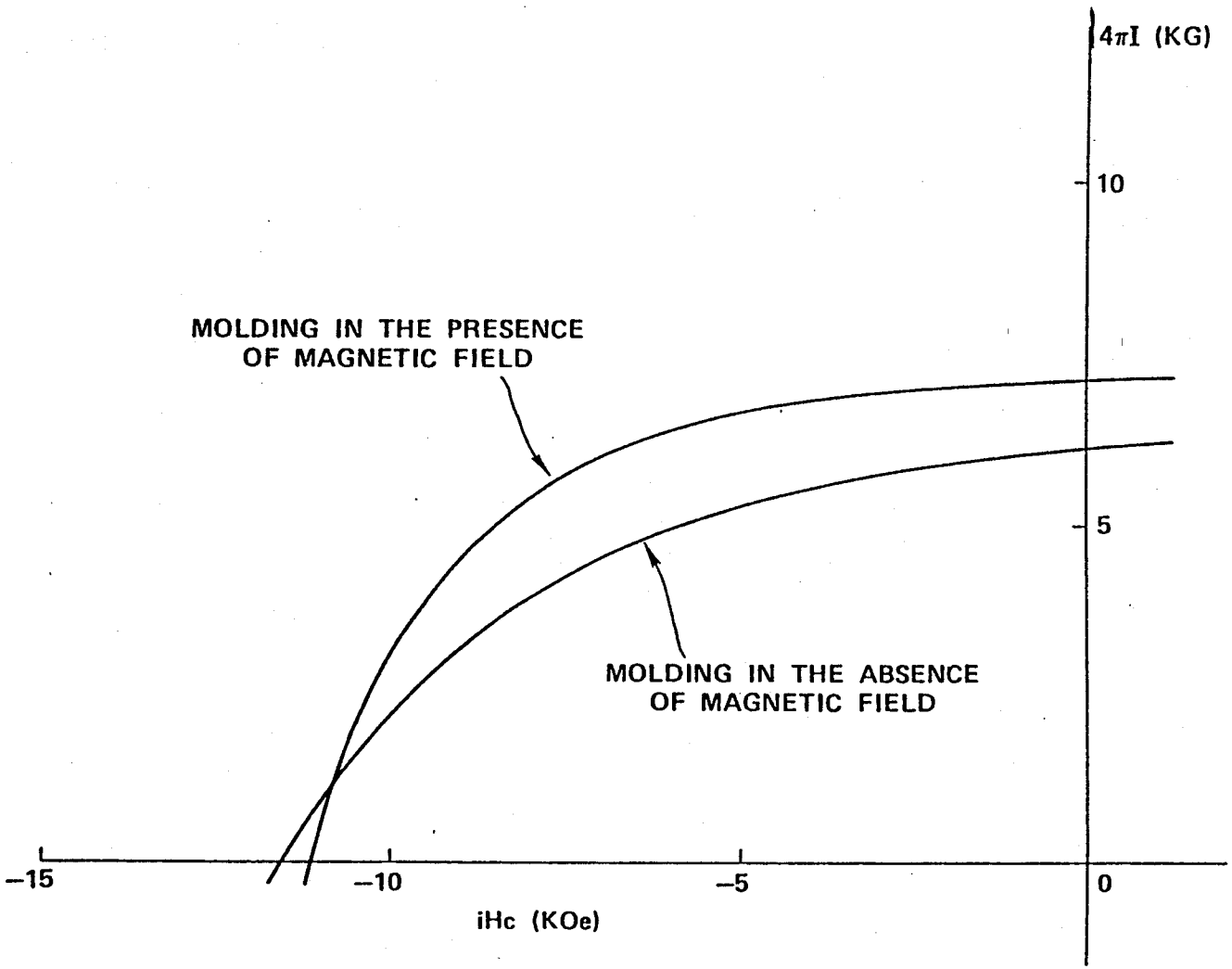
FIG. 26 is a graph showing the demagnetization curve of the bonded magnet of Example 26.

FIG. 26 shows a demagnetization curve for the bonded magnet of the neodymium-praseodymium-iron-boron alloy magnet powder prepared in a vacuum of hydrogen at 100 torr.

TABLE 11

| Kind of samples | $H_2$ gas pressure (torr) | Average particle size (μm) | Presence of magnetic field upon molding | Magnetic properties of bonded magnets Br (KG) | iHc (KOe) | $(BH)_{max}$ (MGOe) |
|---|---|---|---|---|---|---|
| Example 26 | 5 | 24 | Present | 5.1 | 4.5 | 4.2 |
| | | | Absent | 4.6 | 4.4 | 3.3 |
| | 10 | 23 | Present | 6.0 | 5.4 | 5.8 |
| | | | Absent | 5.3 | 5.6 | 5.0 |
| | 80 | 20 | Present | 6.4 | 9.0 | 9.1 |
| | | | Absent | 5.8 | 9.3 | 6.4 |
| | 100 | 29 | Present | 7.2 | 11.1 | 12.0 |
| | | | Absent | 6.1 | 11.6 | 8.2 |
| | 200 | 21 | Present | 6.8 | 10.5 | 10.6 |
| | | | Absent | 5.8 | 10.5 | 7.7 |
| | 300 | 20 | Present | 6.4 | 10.0 | 8.5 |
| | | | Absent | 5.9 | 10.2 | 7.9 |
| | 400 | 19 | Present | 6.4 | 10.1 | 9.3 |
| | | | Absent | 6.0 | 10.3 | 7.9 |
| | 500 | 23 | Present | 6.5 | 10.0 | 9.8 |
| | | | Absent | 6.0 | 9.9 | 7.8 |
| | 600 | 20 | Present | 6.1 | 9.8 | 8.1 |
| | | | Absent | 6.1 | 9.7 | 8.0 |
| | 700 | 25 | Present | 6.0 | 9.5 | 8.0 |
| | | | Absent | 6.0 | 9.6 | 7.6 |
| | 760 | 28 | Present | 6.0 | 9.3 | 7.5 |
| | | | Absent | 5.9 | 9.5 | 7.4 |
| | 850 | 23 | Present | 6.0 | 8.5 | 5.1 |
| | | | Absent | 6.1 | 8.5 | 5.0 |

It is seen from Table 11 that the hydrogen gas pressure upon the annealing should be preferably in the range of 10 to 760 torr. With the pressure above 760 torr, the dehydrogenation treatment is not sufficient, and hydrogen gas remained in the magnet powders.

It is also seen from Table 11 that the bonded magnet produced by the molding in the presence of magnetic filed is superior in Br value to that produced by the molding in the absence of magnetic field, and hence is a markedly anisotropic bonded magnet. This will be also seen from FIG. 26. Accordingly, the magnet powder produced according to the method of the invention exhibits a magnetic anisotropy.

EXAMPLE 27

Figure 27:
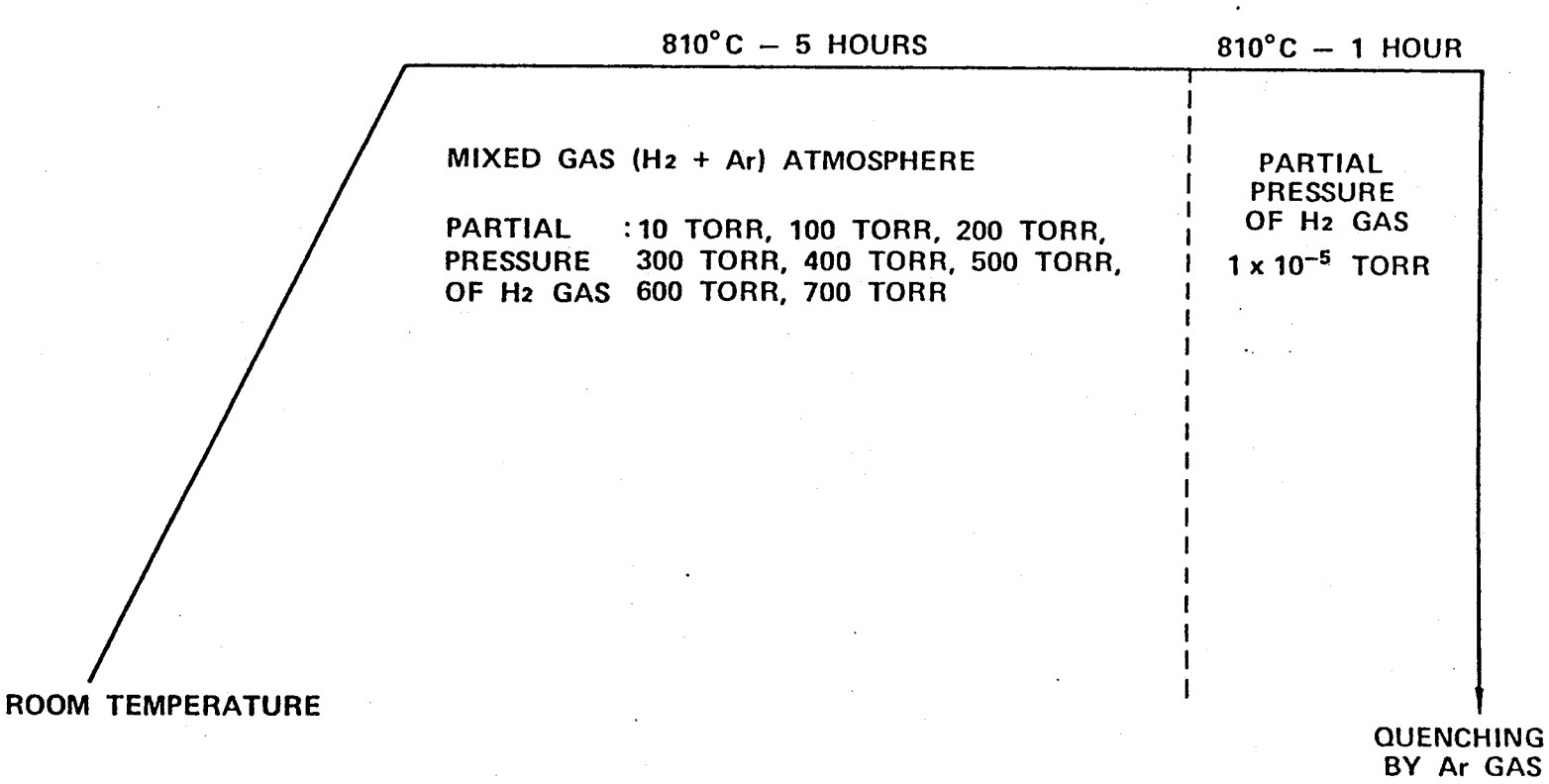
FIGS. 27 to 30 are diagrammatical representations depicting the patterns of Examples 27 to 30, respectively.

An appropriate amount of the neodymium-iron-boron alloy powder of average particle size of 3.8 μm, produced by fine crushing in Example 23, was placed on a board and introduced into a heat treating furnace, and the furnace was evacuated to a vacuum of $1.0\times10^{-5}$ torr. Then, mixed gases of hydrogen and argon, prepared so as to have partial pressures of hydrogen as set forth in Table 12, were selectively introduced into the furnace and the temperature in the furnace was elevated from the room temperature to 810° C. in such atmosphere. Thus the powders were treated at 810° C. in such various mixed gas atmospheres for 5 hours, and the furnace was evacuated to such a level that the partial pressure of hydrogen was $1.0\times10^{-5}$ torr. The dehydrogenation was effected in such an atmosphere and the powder was quenched by the introduction of argon gas into the furnace. The neodymium-iron-boron alloy powder thus obtained was in the form of powder aggregates, and hence broken into pieces in a mortar so as to have average particle sizes set forth in Table 12. FIG. 27 shows the pattern of the above procedures. The magnet powder thus obtained had the same recrystallized grain structure as Example 23 had. The magnetic properties of the magnet powder were measured by a VSM, and the results are also set forth in Table 12.

Further, bonded magnets were prepared by using the above magnet powder, and its magnetic properties are also shown in Table 12.

This example shows that the material may be treated not only in a hydrogen atmosphere but in a mixed gas atmosphere of hydrogen and inert gas, to obtain neodymium-iron-boron alloy powder with superior magnetic properties.

TABLE 12

| Kind of samples | Partial pressure of hydrogen in atmosphere of mixed gas ($H_2$ + Ar) (torr) | Average particle size (μm) | Magnet powders Magnetization with magnetic field of 15 KOe (KG) | Bonded magnets iHc (KOe) | Br (KG) | iHc (KOe) | $BH_{max}$ (MGOe) |
|---|---|---|---|---|---|---|---|
| Example 27 | 10 | 10.0 | 9.8 | 8.8 | 6.5 | 7.0 | 5.2 |
| | 100 | 8.6 | 8.5 | 15.1 | 6.2 | 14.6 | 8.1 |
| | 200 | 7.5 | 8.4 | 14.4 | 6.3 | 14.0 | 8.3 |
| | 300 | 7.6 | 8.2 | 12.2 | 6.8 | 11.5 | 10.1 |
| | 400 | 8.2 | 8.0 | 12.5 | 6.7 | 11.5 | 9.8 |
| | 500 | 7.1 | 7.9 | 12.7 | 6.8 | 11.3 | 10.2 |
| | 600 | 6.8 | 8.1 | 11.9 | 7.1 | 10.8 | 11.5 |
| | 700 | 6.1 | 8.0 | 12.0 | 7.2 | 11.7 | 11.4 |

EXAMPLE 28

Figure 28:
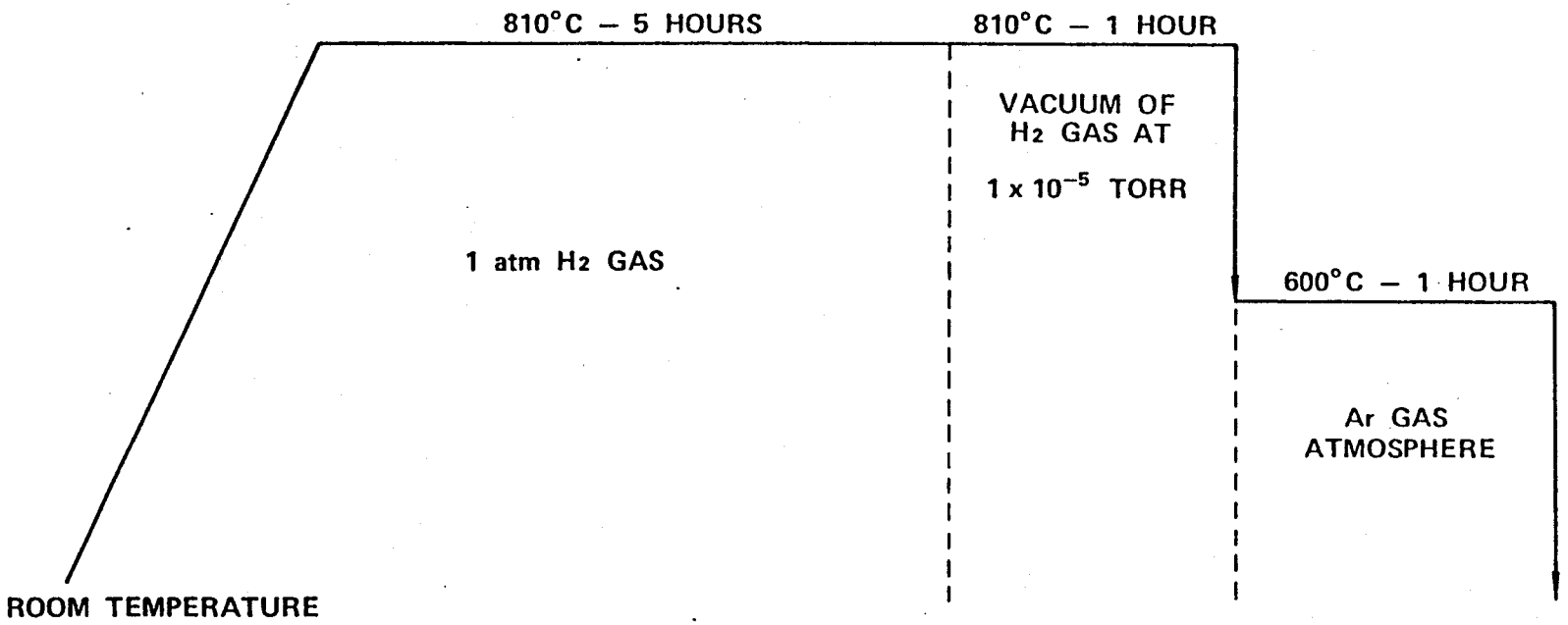

The fine powder, subjected to dehydrogenation in Example 23, was directly cooled to a temperature of 600° C. by argon gas, and was subjected to heat treatment by being kept at this temperature for 1 hour. The aggregated powder thus treated was broken into pieces in a mortar to produce a neodymium-iron-boron alloy magnet powder of average particle size of 7.5 μm. FIG. 28 shows the pattern of the procedures of this example. The magnetic properties of the magnet powder obtained in this example was measured in the same way as in Example 23, and the results are shown in Table 13.

EXAMPLE 29

Figure 29:
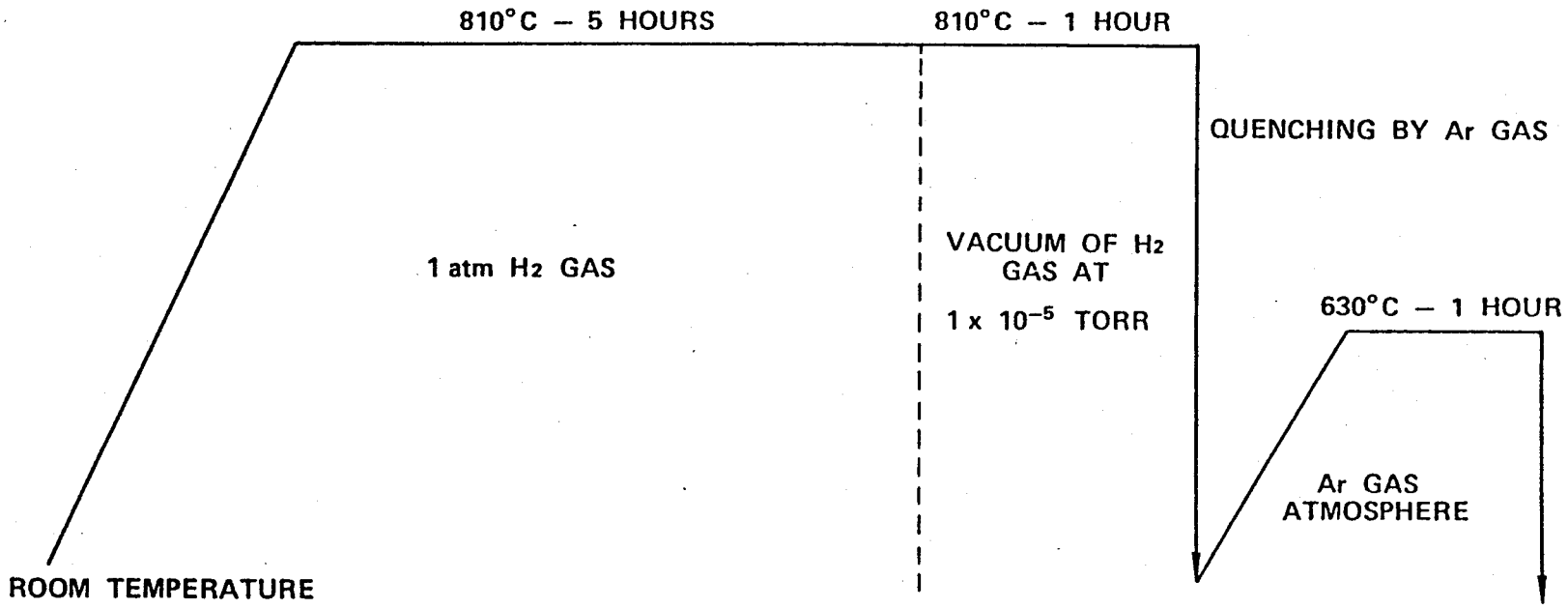

The fine powder, subjected to dehydrogenation in Example 23, was quenched to the room temperature by using argon gas, and heated to elevated temperature of 630° C. in an argon gas atmosphere. After treated by being kept at this temperature for 1 hour, the powder was quenched again. The aggregated powder thus produced was broken into pieces in a mortar to produce a neodymium-iron-boron alloy magnet powder of average particle size of 7.0 μm. The pattern of the procedures of this example is set forth in FIG. 29.

The magnetic properties of the magnet powder obtained in this example was measured in the same way as in Example 23, and the results are shown in Table 13.

The magnetic properties of the magnet powder of Example 23 are also shown in Table 13 for comparison purposes.

TABLE 13

| Kinds of samples | Magnet powders Average particle size (μm) | Magnetization with magnetizing field of 15 KOe (KG) | Coercivities iHc (KOe) |
|---|---|---|---|
| Example 28 | 7.5 | 8.1 | 15.3 |
| Example 29 | 7.0 | 8.1 | 15.0 |
| Example 23 | 6.2 | 8.0 | 12.1 |

It is seen from Table 13 that when the magnet powder of Example 23 is subjected to the heat treatment, the resulted powder exhibits further improved magnetic properties.

EXAMPLE 30

Figure 30:
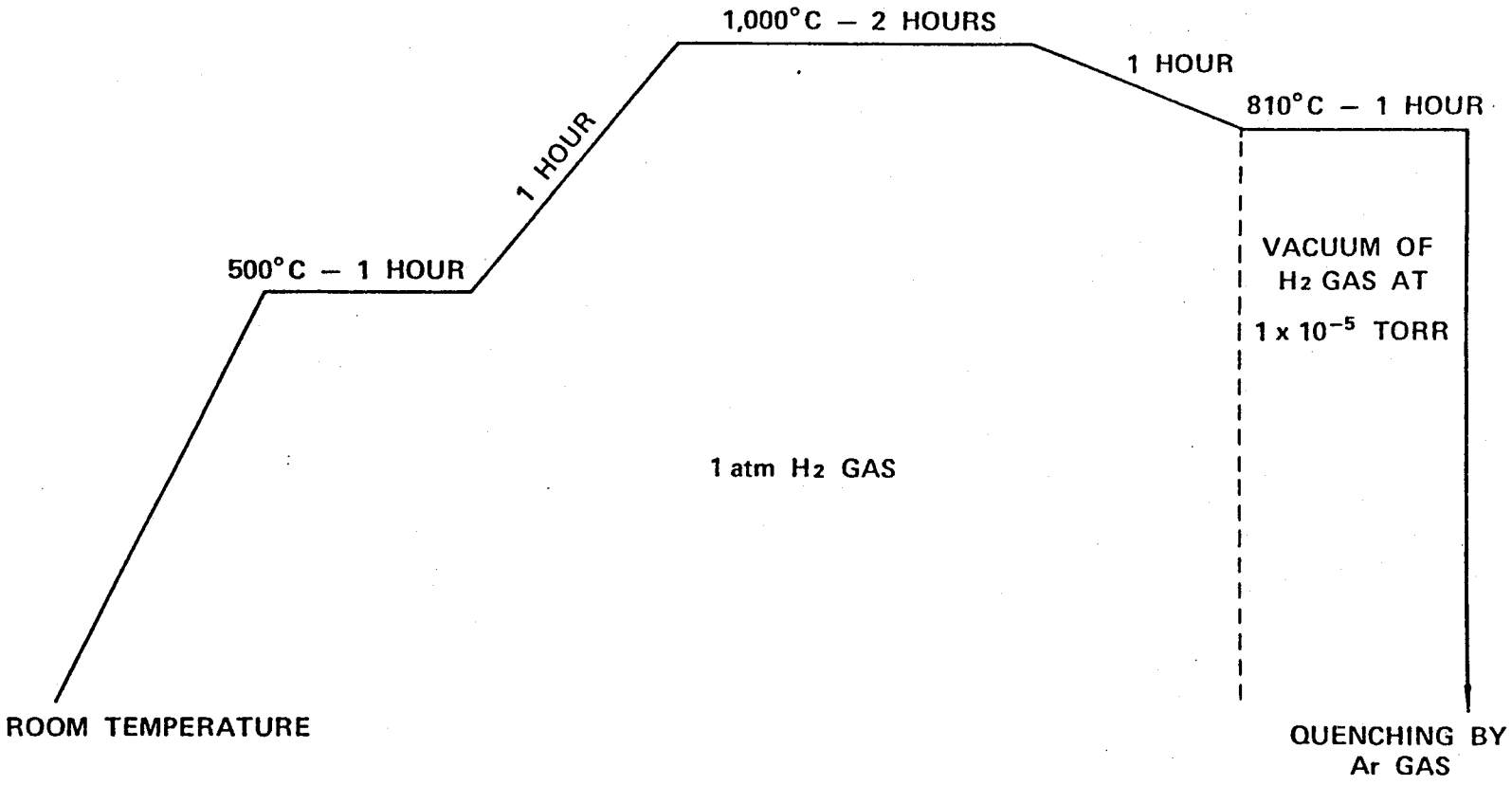

Neodymium and dysprosium were melted with iron and boron in a plasma arc melting furnace and cast into a neodymium-dysprosium-iron-boron alloy ingot having a principal composition represented in atomic composition as $Nd_{10.5}Dy_{1.5}Fe_{82.4}B_{5.6}$. Inasmuch as non-equilibrium phases such as α-Fe phase was formed in the alloy ingot in the state of castings, the ingot was subjected to homogenizing treatment by keeping it in an argon atmosphere at 1,000° C. for 40 hours, to remove the non-equilibrium phases. The principal phase $(Nd,Dy)_2Fe_{14}B$ of the ingot thus homogenized was comprised of crystal grains of an average grain size of about 60 μm. The above ingot was introduced into a heat treating furnace, and the furnace was evacuated to a vacuum of $1\times10^{-5}$ torr. Then, hydrogen gas at 1 atm was introduced into the furnace, and the furnace was heated from room temperature to elevated temperature of 500° C. while maintaining the pressure of hydrogen gas. After the alloy was kept at 500° C. for 1 hour, it was slowly heated to 1,000° C. and kept at 1,000° C. for 2 hours, following which the temperature was decreased to 810° C. in 1 hour. After arrival at 810° C., the furnace was evacuated and dehydrogenation was carried out by keeping the alloy at 810° C. in a vacuum atmosphere of hydrogen at $1\times10^{-5}$ torr for 1 hour. Thereafter, the rapid quenching was effected by introducing argon gas into the furnace until the pressure arrived at 1 atm. FIG. 30 shows the pattern of the procedures of this example.

Since the homogenized ingot treated under the conditions as set forth in FIG. 30 had been already crushed to some extent, it was broken into pieces in a mortar, and neodymium-iron-boron alloy magnet powder of an average particle size of 17 μm was obtained.

The magnet powder thus obtained had the same recrystallized grain structure as Example 23 had. The magnetic properties of the magnet powder were measured by a VSM in the same way as in Example 23. As a result, it was found that the magnetization was 9.2 KG at $H_o=15$ KOe, and that the coercivity was 13.5 KOe.

Subsequently, a bonded magnet was prepared by using this magnet powder, and its magnetic properties measured are as follows:

Flux density Br: 8.0 KG.

Coercivity iHc: 13.0 KOe.

Maximum energy product $BH_{max}$: 14.1 MGOe

As will be seen from the above results of measurement, even though temperature is increased, decreased or kept constant, magnet powder having superior magnetic properties can be obtained as long as the temperature is in the range 500° C.-1,000° C. Besides, the bonded magnet prepared by using this magnet powder as well exhibits superior magnetic properties without reduction in coercivities due to the compression molding.

EXAMPLE 31

Figure 31:
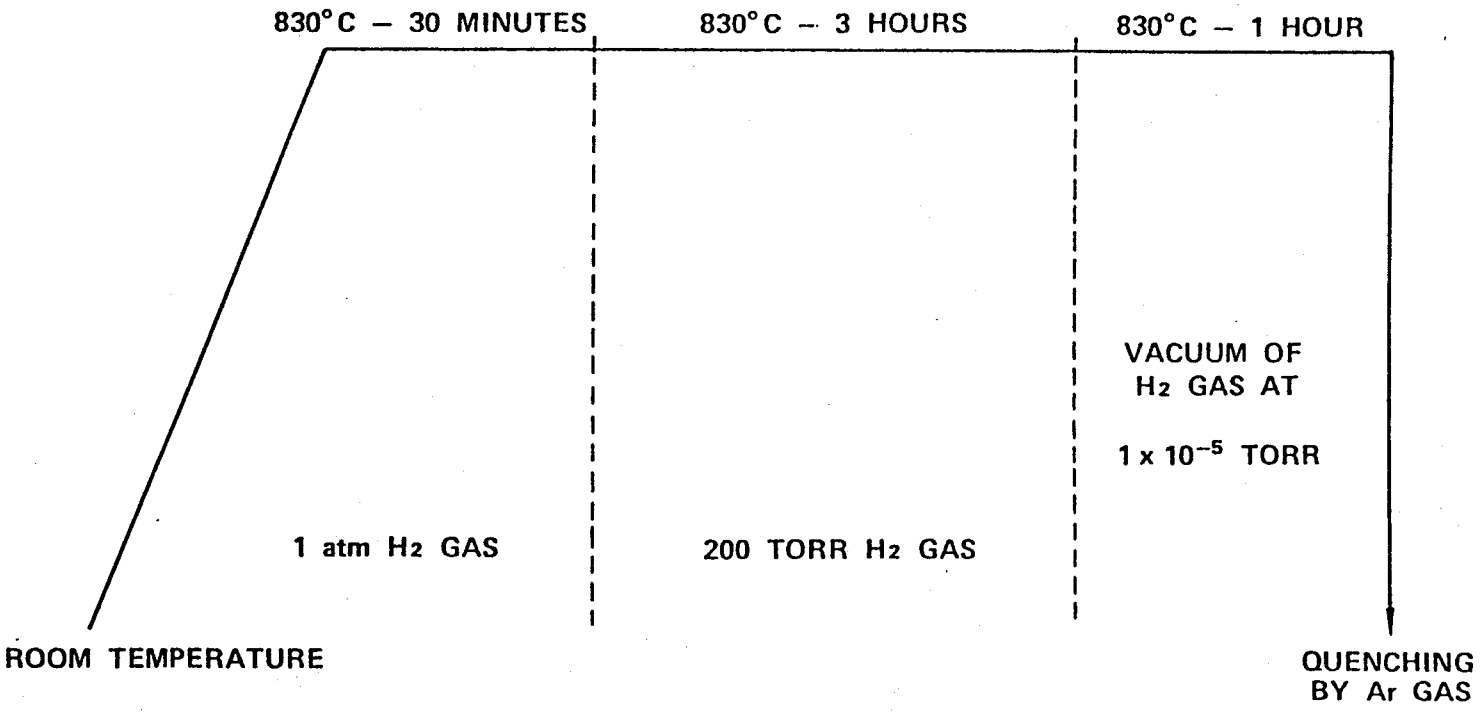
FIG. 31 is a diagrammatical representation showing the patterns of Examples 31 to 33.

Neodymium was melted with iron and boron in a high frequency furnace and cast into rare earth alloy ingots having principal compositions represented in atomic composition as $Nd_{10.5}Fe_{84.2}B_{5.3}$, $Nd_{11.5}Fe_{83.3}B_{5.2}$, $Nd_{12.2}Fe_{82.0}B_{5.8}$, $Nd_{13.0}Fe_{81.0}B_{6.0}$, $Nd_{13.5}Fe_{80.5}B_{6.0}$, $Nd_{14.2}Fe_{79.3}B_{6.5}$, $Nd_{15.1}Fe_{76.8}B_{8.1}$, $Nd_{16.3}Fe_{75.2}B_{8.5}$ and $Nd_{20.2}Fe_{71.6}B_{8.2}$, respectively. The $Nd_2Fe_{14}B$ phase serving as the principal phase was comprised of crystal grains of a particle size of about 50 to 70 μm. Each of the above ingots was introduced into a heat treating furnace and the furnace was evacuated to $1.0\times10^{-5}$ torr. Then, hydrogen gas at 1 atm was introduced into the furnace, and the furnace was heated from room temperature to elevated temperature of 830° C. while maintaining the pressure of hydrogen gas. The alloy was kept in the hydrogen atmosphere at 1 atm at 830° C. for 30 minutes, and further in the hydrogen atmosphere at 200 torr at 830° C. for 3 hours, following which the furnace was evacuated at 830° C. for 1 hour to a vacuum of $1.0\times10^{-5}$ torr. Thereafter, rapid quenching was effected by introducing argon gas into the furnace until the pressure arrived at 1 atm. FIG. 31 shows the pattern of the procedure of this example.

Since the ingots treated under the conditions as set forth in FIG. 31 had been already crushed to some extent, they were broken into pieces in a mortar, so that neodymium-iron-boron alloy magnet powders of an average particle size of 20 μm were obtained. The magnet powder thus obtained also had the same recrystallized grain structure as in Example 23.

The magnetic properties of the magnet powders measured by a VSM are shown in Table 14. These magnet powders were further blended with 3.0% by weight of phenol-novolak epoxy resins and subjected to compression molding under a pressure of 6 tons/cm$^2$ in a magnetic field of 15 KOe, following which the resins were solidified by holding the compact at a temperature of 100° C. for 6 hours, resulting in bonded magnets. The magnetic properties for the bonded magnets thus obtained are also set forth in Table 14.

EXAMPLE 32

In Example 31, each ingot prior to the treatment of the invention was crushed by a stamp mill in an argon gas atmosphere into powder with average particle size of 30 μm. The powder was then introduced into a heat treating furnace and treated under the same conditions as in Example 32, i.e., as in FIG. 31. Since the powders obtained were in the aggregated forms, they were broken into pieces in a mortar, so that neodymium-iron-boron alloy magnet powders of an average particle size of 38 μm were obtained. The magnet powder thus obtained also had the same recrystallized grain structure as the powder of Example 23 had. The magnetic properties of these magnet powders were also measured and the results are set forth in Table 14.

TABLE 14

| Synthetic composition | Kind of samples | Shape of alloy prior to $H_2$ treatment | Magnet powder iHc (KOe) | Bond magnets Br (KG) | iHc (KOe) | $(BH)_{max}$ (MGOe) |
|---|---|---|---|---|---|---|
| $Nd_{10.5}Fe_{84.2}B_{5.3}$ | Example 31 | Ingot | 2.5 | 3.6 | 2.5 | — |
| | Example 32 | powder | 1.0 | 3.5 | 0.9 | — |
| $Nd_{11.5}Fe_{83.3}B_{5.2}$ | Example 31 | Ingot | 4.3 | 4.0 | 4.1 | 2.2 |
| | Example 32 | powder | 2.1 | 3.4 | 2.0 | — |
| $Nd_{12.2}Fe_{82.0}B_{5.8}$ | Example 31 | Ingot | 8.8 | 7.2 | 8.5 | 10.1 |
| | Example 32 | powder | 5.6 | 6.1 | 5.2 | 5.4 |
| $Nd_{13.0}Fe_{81.0}B_{6.0}$ | Example 31 | Ingot | 9.6 | 6.8 | 9.5 | 9.7 |
| | Example 32 | powder | 6.2 | 6.5 | 6.0 | 8.1 |
| $Nd_{13.5}Fe_{80.5}B_{6.0}$ | Example 31 | Ingot | 9.2 | 6.0 | 9.1 | 7.4 |
| | Example 32 | Powder | 6.4 | 6.0 | 6.3 | 6.8 |
| $Nd_{14.2}Fe_{79.3}B_{6.5}$ | Example 31 | Ingot | 9.5 | 6.2 | 9.4 | 8.0 |
| | Example 32 | Powder | 8.3 | 5.9 | 8.3 | 7.2 |
| $Nd_{15.1}Fe_{76.8}B_{8.1}$ | Example 31 | Ingot | 7.7 | 5.7 | 6.0 | 4.1 |
| | Example 32 | Powder | 14.3 | 6.3 | 14.1 | 8.2 |
| $Nd_{16.3}Fe_{75.2}B_{8.5}$ | Example 31 | Ingot | 8.1 | 5.8 | 8.1 | 4.0 |
| | Example 32 | Powder | 16.2 | 5.3 | 16.0 | 5.5 |
| $Nd_{20.2}Fe_{71.6}B_{8.2}$ | Example 31 | Ingot | 7.9 | 4.2 | 7.6 | 3.1 |
| | Example 32 | Powder | 12.3 | 4.0 | 12.4 | 3.5 |

EXAMPLE 33

The ingots and powders produced in Examples 31 and 32 prior to the treatment of the invention were subjected to the homogenizing treatment by keeping them at 1,050° C. in an argon gas pressurized atmosphere of 1.3 atm for 30 hours. The ingots and powders were then treated under the same conditions as in Example 31 shown in FIG. 31, so that neodymium-iron-boron alloy magnet powders of an average particle size of 25 μm were obtained. The magnet powder thus prepared also had the same recrystallized grain structure as the powder of Example 23 had. The magnetic properties of these magnet powders were also measured and the results are set forth in Table 15.

Comparing Table 15 with Table 14, it is seen that in order to improve magnetic properties of the neodymium-iron-boron alloy magnet powder, the neodymium-iron-boron alloy material would rather be used in the form of homogenized ingots than in the form of non-treated ingots, or would rather be used in the form of homogenized powders than non-treated powders. In particular, as regards an alloy having a composition represented by $R_x(Fe,B)_{100-x}$ wherein $11.7 \leqq x \leqq 15$, it can be understood that the homogenized ingot should be preferably used as the material.

TABLE 15

| Synthetic composition | Form of homogenized alloy | Magnet powders iHc (KOe) | Bond magnets Br (KG) | iHc KOe) | $(BH)_{max}$ (MGOe) |
|---|---|---|---|---|---|
| $Nd_{10.5}Fe_{84.2}B_{5.3}$ | Ingot | 4.8 | 3.9 | 4.7 | 2.1 |
| | powder | 3.0 | 3.6 | 3.0 | — |
| $Nd_{11.5}Fe_{83.3}B_{5.2}$ | Ingot | 5.0 | 4.5 | 4.8 | 3.2 |
| | powder | 4.1 | 3.6 | 4.1 | 2.0 |
| $Nd_{12.2}Fe_{82.0}B_{5.8}$ | Ingot | 10.8 | 7.5 | 10.6 | 13.0 |
| | powder | 10.1 | 6.3 | 10.0 | 8.4 |
| $Nd_{13.0}Fe_{81.0}B_{6.0}$ | Ingot | 11.6 | 7.3 | 11.7 | 11.8 |
| | powder | 11.0 | 6.8 | 11.0 | 10.1 |
| $Nd_{13.5}Fe_{80.5}B_{6.0}$ | Ingot | 12.3 | 7.1 | 12.1 | 11.2 |
| | powder | 11.4 | 6.5 | 11.2 | 9.3 |
| $Nd_{14.2}Fe_{79.3}B_{6.5}$ | Ingot | 12.5 | 6.6 | 12.6 | 9.5 |
| | powder | 11.2 | 6.4 | 11.0 | 9.3 |
| $Nd_{15.1}Fe_{76.8}B_{8.1}$ | Ingot | 9.8 | 6.0 | 9.7 | 7.1 |
| | powder | 16.0 | 6.3 | 15.8 | 8.4 |
| $Nd_{16.3}Fe_{75.2}B_{8.5}$ | Ingot | 11.4 | 5.7 | 11.2 | 6.5 |
| | powder | 17.3 | 5.2 | 17.0 | 6.0 |
| $Nd_{20.2}Fe_{71.6}B_{8.2}$ | Ingot | 12.4 | 4.1 | 12.3 | 3.6 |
| | powder | 13.0 | 4.1 | 12.8 | 3.7 |

EXAMPLE 34

Neodymium, selected from the rare earths, was melted with iron and boron in a high frequency induction furnace and cast into neodymium-iron-boron alloy ingots of 20 mm in diameter and 20 mm in height, each of which had a principal composition represented in atomic composition as $Nd_{12.5}Fe_{81.5}B_{6.0}$. These ingots had $Nd_2Fe_{14}B$ phase serving as a principal phase and comprised of crystal grains of an average particle size of about 40 μm, and their α- Fe phases were segregated. Each alloy was introduced into a heat treating furnace and subjected to homogenizing treatment under the conditions as set forth in Table 16 in an atmosphere of argon at 1 atm. The principal phase of each ingot thus homogenized had an average particle size of about 120 μm, and the—phase had been eliminated.

The above homogenized ingots were introduced into a heat treating furnace, and the furnace was evacuated to a vacuum of $5 \times 10^{-5}$ torr. Then, a mixed gas of hydrogen and argon wherein partial pressure of hydrogen gas was 1 atm was introduced into the furnace, and the furnace was heated from room temperature to elevated temperature of 850° C. while maintaining the partial pressure of hydrogen. After the ingots were kept at 850° C. for 6 hours, the furnace was evacuated for 1 hour while maintaining the temperature, to produce an argon atmosphere of $1 \times 10^{-4}$ torr in hydrogen gas partial pressure. Thereafter, the homogenized ingots were rapidly quenched by introducing argon gas into the furnace.

Figure 32:
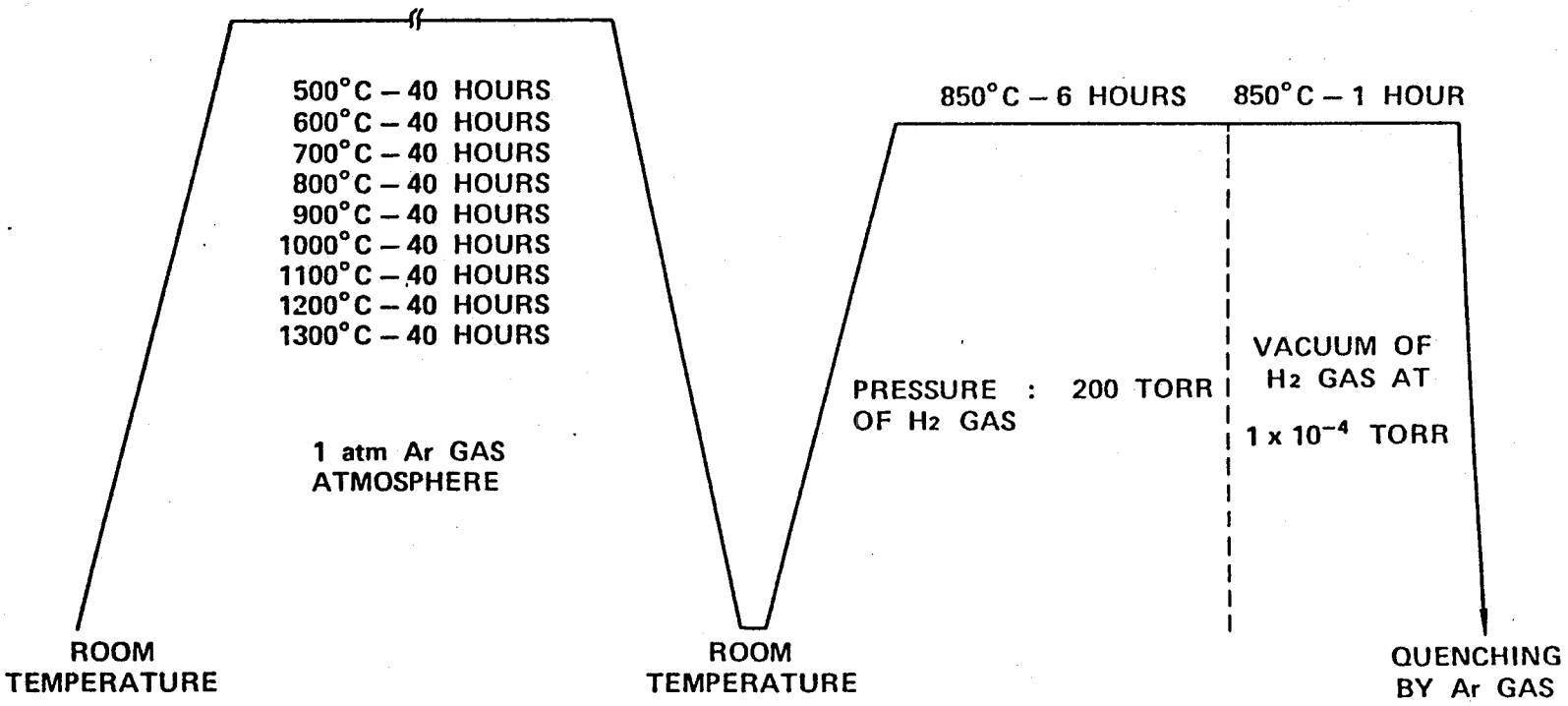
FIGS. 32 and 33 are patterns of Examples 34 and 35, respectively.

FIG. 32 shows the pattern of the procedure of this Example 34.

Since the homogenized ingots treated under the conditions as set forth in FIG. 32 had been already crushed to some extent, they were broken into pieces in a mortar, and neodymium-iron-boron alloy magnet powders having average particle sizes as set forth in Table 16 were obtained. The magnet powder thus obtained also had the recrystallized grain structure. The magnetic properties of the magnet powders, measured by a VSM, are shown in Table 16. These magnet powders were further blended with 3.0% by weight of phenol-novolak epoxy resins and subjected to compression molding under a pressure of 6 tons/cm$^2$ in a magnetic field of 15 KOe, following which the resins were solidified by holding the compacts at 120° C. for 6 hours, resulting in bonded magnets. The magnetic properties for the bonded magnets thus obtained are also set forth in Table 16.

As will be seen from Table 16, the ingots would rather be subjected to homogenizing treatment to improve the magnetic properties, and the temperature of homogenization should be preferably range from 600° C. to 1,200° C., more preferably from 900° C. to 1,100° C.

TABLE 16

| Kind of samples | Conditions of homogenization: Holding temperature (°C.) | Holding time (Hr) | Magnet powder: Average particle size (μm) | iHc (KOe) | Bonded magnets: Br (KG) | iHc (KOe) | $BH_{max}$ (MGOe) |
|---|---|---|---|---|---|---|---|
| Example 34 | not homogenized | | 42 | 7.0 | 6.5 | 6.7 | 4.0 |
| | 500 | 40 | 33 | 7.5 | 6.4 | 7.3 | 4.3 |
| | 600 | 40 | 35 | 9.5 | 6.1 | 9.5 | 8.1 |
| | 700 | 40 | 40 | 9.9 | 6.5 | 10.0 | 9.0 |
| | 800 | 40 | 36 | 9.8 | 6.4 | 9.6 | 8.8 |
| | 900 | 40 | 33 | 11.6 | 6.8 | 11.5 | 10.1 |
| | 1000 | 40 | 41 | 11.3 | 6.7 | 11.4 | 9.7 |
| | 1100 | 40 | 36 | 11.5 | 6.8 | 11.5 | 10.0 |
| | 1200 | 40 | 41 | 10.6 | 6.7 | 10.5 | 9.0 |
| | 1300 | 40 | Ignot had melted | | | | |

EXAMPLE 35

Figure 33:
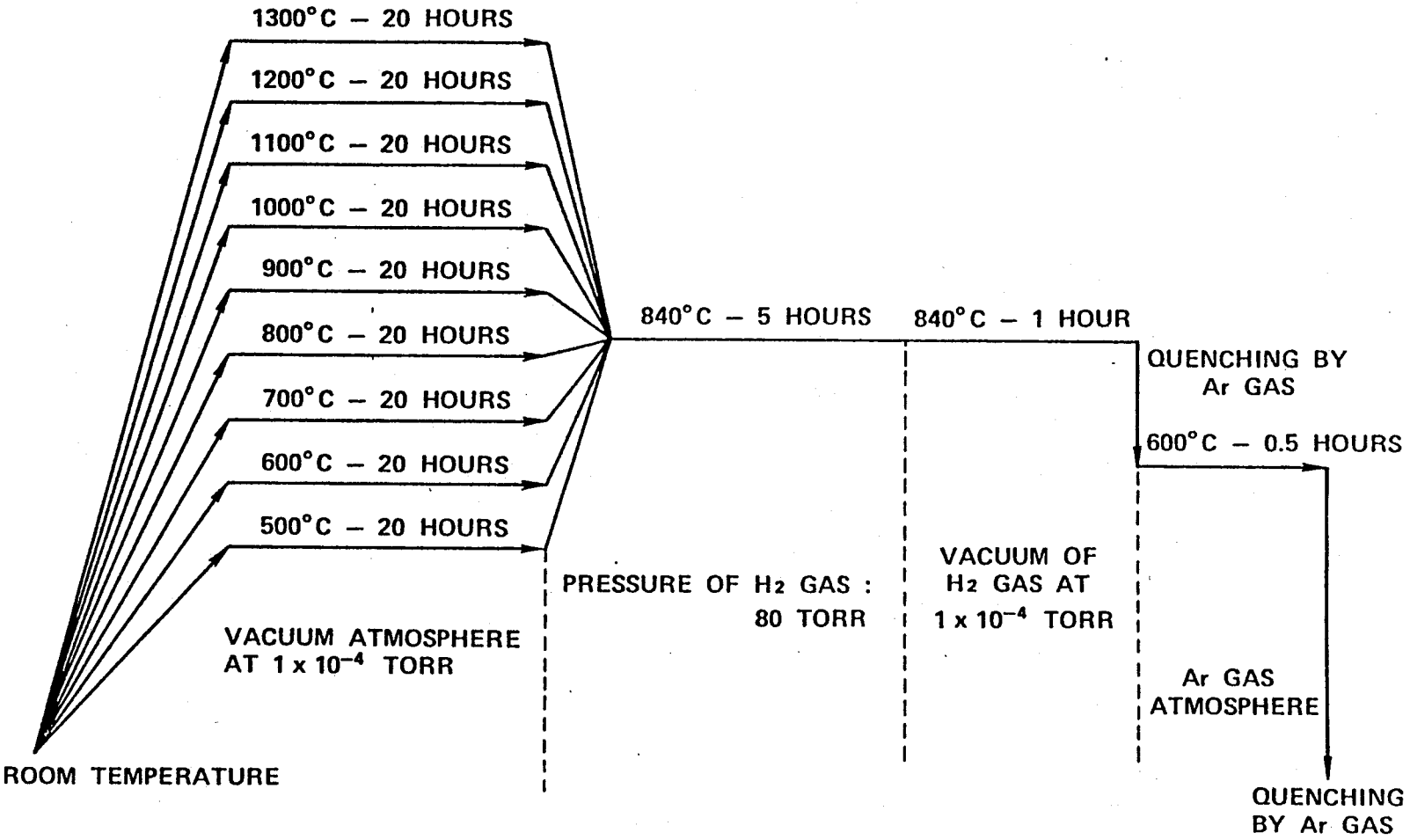

Neodymium was melted with iron, boron and cobalt (Co) in a high frequency induction furnace and cast into neodymium-iron-cobalt-boron alloy ingots of 20 mm in diameter and 20mm in height. Each ingot had a principal composition represented in atomic composition as $Nd_{14.0}Fe_{75.1}Co_{5.4}B_{5.5}$. The $Nd_2(Fe,Co)_{14}B$ phase serving as the principal phase was comprised of crystal grains of about 40 μm, and α- Fe phase or the like was formed. Each of the ingots was crushed in a stamp mill in an argon atmosphere into coarse powder of an average particle size of 42 μm. The powder thus prepared was introduced into a heat treating furnace, and subjected to homogenizing treatment in a vacuum atmosphere for 20 hours at various temperatures as set forth in Table 17. Subsequently, while leaving the homogenized powder in the vacuum atmosphere, hydrogen gas at 80 torr was introduced into the furnace, and while maintaining the pressure of the hydrogen gas, the temperature was raised or decreased to 840° C. After arrival at 840° C., the material was kept at the temperature for 5 hours, and then subjected to dehydrogenation by exhausting the furnace for 1 hour so that a vacuum of $1\times10^{-4}$ torr in the pressure of hydrogen was obtained. While leaving the above dehydrogenated coarse powders as they were, argon gas was introduced into the furnace to cool the powders to 600° C., and the powders were kept at the temperature for 0.5 hour. FIG. 33 shows the pattern of the procedures of this example. The coarse powders obtained from the procedures set forth in FIG. 33 were in the form of aggregates, and hence were broken into pieces in a mortar, so that the neodymium-iron-cobalt-boron alloy magnet powders having average particle sizes as set forth in Table 17 were obtained.

These magnet powders also had the recrystallized grain structures, and their magnetic properties were measured by a VSM. The results are shown in Table 17. The magnet powders thus obtained were blended with 3.0% by weight of phenol-novolak epoxy resin, and the procedures as in Example 34 were repeated to produce bonded magnets, of which magnetic properties are also shown in Table 17.

As will be seen from Table 17, for homogenizing the powder obtained by crushing the neodymium-iron-cobalt-boron alloy ingots having $Nd_{14.0}Fe_{75.1}Co_{5.4}B_{5.5}$, the homogenizing temperature should preferably be set in the range of 600° C. to 1,200° C., more preferably of 900° C. to 1,100° C.

TABLE 17

| Kind of samples | Conditions of homogenization: Holding temperature (°C.) | Conditions of homogenization: Holding time (Hr) | Magnet powder: Average particle size (μm) | Magnet powder: iHc (KOe) | Bonded magnets: Br (KG) | Bonded magnets: iHc (KOe) | Bonded magnets: $BH_{max}$ (MGOe) |
|---|---|---|---|---|---|---|---|
| Example 35 | not homogenized | | 42 | 8.1 | 6.5 | 6.8 | 4.0 |
| | 500 | 20 | 35 | 7.5 | 6.2 | 7.3 | 4.0 |
| | 600 | 20 | 38 | 10.0 | 6.2 | 9.9 | 8.1 |
| | 700 | 20 | 43 | 11.5 | 6.4 | 11.5 | 8.3 |
| | 800 | 20 | 40 | 11.3 | 6.6 | 11.2 | 9.1 |
| | 900 | 20 | 41 | 12.1 | 6.7 | 12.2 | 10.0 |
| | 1000 | 20 | 42 | 13.4 | 6.7 | 13.3 | 10.2 |
| | 1100 | 20 | 40 | 12.5 | 6.8 | 12.3 | 10.1 |
| | 1200 | 20 | 45 | 11.8 | 6.2 | 11.6 | 8.4 |
| | 1300 | 20 | Coarse powder had melted | | | | |

What is claimed is:

1. A process of producing a rare earth-iron-boron alloy magnet powder comprising the steps of:

(a) preparing a rare earth-iron-boron alloy material, (b) subsequently occluding hydrogen into said alloy material by holding said material at a temperature of 500° C. to 1000° C. in an atmosphere of a gas selected from the group consisting of hydrogen gas and a mixture of hydrogen and inert gases wherein the pressure of hydrogen in said atmosphere is no less than 10 torr;

(c) subsequently subjecting said alloy material to dehydrogenation at a temperature of 500° C. to 1000° C. until the pressure of hydrogen in said atmosphere is decreased to no greater than $1\times10^{-1}$ torr; and (d) subsequently cooling said alloy material.

2. A process of producing a rare earth-iron-boron alloy magnet powder according to claim 1, in which the temperature in said steps (b) and (c) is in the range of from 700° C. to 900° C.

3. A process of producing a rare earth-iron-boron alloy magnet powder according to claim 2, in which the temperature in said steps (b) and (c) is about 850° C.

4. A process of producing a rare earth-iron-boron alloy magnet powder according to claim 1, in which said alloy material prepared in said step (a) is in the form of an ingot.

5. A process of producing a rare earth-iron-boron alloy magnet powder according to claim 1, in which said alloy material prepared in said step (a) is in the form of powder.

6. A process of producing a rare earth-iron-boron alloy magnet powder according to claim 1, further comprising subjecting said alloy material to heat treatment at a temperature of 300° C. to 1,000° C. between said steps (c) and (d).

7. A process of producing a rare earth-iron-boron alloy magnet powder according to claim 1, further comprising subjecting said material to homogenizing treatment by holding said alloy material at a temperature of 600° C. to 1,200° C. between said steps (a) and (b).

8. A process of producing a, rare earth-iron-boron alloy magnet powder according to claim 7, in which the temperature in said homogenizing step is in the range from 900° C. to 1,100° C.

9. A process of producing a rare earth-iron-boron alloy magnet powder according to claim 7, further comprising subjecting said alloy material to heat treatment at a temperature of 300° C. to 1,000° C. between said steps (c) and (d).

10. A process of producing a rare earth-iron-boron, alloy magnet powder according to claim 1, claim 6, claim 7 or claim 9, in which the pressure of hydrogen in said atmosphere in said step (b) ranges from 10 torr to 760 torr.

11. A process of producing a rare earth-iron-boron alloy magnet powder according to claim 7, in which said alloy material has a composition represented in atomic percent by $R_x(Fe,B)_{100-x}$, wherein $11.7 \leqq x \leqq 15$, said material prepared in said step (a) being in the form of an ingot.

12. A process for producing a rare earth-iron-boron alloy magnet powder according to claim 1, further comprising, prior to the hydrogen-occluding step of step (b), elevating the temperature of said alloy from room temperature in an atmosphere of gas selected from the group consisting of hydrogen gas and a mixture of hydrogen gas and inert gases.

* * * * *

UNITED STATES PATENT AND TRADEMARK OFFICE

CERTIFICATE OF CORRECTION

PATENT NO. : 5,110,374

DATED : May 5, 1992

INVENTOR(S) : Takuo Takeshita, et al.

It is certified that error appears in the above-identified patent and that said Letters Patent is hereby corrected as shown below:

In the Abstract, line 10: "inot" should read as --into--

In the Drawings, Figure 13(a): " should read as --

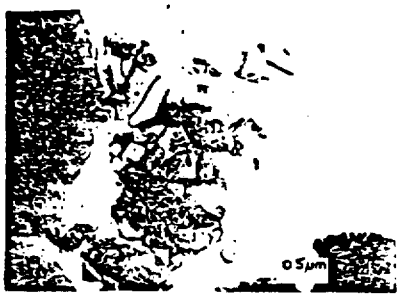

FIG.13(a)

--

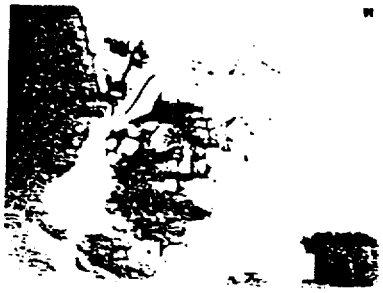

FIG.13(a)

"

UNITED STATES PATENT AND TRADEMARK OFFICE

CERTIFICATE OF CORRECTION

PATENT NO. : 5,110,374

DATED : May 5, 1992

INVENTOR(S) : Takuo Takeshita, et al.

It is certified that error appears in the above-identified patent and that said Letters Patent is hereby corrected as shown below:

In the Drawings, Figure 17(a):

" 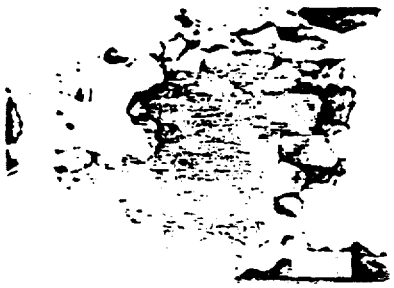 " should read as

FIG.17(a)

-- 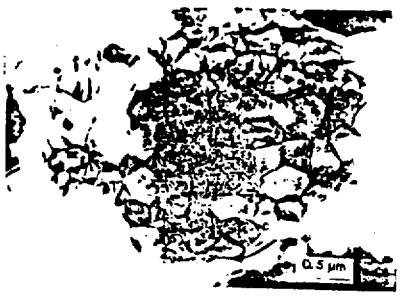 --

FIG.17(a)

Column 4, line 7: "500°0" should read as --500°--

Column 4, line 45: "the magnet" should read as --the present invention, obtained by crushing the ingot or permanent magnet--

UNITED STATES PATENT AND TRADEMARK OFFICE

CERTIFICATE OF CORRECTION

PATENT NO. : 5,110,374

DATED : May 5, 1992

INVENTOR(S) : Takuo Takeshita, et al.

It is certified that error appears in the above-identified patent and that said Letters Patent is hereby corrected as shown below:

Column 9, line 15: "0 05" should read as --0.05--

Column 10, line 7: "50" should read as --50%--

Column 14, line 15: "Fe phase" should read as -- -Fe phase--

Column 16, line 50: "Example The" should read as --Example 1. The--

Column 30, line 68: "filed" should read as --field--

Column 35, line 31, Table 15: "KOe)" should read as --(KOe)--

Signed and Sealed this

Nineteenth Day of October, 1993

*Attest:*

*Attesting Officer*

Bruce Lehman

BRUCE LEHMAN

*Commissioner of Patents and Trademarks*